US007258162B2

(12) United States Patent
Shibata et al.

(10) Patent No.: US 7,258,162 B2
(45) Date of Patent: Aug. 21, 2007

(54) HEAT EXCHANGER

(75) Inventors: Hiroshi Shibata, Kanagawa (JP); Takuya Murayama, Kanagawa (JP)

(73) Assignee: Matsushita Ecology Systems Co., Ltd., Aichi (JP)

( * ) Notice: Subject to any disclaimer, the term of this patent is extended or adjusted under 35 U.S.C. 154(b) by 109 days.

(21) Appl. No.: 10/559,318

(22) PCT Filed: Jun. 5, 2003

(86) PCT No.: PCT/JP03/07116

§ 371 (c)(1),
(2), (4) Date: Dec. 2, 2005

(87) PCT Pub. No.: WO2004/109210

PCT Pub. Date: Dec. 16, 2004

(65) Prior Publication Data

US 2006/0196649 A1 Sep. 7, 2006

(51) Int. Cl.
*F28F 3/04* (2006.01)

(52) U.S. Cl. ..... 165/166; 165/170

(58) Field of Classification Search ..... 165/164, 165/170, 166–168

See application file for complete search history.

(56) References Cited

U.S. PATENT DOCUMENTS

| | | | | |
|---|---|---|---|---|
| 2,865,613 | A * | 12/1958 | Egenwall et al. | 165/167 |
| 5,544,703 | A * | 8/1996 | Joel et al. | 165/167 |
| 5,851,636 | A * | 12/1998 | Lang et al. | 165/166 |

FOREIGN PATENT DOCUMENTS

| | | | |
|---|---|---|---|
| EP | 0 844 454 | A1 | 9/1997 |
| JP | 61-161397 | * | 7/1986 |
| JP | 08-075385 | A | 3/1996 |
| JP | 08-178577 | A | 7/1996 |
| JP | 2001-248993 | | 9/2001 |

OTHER PUBLICATIONS

International Search Report for PCT/JP2003/07116, dated Sep. 24, 2003.

* cited by examiner

*Primary Examiner*—Teresa J. Walberg
(74) *Attorney, Agent, or Firm*—RatnerPrestia

(57) ABSTRACT

A heat exchanger having light weight and an excellent recycling property and capable of exhibiting high sealing property of an air flow passage without using an adhesive agent. This heat exchanger is configured by alternately laminating heat transfer plates A and heat transfer plates B which are respectively integrated by vacuum molding a polystyrene sheet into heat transfer surface, air flow passage rib, air flow passage end surface, groove A, protrusion, outer peripheral rib A, outer peripheral rib B, air flow passage end surface cover, and a groove B. The groove A is brought into close contact with the groove B, upper surfaces of the outer peripheral rib A and the outer peripheral rib B are brought into close contact with the heat transfer plate, the protrusion is brought into close contact with the outer peripheral rib B and the groove B, the air flow passage end surface is brought into contact with the outer peripheral rib B, the air flow passage end surface cover is brought into contact with the end surfaces of the outer peripheral rib A and the outer peripheral rib B, and the side surfaces of the outer peripheral rib A are brought into contact with each other.

21 Claims, 36 Drawing Sheets

HEAT EXCHANGER

This Application is a U.S. National Phase Application of PCT International Application PCT/JP2003/007116.

TECHNICAL FIELD

The present invention relates to a heat exchanger for use in heat exchanging ventilation equipment or other air conditioning equipment, in which multiple heat transfer plates are laminated alternately and air flow passages A and air flow passages B are formed alternately.

BACKGROUND ART

Conventionally, as a conventional counter flow method heat exchanger of this type, the present applicant proposed a heat exchanger described in, for example, Japanese Patent Unexamined Application No. 8-75385.

Hereinafter, the heat exchanger is described with reference to FIGS. 44, 45 and 46.

As shown in FIG. 44, for forming parallel air flow passages on one side of flat plate 101 made of paper and the like, end ribs 102*a* that are disposed obliquely at substantially the same angles are provided in the vicinity of inlets and outlets of the air flow passages, and center ribs 102*b* connected to end ribs 102*a* are provided in the center portion for forming counter flow portions. End rib 102*a* and center rib 102*b* form substantially S-shaped rib 102.

Furthermore, also on the rear surface of plate 101, similar to S-shaped ribs 102 provided on the front surface, substantially S-shaped ribs 103 each composed of end rib 103*a* and center rib 103*b* are provided in a way in which end ribs 103*a* on the rear surface are respectively disposed obliquely with respect to end ribs 102*a* on the front surface, and center ribs 102*b* provided on the front surface are disposed intersecting center ribs 102*b* provided on the rear surface. Unit member 104 is configured by integrating S-shaped ribs 102 and 103 by using resin.

Between unit members 104, cut plate 105 made of paper and the like that was cut in a predetermined dimension is inserted. Unit member 104 and cut plate 105 are laminated so that the air flow passages A and the air flow passages B are formed alternately to form a heat exchanger. Fluid flowing in the air flow passage A and fluid flowing in the air flow passage B exchange beat by way of plate 101 and cut plate 105.

As an attachment structure of handle 106 used for attaching and detaching this type of heat exchanger to equipment and carrying the heat exchanger, for example, as shown in FIG. 47, a handle provided as a separate member on at least one end surface of the both end surfaces in the laminating direction has been known.

In such a conventional heat exchanger, since ribs other than plate 101 of unit member 104 are solid, weight is heavy and material cost is high.

Since plate 101 made of paper and the like and ribs are integrated with each other by using resin, it is difficult to classify a plurality of materials for recycling, and thus a recycling property is low.

Furthermore, a sealing property of the air flow passages A and the air flow passages B is deteriorated because of accuracy defect in cutting dimension and dislocation, and the like, of plates 101 and cut plates 105.

When unit members 104 and cut plates 105 are laminated alternately, it is difficult to laminate unit members 104 and cut plates 105 while positioning thereof in order to prevent dislocation of cut plates 105, and thus productive efficiency is low.

Furthermore, since handle 106 is provided on the end surface in the laminating direction of heat transfer plates, it is necessary to design equipment on which a heat exchanger is mounted in a way in which the direction of attaching and detaching the heat exchanger become the laminating direction, thus lowering the degree of freedom in designing of equipment on which the heat exchanger is mounted.

Furthermore, since fluid flowing in the air flow passages A and fluid flowing in the air flow passages B are opposed to each other in the central portion, although heat exchanging efficiency is improved as compared with a heat exchanger composed of only air flow passages having equal heat transferring areas that are disposed orthogonally or obliquely, the heat exchanging efficiency is still insufficient.

DISCLOSURE OF THE INVENTION

A heat exchanger comprises:

a heat transfer plate A and a heat transfer plate B;

a plurality of air flow passage ribs formed in a substantially S-shaped hollow convex and disposed substantially parallel to each other and substantially at equal intervals, the plurality of air flow passage ribs forming a plurality of substantially S-shaped air flow passages and heat transfer surfaces;

an air flow passage end surface provided at an inlet and an outlet of the air flow passage of the heat transfer plate A, the air flow passage end surface being provided obliquely or perpendicular to a direction of the inlet and outlet of the air flow passage and provided by folding the heat transfer surface in a direction opposite to a convex direction of the air flow passage rib;

a groove A provided parallel to the air flow passage end surface on the heat transfer plate A;

a plurality of protrusions each having a hollow shape being convex in the same direction as the convex direction of the air flow passage rib, which are provided between the groove A and the air flow passage end surface on extended lines of the plurality of air flow passage ribs on the heat transfer surface in the vicinity of the air flow passage end surface, each of the plurality of protrusions having a pair of side surfaces substantially parallel to the air flow passage end surface and being higher than a height in the convex direction of the plurality of air flow passage ribs;

outer peripheral edge portions being other than portions of the inlets and outlets of the air flow passages on the heat transfer plate, the outer peripheral edge portions including one pair of outer peripheral edge portions A facing each other and being adjacent to the inlets and outlets of the air flow passages and which are provided substantially parallel to substantially central portions of the plurality of substantially S-shaped air flow passage ribs, and another pair of outer peripheral edge portions B facing each other and being adjacent to the inlets and outlets of the air flow passages and which are provided substantially parallel to the air flow passage rib in the portion of the inlets and outlets of the plurality of substantially S-shaped air flow passages;

the outer peripheral edge portion A having an outer peripheral rib A obtained by forming the heat transfer surface into a hollow shape that is convex in the same direction as the convex direction of the air flow passage rib, in which a convex height of the outer peripheral rib A is higher than a height in a convex direction of the air flow passage rib A and an outer side surface of the outer peripheral rib A is folded in a direction opposite to the convex direction of the air flow passage rib so as to have a folding dimension that is larger than a dimension of the height in the convex direction of the outer peripheral rib A with respect to the heat transfer surface;

the outer peripheral edge portion B having an outer peripheral rib B obtained by forming the heat transfer surface into a hollow shape that is convex in the same direction as the convex direction of the air flow passage rib, in which a convex height of the outer peripheral rib B is the same height in a convex direction of the air flow passage rib B and a central portion of an outer side surface of the outer peripheral rib B is folded to the same plane as the heat transfer surface so as to have an opening portion at the outer side surface of the outer peripheral rib B;

an air flow passage end surface cover provided at both ends of the outer side surface of the outer peripheral rib B, which is folded to the same position as the folding position of the air flow passage end surface; and a groove B provided on an upper surface of the outer peripheral rib B, the groove B being caved to the same plane as the heat transfer surface, on a position in which a distance between a side surface of the outer peripheral rib B and a center line of the groove B is equal to a distance between a center line of the groove A and the air flow passage end surface, in a shape in which an outer surface in a longitudinal direction of the groove A is brought into close contact with an inner surface in a longitudinal direction of the groove B, wherein the heat transfer plate B is mirror-image relation to the heat transfer plate A;

in a shape of the heat transfer plate B, a height in a convex direction of the outer peripheral rib A of the heat transfer plate B is allowed to be the same as a height in a convex direction of the air flow passage rib;

furthermore, a width of the outer peripheral rib A of the heat transfer plate B is larger than a width of the outer peripheral rib A provided in the heat transfer plate A;

each of the heat transfer plate A and the heat transfer plate B is integrated by using one sheet as a material, respectively;

the heat transfer plates A and the heat transfer plates B are laminated alternately in a way in which the outer peripheral rib A of the heat transfer plate A and the outer peripheral rib A of the heat transfer plate B are overlapped with each other; and the heat transfer plates A and the heat transfer plates B are laminated to each other, resulting in forming the air flow passage A and the air flow passage B alternately; and wherein, when the heat transfer plates A and the heat transfer plates B are laminated alternately, upper surfaces of the air flow passage ribs, the protrusions, the outer peripheral ribs A and the outer peripheral ribs B are brought into contact with a heat transfer plate to be laminated on an upper part thereof;

the groove B is brought into contact with an upper surface of the outer peripheral rib B provided on a heat transfer plate located in a lower part of the groove B;

a pair of side surfaces of the protrusions being parallel to the air flow passage end surface are brought into contact with at least one of an inner side surface of the outer peripheral rib B and a side surface of the groove B provided in the heat transfer plate to be laminated on an upper part of the protrusions;

the air flow passage end surface is brought into contact with an outer side surface of the outer peripheral rib B provided on a heat transfer plate located in a lower part of the air flow passage end surface;

side surfaces of the outer peripheral ribs A provided respectively on the heat transfer plate A and the heat transfer plate B are brought into contact with each other; and the air flow passage end surface cover is brought into contact with an end surface of the outer peripheral rib A and the outer peripheral rib B provided on a heat transfer plate located in a lower part of the air flow passage end surface cover.

DETAILED DESCRIPTION OF THE PREFERRED EMBODIMENTS

Figure 1:
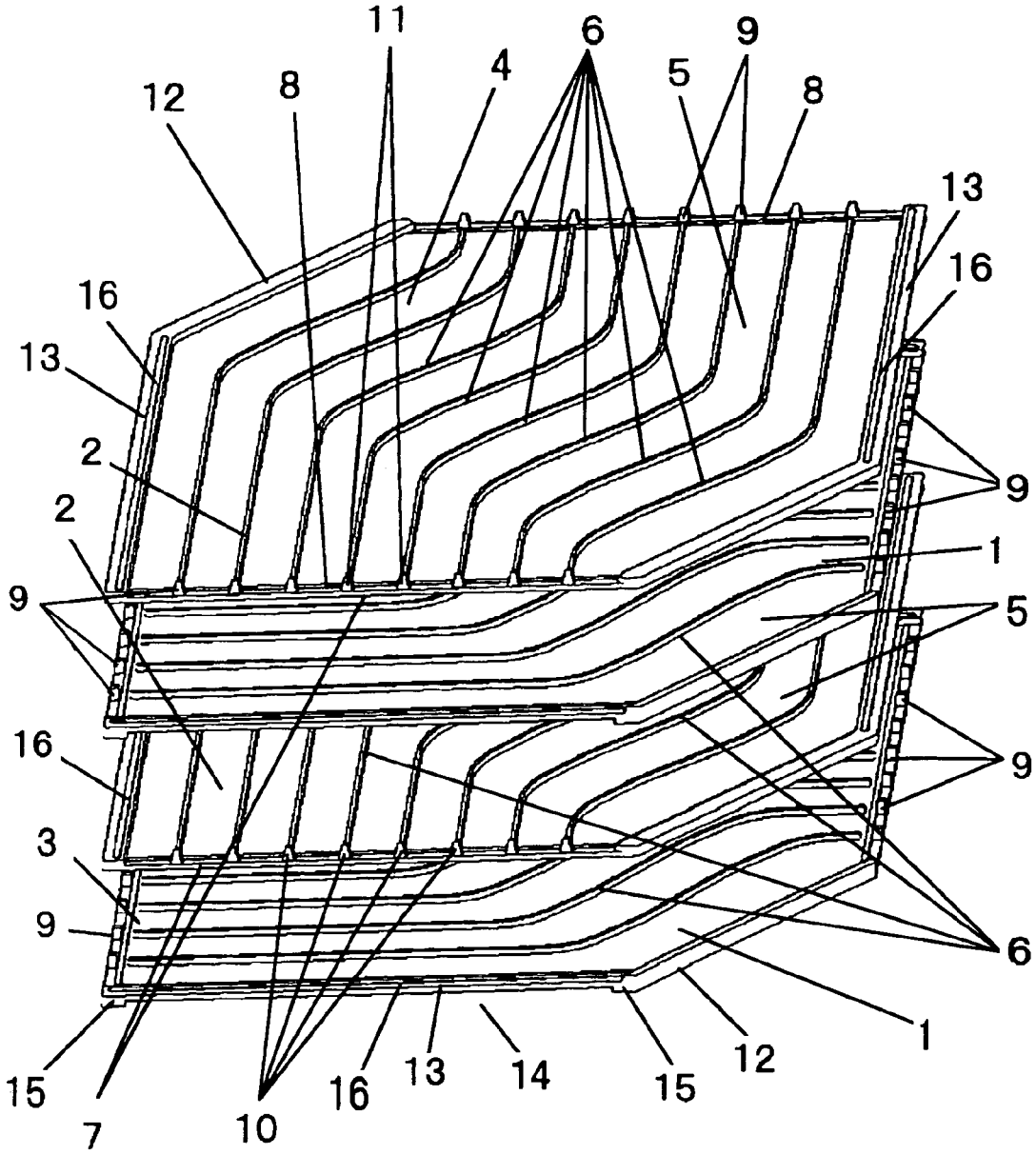
FIG. 1 is a schematic exploded perspective view showing a heat exchanger in accordance with Example 1 of the present invention.

The present invention was made to solve the above-mentioned conventional problems and the object of the present invention is to provide a heat exchanger capable of achieving light weight, low material cost, improvement of a recycling property, structure with a high sealing property, improvement in productive efficiency, a structure having a degree of freedom in the direction it is attached and detached, and improvement in heat exchanging efficiency.

According to the present invention, a heat exchanger includes a heat transfer plate A and a heat transfer plate B. The heat transfer plate A includes a plurality of air flow passage ribs formed in a substantially S-shaped hollow convex and disposed substantially parallel to each other and substantially at equal intervals, the plurality of air flow passage ribs forming a plurality of substantially S-shaped air flow passages and heat transfer surfaces; and an air flow passage end surface provided at an inlet and an outlet of the air flow passage of the heat transfer plate A, the air flow passage end surface being provided obliquely or perpendicular to a direction of the inlet and outlet of the air flow passage and provided by folding the heat transfer surface in a direction opposite to a convex direction of the air flow passage rib; a groove A provided parallel to the air flow passage end surface on the heat transfer plate A; a plurality of protrusions each having a hollow shape being convex in the same direction as the convex direction of the air flow passage rib, which are provided between the groove A and the air flow passage end surface on extended lines of the plurality of air flow passage ribs on the heat transfer surface in the vicinity of the air flow passage end surface, each of the plurality of protrusions having a pair of side surfaces substantially parallel to the air flow passage end surface and being higher than a height in the convex direction of the plurality of air flow passage ribs; outer peripheral edge portions being other than portions of the inlets and outlets of the air flow passages on the heat transfer plate, the outer peripheral edge portions including one pair of outer peripheral edge portions A facing each other and being adjacent to the inlets and outlets of the air flow passages and which are provided substantially parallel to substantially central portions of the plurality of substantially S-shaped air flow passage ribs, and another pair of outer peripheral edge portions B facing each other and being adjacent to the inlets and outlets of the air flow passages and which are provided substantially parallel to the air flow passage rib in the portion of the inlets and outlets of the plurality of substantially S-shaped air flow passages; the outer peripheral edge portion A having an outer peripheral rib A obtained by forming the heat transfer surface into a hollow shape that is convex in the same direction as the convex direction of the air flow passage rib, in which a convex height of the outer peripheral rib A is higher than a height in a convex direction of the air flow passage rib A and an outer side surface of the outer peripheral rib A is folded in a direction opposite to the convex direction of the air flow passage rib so as to have a folding dimension that is larger than a dimension of the height in the convex direction of the outer peripheral rib A with respect to the heat transfer surface; the outer peripheral edge portion B having an outer peripheral rib B obtained by forming the heat transfer surface into a hollow shape that is convex in the same direction as the convex direction of the air flow passage rib, in which a convex height of the outer peripheral rib B is the same height in a convex direction of the air flow passage rib B and a central portion of an outer side surface of the outer peripheral rib B is folded to the same plane as the heat transfer surface so as to have an opening portion at the outer side surface of the outer peripheral rib B; an air flow passage end surface cover provided at both ends of the outer side surface of the outer peripheral rib B, which is folded to the same position as the folding position of the air flow passage end surface; and a groove B provided on an upper surface of the outer peripheral rib B, the groove B being caved to the same plane as the heat transfer surface, on a position in which a distance between a side surface of the outer peripheral rib B and a center line of the groove B is equal to a distance between a center line of the groove A and the air flow passage end surface, in a shape in which an outer surface in a longitudinal direction of the groove A is brought into close contact with an inner surface in a longitudinal direction of the groove B. The heat transfer plate B is mirror-image relation to the heat transfer plate A; in a shape of the heat transfer plate B, a height in a convex direction of the outer peripheral rib A of the heat transfer plate B is allowed to be the same as a height in a convex direction of the air flow passage rib; furthermore, a width of the outer peripheral rib A of the heat transfer plate B is larger than a width of the outer peripheral rib A provided in the heat transfer plate A; each of the heat transfer plate A and the heat transfer plate B is integrated by using one sheet as a material, respectively; the heat transfer plates A and the heat transfer plates B are laminated alternately in a way in which the outer peripheral rib A of the heat transfer plate A and the outer peripheral rib A of the heat transfer plate B are overlapped with each other; and the heat transfer plates A and the heat transfer plates B are laminated to each other, resulting in forming the air flow passage A and the air flow passage B alternately. When the heat transfer plates A and the heat transfer plates B are laminated alternately, upper surfaces of the air flow passage ribs, the protrusions, the outer peripheral ribs A and the outer peripheral ribs B are brought into contact with a heat transfer plate to be laminated on an upper part thereof; the groove B is brought into contact with an upper surface of the outer peripheral rib B provided on a heat transfer plate located in a lower part of the groove B; a pair of side surfaces of the protrusions being parallel to the air flow passage end surface are brought into contact with at least one of an inner side surface of the outer peripheral rib B and a side surface of the groove B provided in the heat transfer plate to be laminated on an upper part of the protrusions; the air flow passage end surface is brought into contact with an outer side surface of the outer peripheral rib B provided on a heat transfer plate located in a lower part of the air flow passage end surface; side surfaces of the outer peripheral ribs A provided respectively on the heat transfer plate A and the heat transfer plate B are brought into contact with each other; and the air flow passage end surface cover is brought into contact with an end surface of the outer peripheral rib A and the outer peripheral rib B provided on a heat transfer plate located in a lower part of the air flow passage end surface cover. With this, the following effect is exhibited. When the heat transfer plates A and the heat transfer plates B are laminated alternately, the outer surface of the groove A is brought into close contact with the inner surface of the groove B in the adjacent heat transfer plates; the upper surface of the outer peripheral rib A and the upper surface of the outer peripheral rib B are brought into close contact with the heat transfer plate laminated on the upper part; the air flow passage end surface is brought into contact with the outer side surface of the outer peripheral rib B provided on a heat transfer plate located in the lower part; the side surfaces of the outer peripheral rib A provided on the adjacent heat transfer plates are brought into contact with each other; and the air flow passage end surface cover is brought into contact with the end surfaces of the outer peripheral rib A and the outer peripheral rib B provided on a heat transfer plate located in the lower part. Thus, the air flow passage A and the air flow passage B are sealed with each other at the peripheral portions thereof. The protrusions provided at the inlet and outlet of the air flow passage A and the air flow passage B are brought into close contact with the rear surface of the outer peripheral rib B formed on the heat transfer plate laminated on the upper part. Thereby, the sealing property between the outer peripheral rib B formed on a heat transfer plate to be laminated on the upper part of the protrusions and a heat transfer surface formed on a heat transfer plate to be laminated on the further upper part is improved. The groove A provided in the inlet and outlet of air flow passage reinforces a heat transfer plate on the inlet and outlet portion of the air flow passage; and the groove B provided on the upper surface of the outer peripheral rib B reinforces the outer peripheral rib B. Thereby, the upper surface of the outer peripheral rib B and the heat transfer plate laminated on the upper part are suppressed from being deformed when they are brought into close contact with each other, and the sealing property is improved. In a position where the outer peripheral ribs B provided in the adjacent heat transfer plates intersect each other, the groove B provided on the heat transfer plate laminated on the upper part is brought into contact with the upper surface of the outer peripheral rib B provided on a heat transfer plate located in the lower part. Thereby, deformation in the laminating direction is suppressed and deterioration in the sealing property due to the deformation can be prevented. The outer surface of the groove A is brought into close contact with the inner surface of the groove B of the adjacent heat transfer plates. The air flow passage end surface is brought into contact with the outer side surface of the outer peripheral rib B provided on a heat transfer plate located in the lower part; the side surfaces of the outer peripheral ribs A provided in the adjacent heat transfer plates are brought into contact with each other; the air flow passage end surface cover is brought into contact with the end surfaces of the outer peripheral rib A and the outer peripheral rib B provided on a heat transfer plate located in the lower part; and a pair of side surfaces that are parallel to the air flow passage end surface provided on the protrusion are brought into contact with at least one of the inner side surface of the outer peripheral rib B and the side surface of the groove B, which are provided on the heat transfer plate laminated on the upper part. Thus, dislocation of the laminated heat transfer plates is suppressed and the sealing properties of the air flow passage A and the air flow passage B are prevented from being deteriorated due to the dislocation. Thus, positioning can be carried out easily when the heat transfer plates are laminated, and the air flow passage ribs, the outer peripheral ribs A, the outer peripheral ribs B and the protrusions are molded in a hollow shape by using one sheet. Consequently, light weight and the reduction in the amount of materials can be realized. Since the heat transfer plate is molded by a sheet of a single material, a recycling property can be improved. Fluid is also flown to the inner surface of the air flow passage rib and heat exchange can be carried out also in the air flow passage rib, and thus, heat exchanging efficiency is improved.

Furthermore, a thermoplastic resin sheet is used as a sheet material. With the feature of the thermo plastic resin that molding can be carried out easily for a short time, an effect of improving productive efficiency is exhibited.

Furthermore, a styrene resin sheet is used as a sheet material. With the feature that the styrene resin sheet is hard, the effect is exhibited, in which the strength at the time of laminating in portions in which adjacent heat transfer plates are brought into close contact with each other or brought into contact with each other can be secured, and thus a sealing property is improved and at the same time, workability is excellent and productive efficiency is improved.

Furthermore, a polystyrene resin sheet is used as a sheet material. With this material, the effect is exhibited, in which material cost is low, shrinkage is small, dimension stability is excellent, dimension accuracy of a molded product is high, a sealing property is improved, moldability is excellent and productive efficiency is improved.

Furthermore, when the heat transfer plates A and the heat transfer plates B are integrated with each other, by carrying out a molding process by the use of a molding die having a rectangular shaped portion that continues to the outer side surface of the outer peripheral rib B and has a cross sectional shape equal to an opening portion formed on the outer side surface of the outer peripheral rib B, and then cutting a portion formed by the rectangular shaped portion and a sheet portion other than the heat transfer plate A and the heat transfer plate B along the outer side surfaces of the heat transfer plate A and the heat transfer plate B, the heat transfer plate A and the heat transfer plate B are manufactured. With this, the following effect is exhibited. Since the outer periphery of the heat transfer plate is cut in a predetermined dimension and at the same time, an opening portion of the inlet and outlet of the air flow passage provided on the side surface of the outer peripheral rib B is formed, productivity is enhanced as compared with a working process for forming an opening portion of the inlet and outlet by molding the side surface portion of the outer peripheral rib B to the folding positions of the air flow passage end surface covers provided at both ends of the side surface of the outer peripheral rib B, and then cutting the central portion of the side surface portion of the outer peripheral rib B.

Furthermore, in at least two corner portions of the heat transfer plate A and the heat transfer plate B, overlapped portions of the air flow passage end surface cover, the outer peripheral rib A, the outer peripheral rib B or the air flow passage end surface, which are formed on an outer side surface of adjacent heat transfer plates, are thermally welded over an entire length in the laminated direction. With this, the following effect is exhibited. In the laminated adjacent heat transfer plates, the air flow passage end surface cover and the end surface of outer peripheral rib A, the air flow passage end surface cover and the end surface of outer peripheral rib B, the air flow passage end surface and the side surface of outer peripheral rib B, and the side surfaces of outer peripheral rib A are thermally welded to be fixed, respectively. Thus, deterioration of the sealing property of the air flow passages due to dislocation of the heat transfer plates is prevented and the sealing property is improved.

Furthermore, in a surface on which the inlets and outlets of the air flow passages A and the air flow passages B are formed, overlapped portions of the air flow passage end surface cover, the outer peripheral rib A, the outer peripheral rib B and the air flow passage end surface, which are formed on an outer side surface of adjacent heat transfer plates, are thermally welded over an entire surface. With this, the following effect is exhibited. In the laminated adjacent heat transfer plates, the air flow passage end surface and the side surface of the outer peripheral rib A, the air flow passage end surface cover and the side surface of the outer peripheral rib A, and the air flow passage end surface cover and the side surface of the outer peripheral rib B are thermally welded, respectively. Thus, the outer side surface of outer peripheral ribs B of another air flow passage facing the inlet and outlet portion of one air flow passage is sealed. Furthermore, dislocation of the heat transfer plates is suppressed and the sealing property of the air flow passages is improved.

Furthermore, overlapped portions on an outer side surface of adjacent heat transfer plates are thermally welded over an entire surface. With this, the following effect is exhibited. In the laminated adjacent heat transfer plates, the air flow passage end surface and the side surface of the outer peripheral rib A, the air flow passage end surface cover and the side surface of the outer peripheral rib A, and the air flow passage end surface cover and the end surface of the outer peripheral rib B are thermally welded, respectively. Thus, the outer side surface of outer peripheral ribs B of another air flow passage facing the inlet and outlet portion of one air flow passage is sealed. Furthermore, outer side surfaces of the outer peripheral ribs A of the laminated adjacent heat transfer plates are thermally welded. Thereby, dislocation of the heat transfer plates is suppressed and that the sealing property of the air flow passages is improved.

Furthermore, when adjacent portions on an outer side surface of the heat exchanger is thermally welded, the adjacent portions on an outer side surface of the heat exchanger is thermally welded simultaneously by a thermal welding means having a thermally welding surface having a shape corresponding to a shape of the adjacent portions on an outer side surface of the heat exchanger. With this, the following effect is exhibited. Since adjacent portions to be thermally welded that are not present on the same plane are thermally welded simultaneously, productive efficiency is improved.

Furthermore, when adjacent portions on an outer side surface of the heat exchanger are thermally welded, by vertically pressing a thermal welding means having substantially the same shape as respective surfaces to be thermally welded to a surface to be thermally welded, the outer side surface of the heat exchanger is thermally welded. With this, the following effect is exhibited. By vertically pressing the thermal welding means to a surface to be thermally welded, the adhesiveness at the time of thermal welding in the portion in which the outer side surfaces of the heat transfer plates are overlapped with each other is improved and the sealing property is improved.

Furthermore, the outer side surface of the heat exchanger is thermally welded by the use of a thermal welding means having a cylindrical-shaped thermally welding surface, by pressing the thermally welding surface of the thermal welding means to the heat exchanger and moving while rotating it from an upper part to a lower part along a laminating direction of the heat transfer plates. With this, the following effect is exhibited. Since the thermal welding means moves while rotating from the upper part to the lower part along the laminating direction, the direction in which the thermal welding means is rotated and the direction in which the outer peripheral side surface of the heat transfer plate is folded are the same. Consequently, the occurrence of warp, folding, or the like, of the outer peripheral side surface of the heat transfer plate at the time of thermal welding is prevented. Furthermore, the direction of level difference between the cut portion of the outer side surface of the heat transfer plate and the outer peripheral side surface of the heat transfer plate located in the lower part, which occurs due to overlapping of the outer side surfaces of the heat transfer plates, is substantially parallel to the thermal welding means. Consequently, defective thermal welding due to the level difference in the outer side surfaces of the heat transfer plates is prevented, and thus a heat exchanger with a high sealing property can be obtained.

Furthermore, the heat exchanger includes the first end surface members, which are facing each other, at both end surfaces in the laminating direction in which the heat transfer plates A and the heat transfer plates B are laminated alternately; a side surface plate covering an outer side surface of the laminated heat transfer plates A and the heat transfer plates B and which is provided at an outer peripheral edge portion of the first end surface member; a support member provided on an outer side surface of the outer peripheral rib A of the laminated heat transfer plates with both ends thereof coupled to the first end surface members; elastic bodies included between the first end surface members and the heat transfer plates located at both ends, respectively, the elastic body having a shape of pressing at least outer peripheral edge portions of the heat transfer plates located at both end surfaces; and a handle provided on at least one of the first end surface member and the support member. With this, the following effect is exhibited. Since a handle is provided in the direction perpendicular to the laminating direction of the heat transfer plates or in the laminating direction, a heat exchanger can be attached and detached to/from equipment in the laminating direction or in the direction perpendicular to the laminating direction, so that the direction of attaching and detaching the heat exchanger to/from equipment is expanded. Since the side surface plate is formed in a shape covering the outer side surface of the heat transfer plates, fluid is suppressed from flowing into the portion between the first end surface member and the heat transfer plates located at both ends. Since the elastic body presses at least the outer peripheral portion of heat transfer plate located at both end surfaces, sealing is carried out between the first end surface members and the heat transfer plates located at both ends, respectively. Furthermore, since the side surface plate is formed in a shape covering the outer side surface of the heat transfer plates, positioning can be carried out easily.

Furthermore, the first end surface members and the support members are integrated with each other with one of the support members separated. After the integrated first end surface members and support members are attached to the laminated heat transfer plates, the separated portion of the separated support member is coupled. The first end surface member is disposed at the end surface of the laminated heat transfer plates via the elastic body. After the support member is disposed on the outer side surface of the outer peripheral ribs A of the laminated heat transfer plates, a coupling operation between the first end surface member and the support member is carried out only by the coupling operation of the separated portion of the separated support member.

Furthermore, the heat exchanger includes second end surface members affixed to heat transfer plates located at both end surfaces of the alternately laminated heat transfer plates A and heat transfer plates B, the second end surface member being formed of an elastic body molded in a shape that is the same as a shape of the outer peripheral edge portion of at least the heat transfer plate A or the heat transfer plate B; and a band-like handle member provided along at least one side surface of the outer side surface of the outer peripheral rib A, the band-like handle member being fixed to the heat transfer plates located at both end surfaces by the second end surface members. With this, the following effect is exhibited. An operation of affixing the second end surface members to the heat transfer plates located at both end surfaces of the laminated heat transfer plates respectively and an operation of fixing the band-like handle member are carried out simultaneously. Furthermore, since the second end surface member is formed of an elastic body, the second end surface member is pressed in the laminating direction when the heat exchanger is mounted onto equipment and the sealing is carried out at the end surfaces of the heat exchanger when the heat exchanger is mounted onto equipment. Since the band-like handle member is provided along at least one surface of the outer side surfaces of the outer peripheral rib A of the laminated heat transfer plates, the heat exchanger can be attached and detached in the direction of the side surfaces of the outer peripheral rib A.

Furthermore, the heat exchanger includes second end surface members affixed to heat transfer plates located at both end surfaces of the alternately laminated heat transfer plates A and heat transfer plates B, the second end surface member being formed of an elastic body molded in a shape that is the same as a shape of the outer peripheral edge portion of at least the heat transfer plate A or the heat transfer plate B; and a band-like handle member provided along the outer side surface of the outer peripheral rib A, the band-like handle member being fixed to the heat transfer plate located at the end surface by the second end surface member at one end surface in the laminating direction of the laminated heat transfer plates, and disposed at the outside of the second end surface member at another end in the laminating direction of the laminated heat transfer plates. With this, the following effect is exhibited. An operation of affixing the second end surface member to the heat transfer plate located at one of the end surfaces of the laminated heat transfer plates and an operation of fixing the band-like handle member are carried out simultaneously. Furthermore, since the second end surface member is formed of an elastic body, the second end surface member is pressed in the laminating direction when the heat exchanger is mounted onto equipment and the sealing is carried out at the end surfaces of the heat exchanger when the heat exchanger is mounted onto equipment. Since the band-like handle member is provided along at least one surface of the outer side surfaces of the outer peripheral rib A of the laminated heat transfer plates, the heat exchanger can be attached and detached in the laminating direction of the heat transfer plates or in the laminating direction of the heat transfer plates and the direction of side surface of the outer peripheral rib A.

Furthermore, a side surface reinforcement convex portion is provided on an upper surface of the outer peripheral rib A of the heat transfer plate B, and when the heat transfer plates A and the heat transfer plates B are laminated alternately, an upper surface of the outer peripheral rib A formed on the heat transfer plate A is brought into contact with a rear surface of the outer peripheral rib A formed on the heat transfer plate B, an upper surface of the outer peripheral rib A formed on the heat transfer plate B is brought into contact with a rear surface of the heat transfer surface provided on the heat transfer plate A, and an upper surface and a side surface of the side surface reinforcement convex upper surface formed on the outer peripheral rib A of the heat transfer plate B are brought into contact with a rear surface and a side surface of the outer peripheral rib A formed on the heat transfer plate A. With this, the following effect is exhibited. When adjacent surfaces of the outer side surfaces of the outer peripheral ribs A of the heat exchanger are thermally welded, since the side surface reinforcement convex portion of the heat transfer plate B is brought into contact with a hollow convex portion of the outer peripheral ribs A of the heat transfer plate A, after heated transfer plates are melted, when a temperature decreases and respective heat transfer plates are welded, deformation of the side surface portion due to temperature shrinkage is prevented. Furthermore, deterioration of sealing property due to deformation is prevented and the sealing property of the side surface portion is improved.

Furthermore, the side surface reinforcement convex portion is formed in a discontinuous structure. With this, the following effect is exhibited. When adjacent surfaces of the outer side surfaces of the outer peripheral ribs A of the heat exchanger are thermally welded, since the side surface reinforcement convex portion of the heat transfer plate B is brought into contact with a hollow convex portion of the outer peripheral ribs A of the heat transfer plate A, after heated transfer plates are melted, when a temperature decreases and respective heat transfer plates are welded, deformation of the side surface portion due to temperature shrinkage is prevented. Furthermore, deterioration of sealing property due to deformation is prevented and the sealing property of the side surface portion is improved.

Furthermore, a side surface reinforcement convex portion is provided on an upper surface of the outer peripheral rib A of the heat transfer plate A and the heat transfer plate B, and when the heat transfer plates A and the heat transfer plates B are laminated alternately, an upper surface and a side surface of the side surface reinforcement convex portion formed on the heat transfer plate A are brought into contact with a rear surface and a side surface of the outer peripheral rib A formed on the heat transfer plate B, and an upper surface and a side surface of the side surface reinforcement convex portion formed on the heat transfer plate B are brought into contact with a rear surface and a side surface of the outer peripheral rib A. With this, the following effect is exhibited. When adjacent surfaces of the outer side surfaces of the outer peripheral ribs A of the heat exchanger are thermally welded, since the side surface reinforcement convex portion is brought into contact with a hollow convex portion of the outer peripheral ribs A of the heat transfer plate A and the heat transfer plate B, after heated transfer plates are melted, when a temperature decreases and respective heat transfer plates are welded, deformation of the side surface portion due to temperature shrinkage is prevented. Furthermore, deterioration of sealing property due to deformation is prevented and the sealing property of the side surface portion is improved.

Furthermore, when the heat transfer plates A and the heat transfer plates B are laminated alternately, an upper surface and a side surface of the outer peripheral rib A formed on the heat transfer plate A are brought into contact with a rear surface and a side surface of the outer peripheral rib A formed on the heat transfer plate B, and an upper surface and a side surface of the side surface reinforcement convex portion formed on the outer peripheral rib A of the heat transfer plate B are brought into contact with a rear surface and a side surface of the outer peripheral rib A formed on the heat transfer plate A. With this, the following effect is exhibited. When adjacent surfaces of the outer side surfaces of the outer peripheral ribs A of the heat exchanger are thermally welded, since the side surface reinforcement convex portion of the heat transfer plate B is brought into contact with a hollow convex portion of the outer peripheral ribs A of the heat transfer plate A, after heated transfer plates are melted, when a temperature decreases and respective heat transfer plates are welded, deformation of the side surface portion due to temperature shrinkage is prevented. Furthermore, deterioration of sealing property due to deformation is prevented and the sealing property of the side surface portion is improved.

Hereinafter, Examples of the present invention are described with reference to drawings.

EXAMPLE 1

Hereinafter, Example 1 of the present invention is described with reference to FIGS. 1, 2, 3, 4, 5, 6, 7 and 8.

Figure 2:
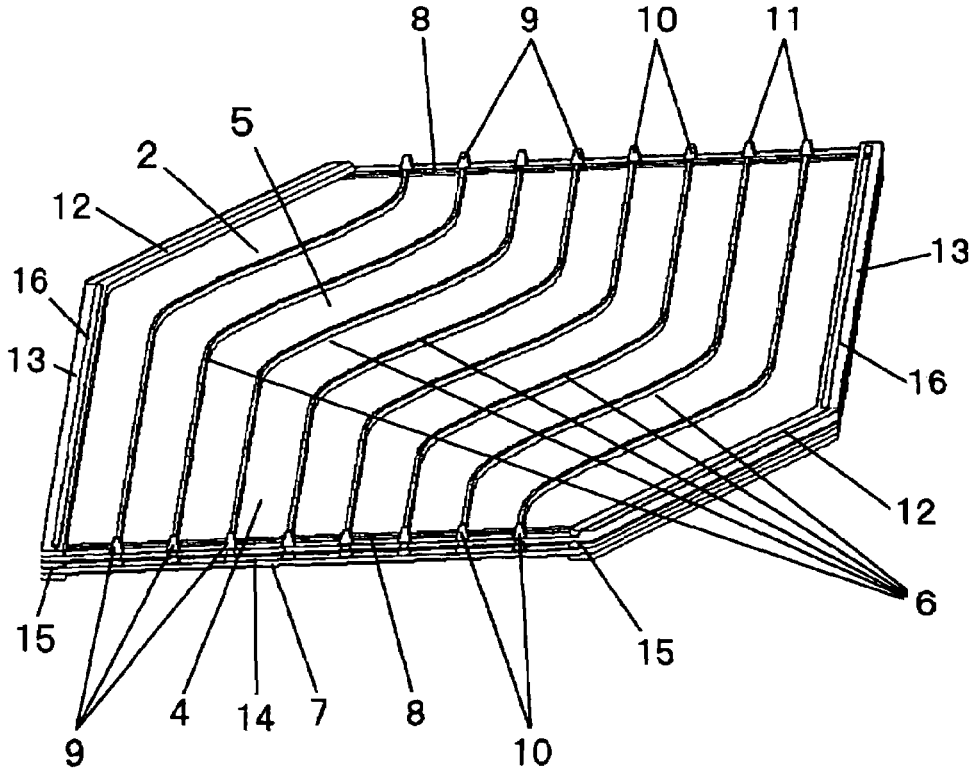
FIG. 2 is a schematic perspective view showing a laminated state in accordance with Example 1.
Figure 3:
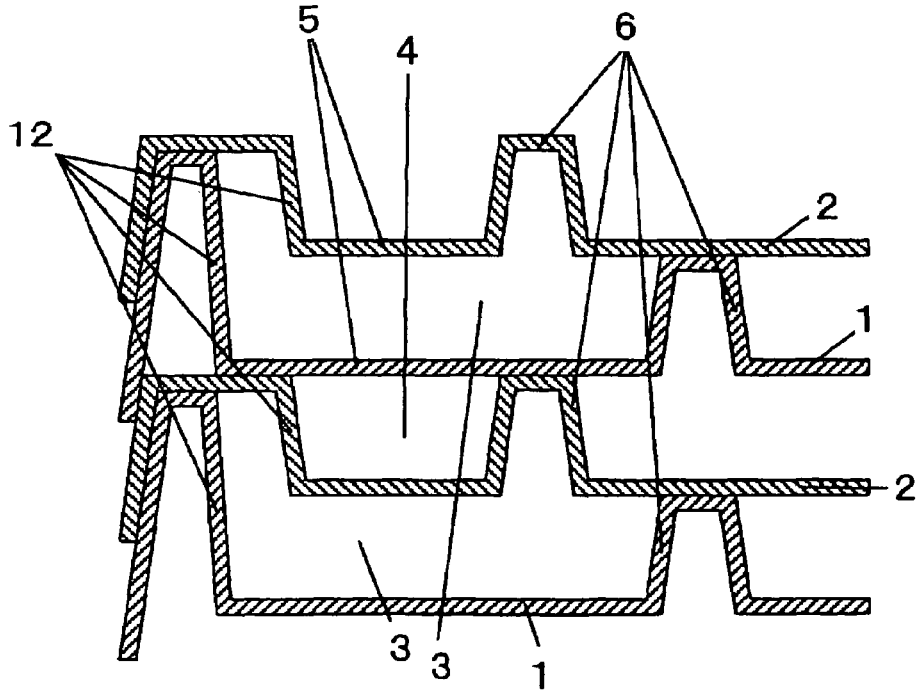
FIG. 3 is a schematic sectional view showing a laminated state of a side surface portion in accordance with the Example 1.
Figure 4:
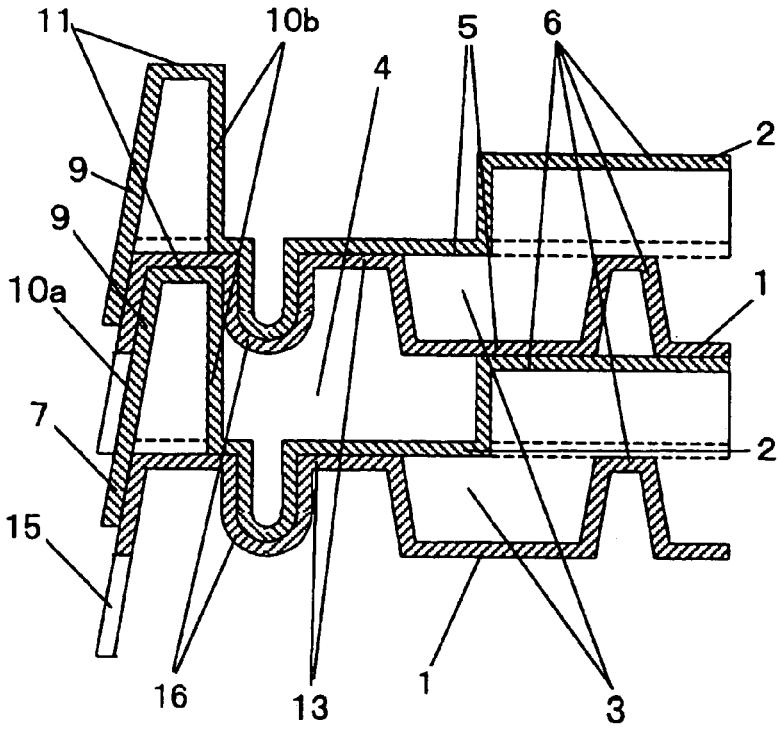
FIG. 4 is a schematic sectional view showing a laminated state of the portion of inlets and outlets of air flow passages in accordance with Example 1.
Figure 5:
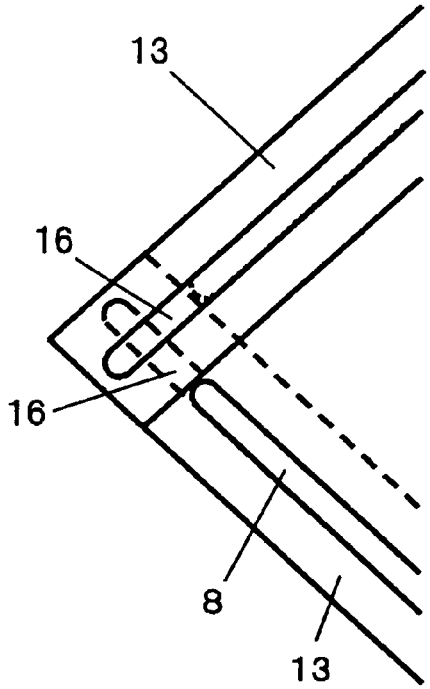
FIG. 5 is a schematic perspective projection plan view showing a laminated state of a corner portion in which the portion of inlets and outlets of air flow passages are adjoined to each other in accordance with the Example 1.
Figure 6:
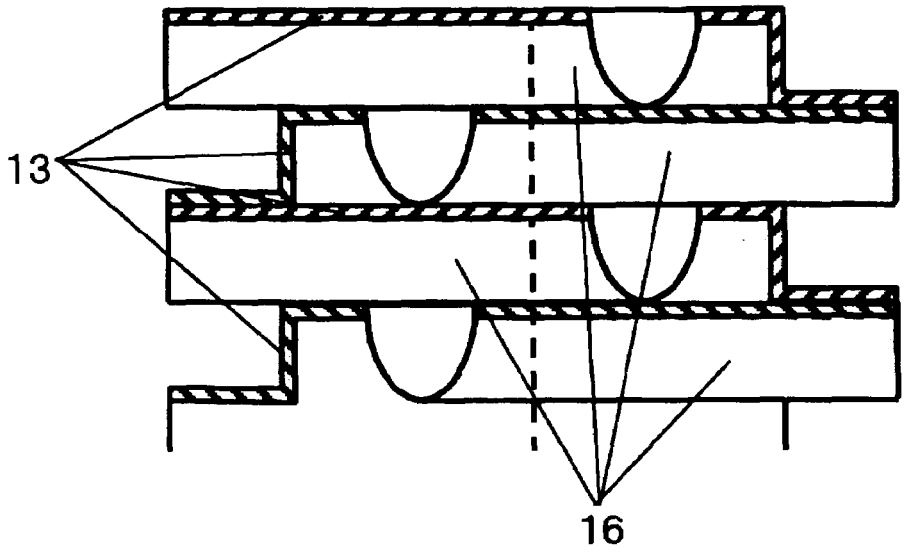
FIG. 6 is a schematic perspective projection front view showing a laminated state of a corner portion in which the portion of inlets and outlets of air flow passages are adjoined to each other in accordance with the Example 1.
Figure 7:
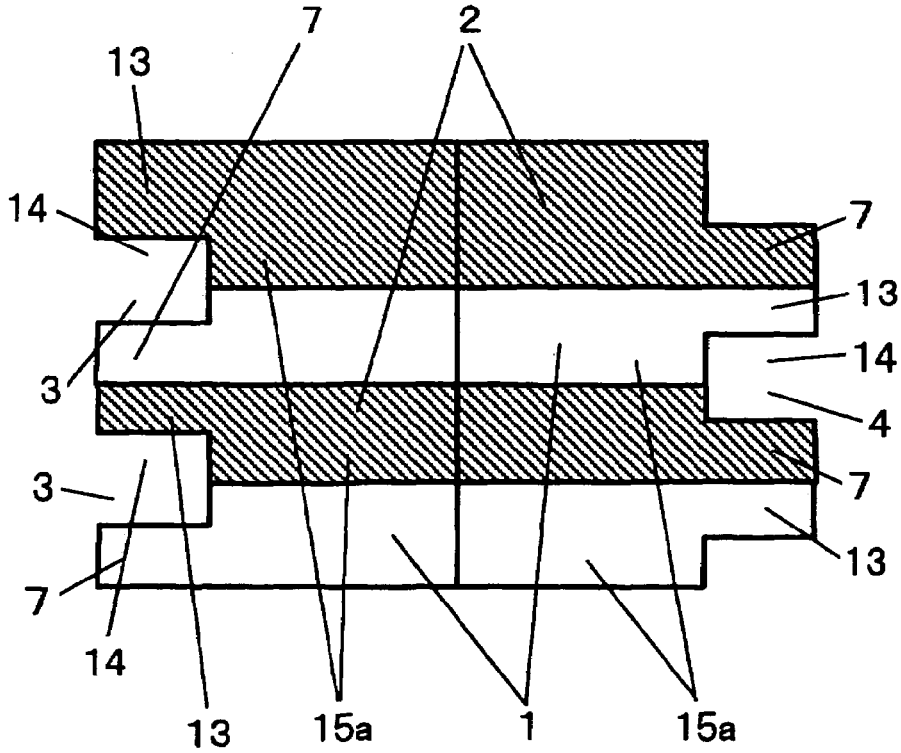
FIG. 7 is a schematic front view showing a laminated state of a corner portion in which the portion of inlets and outlets of air flow passages are adjoined to each other in accordance with the Example 1.
Figure 8:
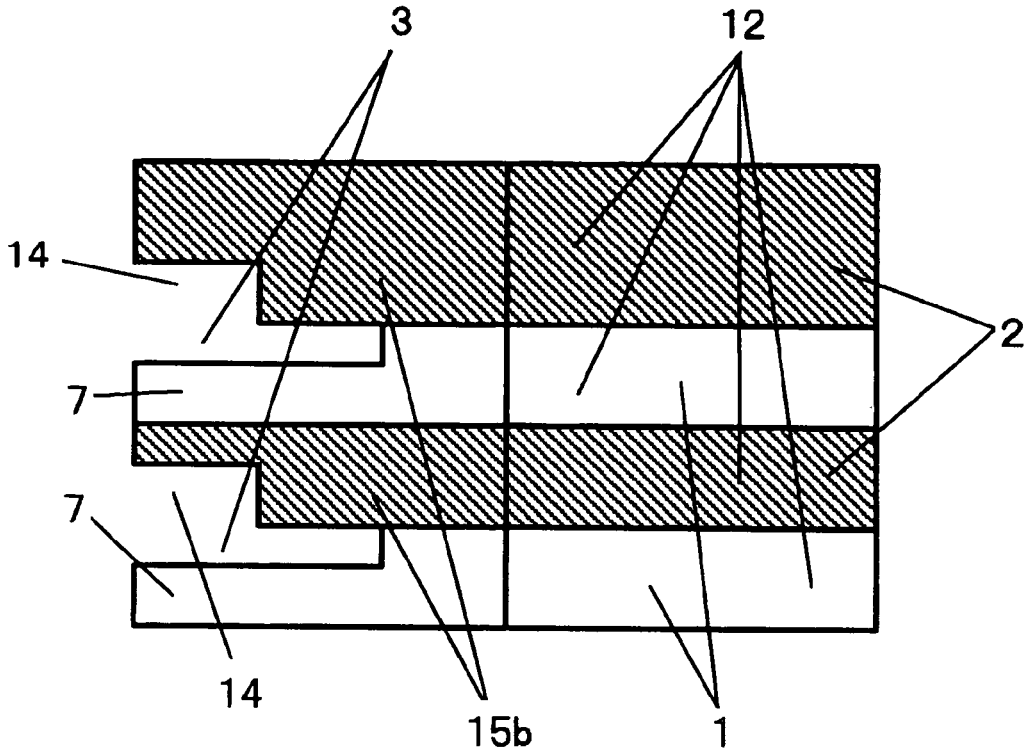
FIG. 8 is a schematic front view showing a laminated state of the portion of inlets and outlets of air flow passages at side of the side surface in accordance with the Example 1.

FIG. 1 is a schematic exploded perspective view showing a heat exchanger used in this Example; FIG. 2 is a schematic perspective view showing a state in which heat transfer plates are laminated; FIG. 3 is a schematic sectional view showing a side surface portion thereof; FIG. 4 is a schematic sectional view showing a portion of inlets and outlets of air flow passages thereof; FIG. 5 is a schematic perspective projection plan view showing a corner portion in which the portion of inlets and outlets of air flow passages A and the portion of inlets and outlets of air flow passages B are adjoined to each other; FIG. 6 is a schematic perspective projection front view thereof; FIG. 7 is a schematic front view thereof; and FIG. 8 is a schematic front view showing the portion of inlets and outlets of air flow passages at the side of the side surface of the heat transfer plate.

In FIGS. 1 and 2, a heat exchanger configured by alternately laminating heat transfer plates A1 and heat transfer plates B2 is a counter-flow type heat exchanger in which air flow passages A3 and air flow passages B4 are provided at the upper and lower parts of the respective heat transfer plates, fluid flowing in air flow passages A3 exchanges heat via the respective heat transfer plates, flows obliquely each other in portions of inlets and outlets of the respective air flow passages, and flows in the direction in which they are opposing to each other in the central portions of the air flow passages.

Actually, multiple heat transfer plates A1 and heat transfer plates B2 are laminated alternately. However, for simplification, only four heat transfer plates are shown.

Heat transfer plate A1 and heat transfer plate B2 are molded by vacuum molding process of a polystyrene sheet having a hexagonal planar shape and thickness of, for example, 0.2 mm. Heat transfer plate A1 has eight substantially S-shaped air flow passage ribs 6 provided substantially parallel to each other and at equal intervals, and each air flow passage rib 6 is formed in a hollow convex shape and has a convex height of, for example, 2 mm with respect to the surface of heat transfer surface 5. Air flow passage ribs 6 form substantially S-shaped air flow passages A3 and heat transfer surfaces 5. In the portion of inlets and outlets of air flow passages A3, air flow passage end surface 7 is provided by folding the edge of heat transfer plate A1 to, for example, a position that is 2.2 mm with respect to the surface of heat transfer surface 5 in the direction opposite to the convex direction of air flow passage rib 6. Groove A8 is provided parallel to air flow passage end surface 7 on heat transfer surface 5 at the inner side from air flow passage end surface 7 at, for example, a position with a distance from air flow passage end surface 7 to the center line of groove A8 of 4.5 mm in a way in which the outer dimension of the width of groove A8 is 2 mm. On extended lines of air flow passage ribs 6 between groove A8 and air flow passage end surface 7, a plurality of protrusions 9 each having a hollow convex shape in the same direction as the convex direction of the air flow passage rib 6 and being higher than air flow passage rib 6 are formed in the vicinity of the air flow passage end surface. For example, eight protrusions having a height of 4 mm with respect to heat transfer surface 5 are provided. Protrusion 9 has a pair of side surfaces 10*a* and 10*b* parallel to air flow passage end surface 7 and top surface 11 parallel to heat transfer surface 5. In a pair of outer peripheral edge portions that are substantially parallel to air flow passage portions flowing in the opposite directions in the outer peripheral edge portions of heat transfer plate A1, outer peripheral ribs A12 formed to have a hollow convex shape in the same direction as the convex direction of air flow passage rib 6 and to have the same height as that of protrusion 9 are provided in a way in which the width of outer peripheral rib A12 is, for example, 4 mm. The top surface of outer peripheral rib A12 is parallel to heat transfer surface 5 and the outer side surface is folded to the same position as that of air flow passage end surface 7. In a pair of outer peripheral edge portions that are substantially parallel to the air flow passage portions flowing obliquely in the outer peripheral edge portions of heat transfer plate A1, outer peripheral ribs B13 formed to have a hollow convex shape in the same direction as the convex direction of air flow passage rib 6 and to have the same height as air flow passage rib 6 are provided in a way in which the width of outer peripheral rib B13 is, for example, 7 mm. The top surface of outer peripheral rib B13 is parallel to heat transfer surface 5 and the central portion of the outer side surface is folded to the same position as heat transfer surface 5 to form air flow passage opening portion 14. Both end portions, for example, the portions that are 8 mm distant from the corner are folded to the same position as air flow passage end surface 7 to form air flow passage end surface cover 15. The top surface of outer peripheral rib B13 is provided with groove B16. Groove B16 is caved to the same plane as heat transfer plate in a way in which the distance between the folded position of the outer side surface of the top surface of outer peripheral rib B13 and the central line of groove B is equal to the distance between the central line of groove A8 and the folded position of air flow passage end surface 7 in a way in which the outer surface in the longitudinal direction of groove A8 is a close contact with the inner surface in the longitudinal direction of groove B16 and the inner dimension of the width of groove B16 is, for example, 2 mm.

With the configuration in which eight air flow passage ribs 6 are provided substantially parallel to each other at substantially equal intervals and outer peripheral ribs A12 and outer peripheral ribs B13 are disposed substantially parallel to air flow passage ribs 6, the flow of respective fluid flowing in plurality of air flow passages A3 formed of air flow passage ribs 6, outer peripheral ribs A12 and outer peripheral ribs B13 is uniformed. Thus, the increase in the air-flow resistance is suppressed, and entire region of heat transfer surfaces 5 of heat transfer plate A1 efficiently functions in heat exchange.

Furthermore, heat transfer plate B2 is mirror-image relation to heat transfer plate A1. In the shape of heat transfer plate B2, the height of outer peripheral rib A12 of heat transfer plate B2 is allowed to be equal to that of air flow passage rib 6 and the width of outer peripheral rib A12 of heat transfer plate B2 is allowed to be larger than that of outer peripheral rib A12 of heat transfer plate A1, the width is allowed to be, for example, 7 mm.

When heat transfer plates A1 and heat transfer plates B2 are laminated alternately, as shown in FIG. 3, molding is carried out so that the top surface of outer peripheral rib A12*a* of heat transfer plate A1 is brought into close contact with outer peripheral rib A12*b* of heat transfer plate B2 laminated in the upper part and the top surface of outer peripheral rib A12*b* of heat transfer plate B2 is brought into close contact with outer peripheral rib A 12*a* of heat transfer plate A1 laminated in the upper part. As a result, outer surface and the inner surface of the outer side surfaces of adjacent outer peripheral ribs A12 are brought into close contact with each other. Thus, air flow passages A3 and air flow passages B4 are sealed at the portion of outer peripheral rib A12.

Furthermore, air flow passage rib 6 is formed so that the upper surface thereof is brought into contact with the heat transfer plate laminated in the upper part. Air flow passages 6 maintain the heights of air flow passages of air flow passage A3 and air flow passage B4. The height of the air flow passage is designed in terms of performance such as air-flow resistance of a heat exchanger and a molding property, and the like.

Furthermore, as shown in FIG. 4, at the inlets and outlets of the air flow passages, molding is carried out so that in the portion of the inlets and outlets of air flow passages, the inner surface of groove B16 is brought into close contact with the outer surface of groove A8 of the heat transfer plate laminated in the upper part, the top surface of outer peripheral rib B13 is brought into close contact with the transfer plate laminated in the upper part, one side surface 10*a* of the pair of side surfaces 10 of protrusion 9 that is parallel to air flow passage end surface 7 is brought into close contact with the inner surface of the outer side surface of outer peripheral rib B13 of the heat transfer plate laminated in the upper part, another side surface 10*b* is brought into close contact with the side surface of groove B16 of the heat transfer plate laminated in the upper part, top surface 11 of protrusion 9 is brought into close contact with the rear surface of the top surface of outer peripheral rib B13 of the heat transfer plate laminated in the upper part, and the outer side surface of the outer peripheral rib B13 is brought into close contact with the inner surface of the air flow passage end surface of the heat transfer plate laminated in the upper part. As a result, air flow passage A3 and air flow passage B4 are sealed with each other at the portion of the inlets and outlets. Furthermore, dislocation of the laminated heat transfer plates is prevented and poisoning is carried out when heat transfer plates are laminated.

Furthermore, as shown in FIGS. 5 and 6, in the corner portion in which outer peripheral rib B13 of heat transfer plate A1 and outer peripheral rib B 13 of heat transfer plate B2 intersect each outer, grooves B13 provided on the upper surface of outer peripheral ribs B13 also intersect each other. Molding is carried out so that the top surface of outer peripheral rib B13 is brought into contact with groove B16 of the heat transfer plate laminated on the upper surface. Thus, deformation in the laminating direction of the heat transfer plates in the corner portion where outer peripheral ribs B13 intersect each other and the deterioration due to the deformation in the sealing property is prevented.

Furthermore, as shown in FIGS. 7 and 8, on both ends of air flow passage A3 and air flow passage B4, molding is carried out so that in a corner portion where the inlets and outlets of air flow passage A3 are adjacent to the inlets and outlets of air flow passage B4, the end surface of outer peripheral rib B13 is brought into close contact with the inner surface of air flow passage end surface cover 15*a* of the heat transfer plate laminated in the upper part, and in a corner portion where the inlets and outlets of air flow passage A3 or air flow passage B4 is adjacent to outer peripheral rib A12, the end surface of outer peripheral rib A12 is brought into close contact with the inner surface of air flow passage end surface cover 15*b* of the heat transfer plate laminated in the upper part. Thus, the sealing property on both ends of air flow passage A3 and air flow passage B4 is secured.

The above-mentioned configuration enables a heat exchanger to be provided, in which the sealing property of air flow passage A3 and air flow passage A4 is high, positioning can be carried out easily when heat transfer plates A1 and heat transfer plates B2 are laminated, air flow passage ribs 6, protrusions 9, outer peripheral ribs A12 and outer peripheral ribs B13 are molded into a hollow convex shape by using one sheet of polystyrene sheet by vacuum molding process, thus reducing the weight and the amount of materials to be cast, a recycling property is improved because the heat exchanger is configured by a single material, i.e., polystyrene that is a material of heat transfer plate A3 and heat transfer plate B4, and heat exchanging efficiency is improved because fluid is also flown into the inner surfaces of hollow shaped air flow passage rib 6 and heat exchange is carried out also in air flow passage ribs 6.

In this Example, as a material for a heat transfer plate, a polystyrene sheet was used, and integration molding was carried out by vacuum molding. However, examples of the material may include a thermoplastic resin film of ABS, polypropylene, polyethylene, and the like, a thin metal plate of aluminum, and the like, or a paper material having a heat transfer property and moisture permeability, a microporous resin film, and a paper material in which resin is contained, and the like. Furthermore, a heat transfer plate may be integrated by other molding method such as pressure molding, extra high pressure molding, press molding, and the like, and also in such a case, the same effect can be obtained.

Furthermore, the dimension value and the number of each portion are described as an example, and they are not particularly limited thereto. The same effect can be obtained even when they are appropriately designed in terms of performance of a heat exchanger, for example, air-flow resistance, heat exchanging efficiency, etc., and a molding process property, and the like.

A polystyrene sheet was used as a sheet material and the thickness thereof was 0.2 mm. However, it is preferable that the thickness of the sheet material is in a range of 0.05 to 0.5 mm.

The thickness of not more than 0.05 mm makes a sheet material to be easily damaged such as broken etc. when convex and concave portions are formed and when a heat transfer plate after molding is treated, and makes it difficult to be treated because the molded heat transfer plate is less hard. While, the thickness of more than 5 mm deteriorates the heat transfer property.

The thinner the sheet thickness becomes, the higher the heat transfer property tends to be and the lower the moldability tends to be. On the contrary, the larger the sheet thickness becomes, the lower the heat transfer property tends to be.

Therefore, in order to satisfy the moldability and heat transfer property, the thickness of the sheet material for use is preferably in a range of 0.05 to 0.5 mm and the most preferably in a range of 0.15 to 0.25 mm.

EXAMPLE 2

Hereinafter, Example 2 of the present invention is described with reference to FIGS. 9, 10, 11, 12, 13 and 14.

The same members as those in Example 1 are designated with the same reference numbers and regarded as having the same effects, and therefore detailed description thereof is omitted herein.

Figure 9:
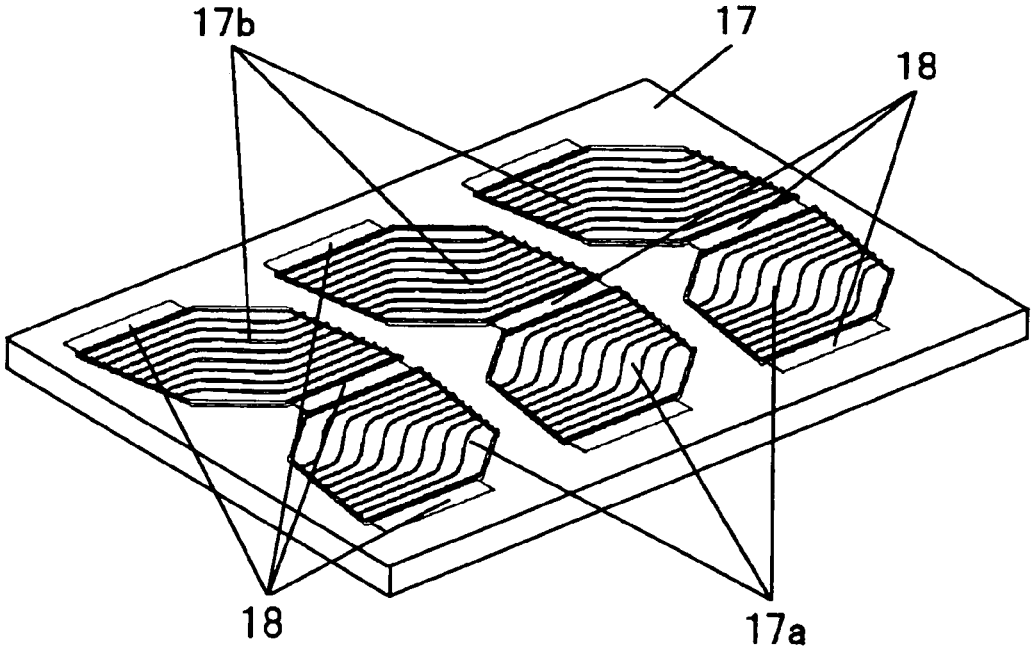
FIG. 9 is a schematic perspective view showing a vacuum molding die for a heat transfer plate of a heat exchanger in accordance with Example 2 of the present invention.
Figure 10:
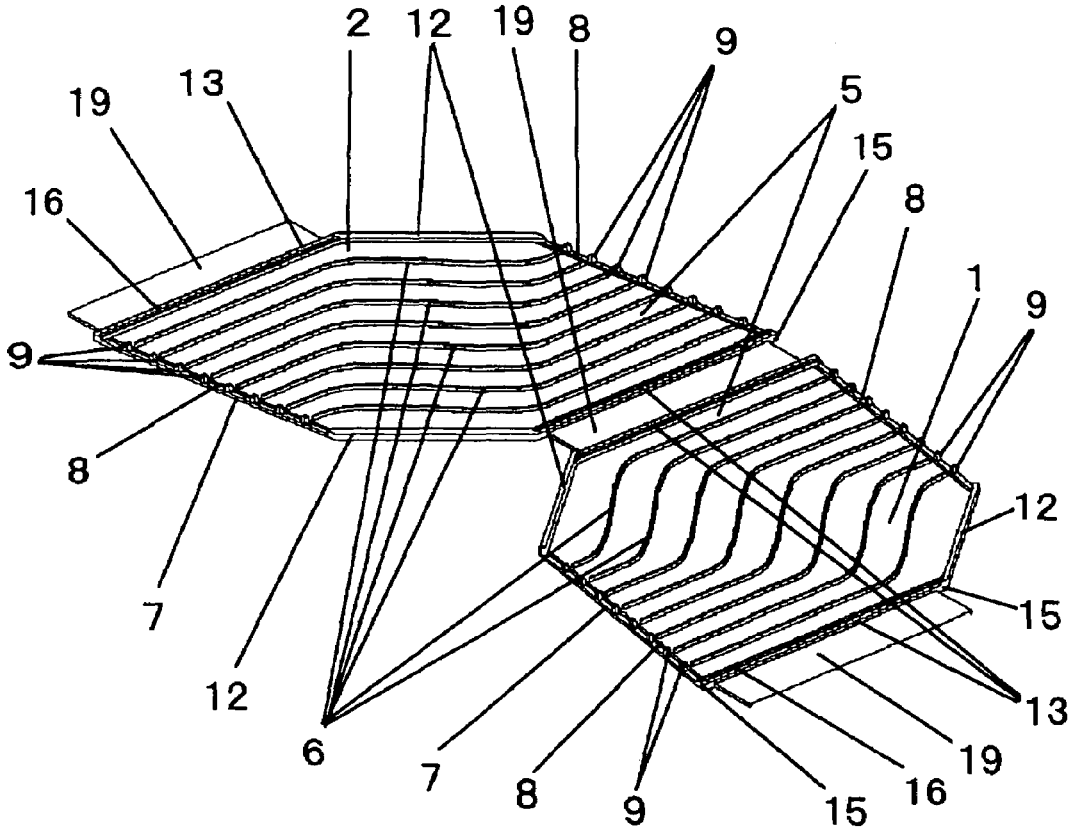
FIG. 10 is a schematic enlarged perspective view showing a heat transfer plate in accordance with Example 2.
Figure 11:
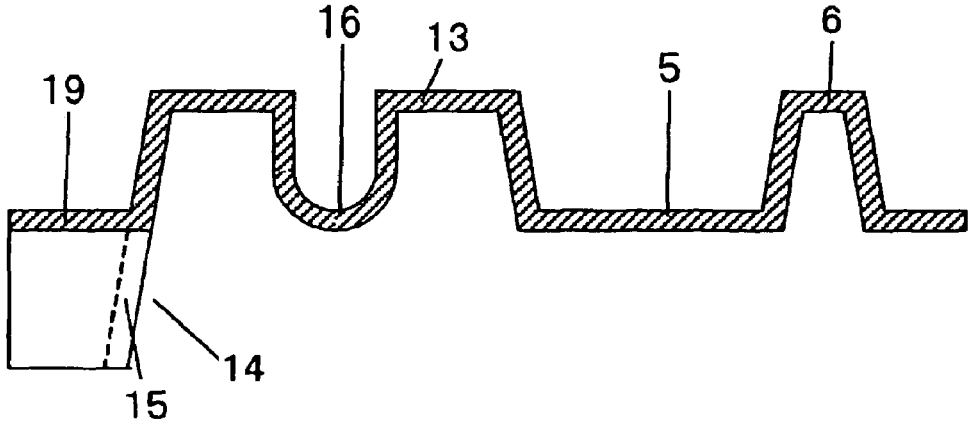
FIG. 11 is a schematic sectional view showing an air flow passage opening portion of the heat transfer plate in accordance with Example 2.
Figure 12:
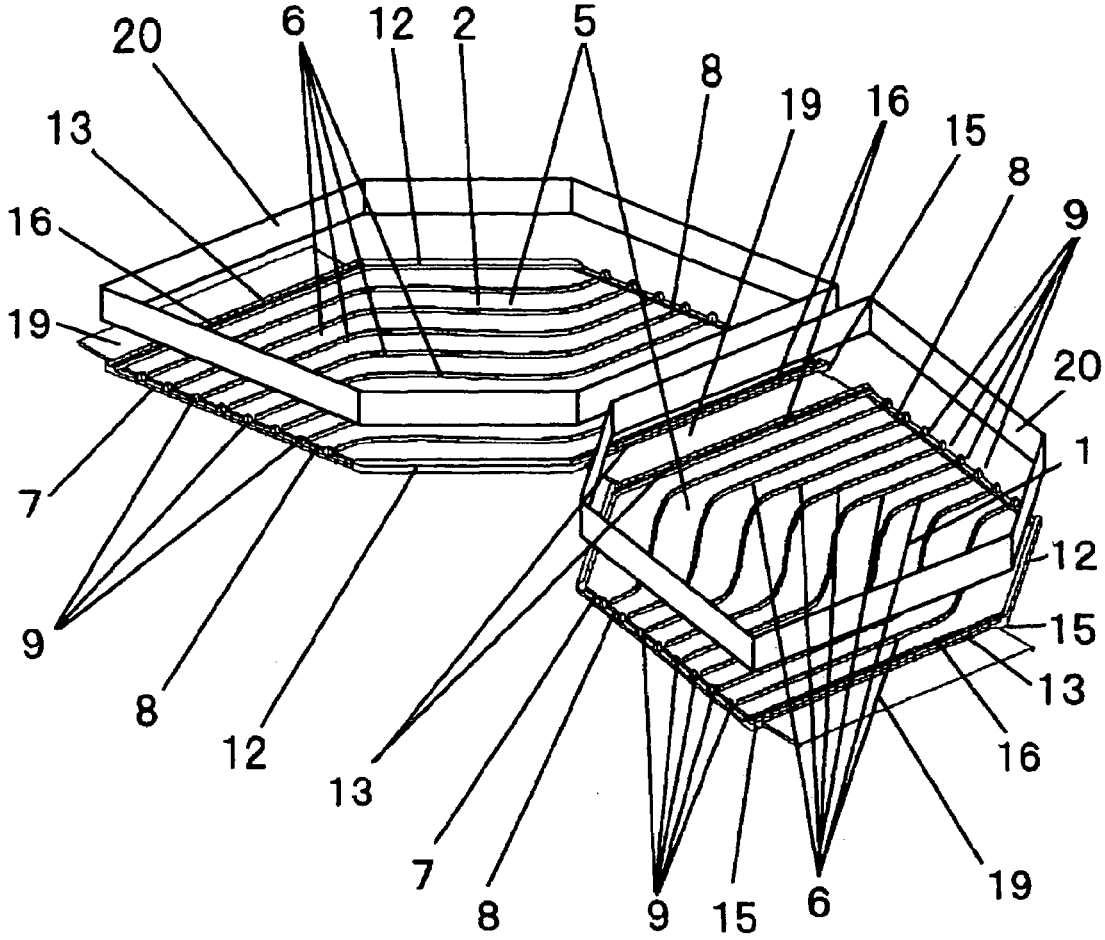
FIG. 12 is a schematic perspective view showing a method of cutting the heat transfer plate in accordance with Example 2.
Figure 13:
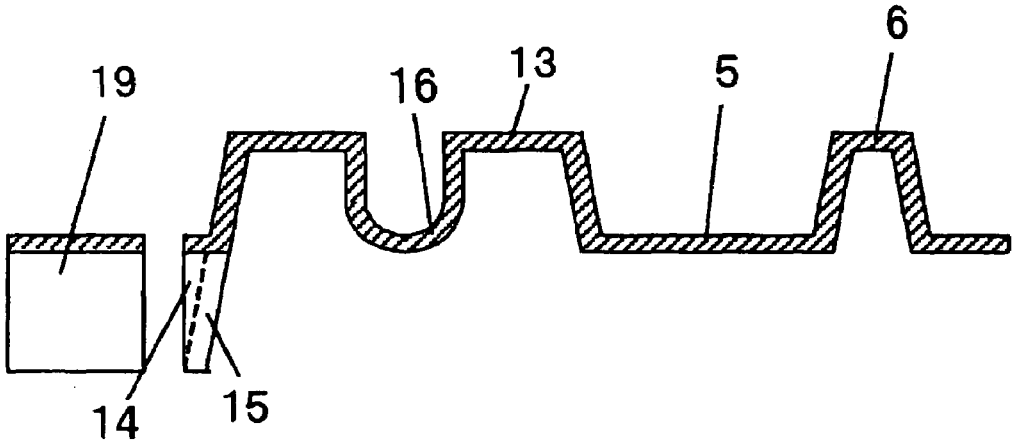
FIG. 13 is a schematic sectional view showing a cutting position of the air flow passage opening portion of the heat transfer plate in accordance with Example 2.

FIG. 9 is a schematic perspective view showing a vacuum molding die of heat transfer plate A1 and heat transfer plate B2 of a heat exchanger used in this Example; FIG. 10 is a schematic enlarged perspective view showing a vacuum molded product of pair of heat transfer plate A1 and heat transfer plate B2; FIG. 11 is a schematic sectional view showing air flow passage opening portion 14; FIG. 12 is a schematic perspective view showing a method of cutting pair of heat transfer plate A1 and heat transfer plate B2; and FIG. 13 is a schematic sectional view showing a cutting position of air flow passage opening portion 14 of the heat transfer plate.

As shown in FIG. 9, vacuum molding die 17 includes molding die portion 17*a* of heat transfer plate A1 and molding die portion 17*b* of heat transfer plate B2. In a portion in which air flow passage opening portion 14 is formed on the outer side surface of outer peripheral ribs B13 of molding die portion 17*a* of heat transfer plate A1 and molding die portion 17*b* of heat transfer plate B2, rectangular shaped molding die portion 18 having a cross-sectional shape equal to that of air flow passage opening portion 14, for example, rectangular shaped molding die portion 18 having a height of 1.8 mm and a width of 160 mm is integrated. Vacuum molding die 17 includes molding die portion 17*a* of heat transfer plate A1 and molding die portion 17*b* of heat transfer plate B2 in a way in which the outer side surfaces of the respective outer peripheral ribs B13 are facing each other and rectangular shaped molding die portion 18 is connected and integrated to the respective facing side surfaces of outer peripheral rib B13. One vacuum molding die portion 17 is provided with three sets of pair of molding die portions 17*a* of heat transfer plate A1 and molding die portions 17*b* of heat transfer plate B2.

FIG. 10 shows one polystyrene sheet that was vacuum molded by using vacuum molding die 17, which shows a molded product of heat transfer plate A 1 and heat transfer plate B2. Actually, three sets of the heat transfer plates A and the heat transfer plates B are formed, however, a pair of heat transfer plate A1 and heat transfer plate B2 are shown for simplification.

Heat transfer plate A1 and heat transfer plate B2 are integration molded with opening formation portion 19 molded in a hollow shape by using rectangular molding die portion 18 in which the outer side surfaces of outer peripheral rib B13 face each other. As shown in FIG. 11, opening formation portion 19 is continuously integrated with the outer side surface of outer peripheral ribs B13 so as to form space having the same height as that of air flow passage opening portion 14 of the outer side surfaces of outer peripheral rib B13.

As shown in FIG. 12, cutting die 20 provided with a punch cutter having a shape that is equal to that of the outer peripheral shape of the respective heat transfer plates is pressed to the outer peripheral edge portion of heat transfer plate A1 and the outer peripheral edge portion of heat transfer plate B2, thereby cutting heat transfer plate A1 and heat transfer plate B2.

When heat transfer plate A1 and heat transfer plate B2 are cut, as shown in FIG. 13, opening formation portion 19 continuously integrated with an outer side surface of outer peripheral rib B13 is cut from the outer side surface of outer peripheral rib B13 by using cutting die 20. On the outer side surfaces of outer peripheral rib B13, air flow passage opening portion 14 is formed.

According to the above-mentioned Example, since the outer peripheries of heat transfer plate A1 and heat transfer plate B2 are cut in a predetermined dimension and at the same time, air flow passage opening portion 14 is formed on the outer side surface of outer peripheral rib B13, it is possible to obtain a heat exchanger with high productive efficiency.

In this Example, vacuum molding die 17 was provided with three sets of molding die portions 17*a* of the heat transfer plate A and molding die portions 17B of the heat transfer plate B, but the number of the sets is described as an example. The same effect can be obtained even when design is carried out by selecting a value that is not particularly limited thereto.

Furthermore, the dimension value and the number of each portion are described as an example, and they are not particularly limited thereto. The same effect can be obtained even when they are appropriately designed in terms of performance of a heat exchanger, for example, air-flow resistance, heat exchanging efficiency, etc., and a molding process property, and the like.

EXAMPLE 3

Next, Example 3 of the present invention is described with reference to FIGS. 14 and 15.

The same members as those in Examples 1 and 2 are designated with the same reference numbers and regarded as having the same effects, and therefore detailed description thereof is omitted herein.

Figure 14:
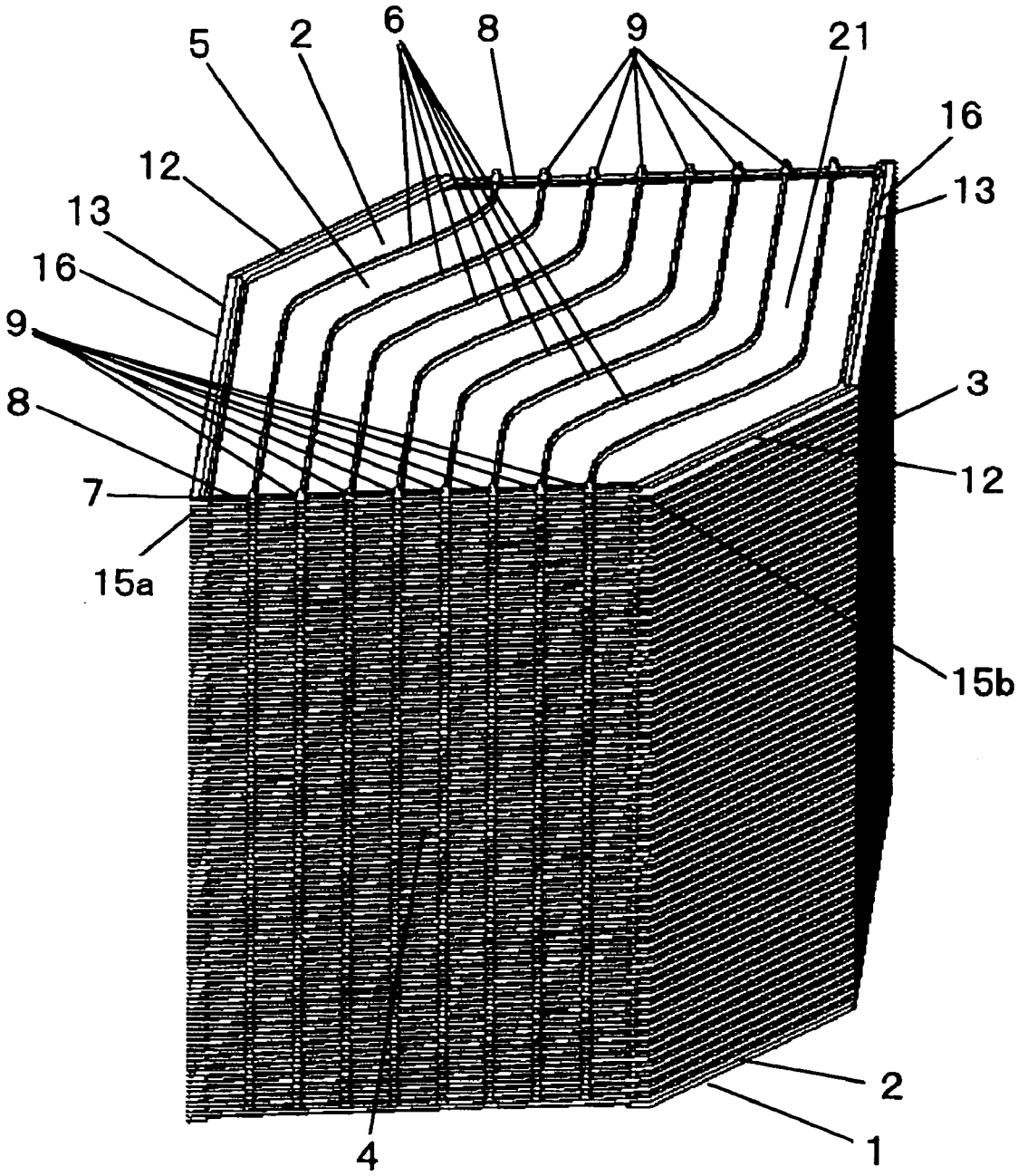
FIG. 14 is a schematic perspective view showing a heat exchanger in accordance with Example 3 of the present invention.
Figure 15:
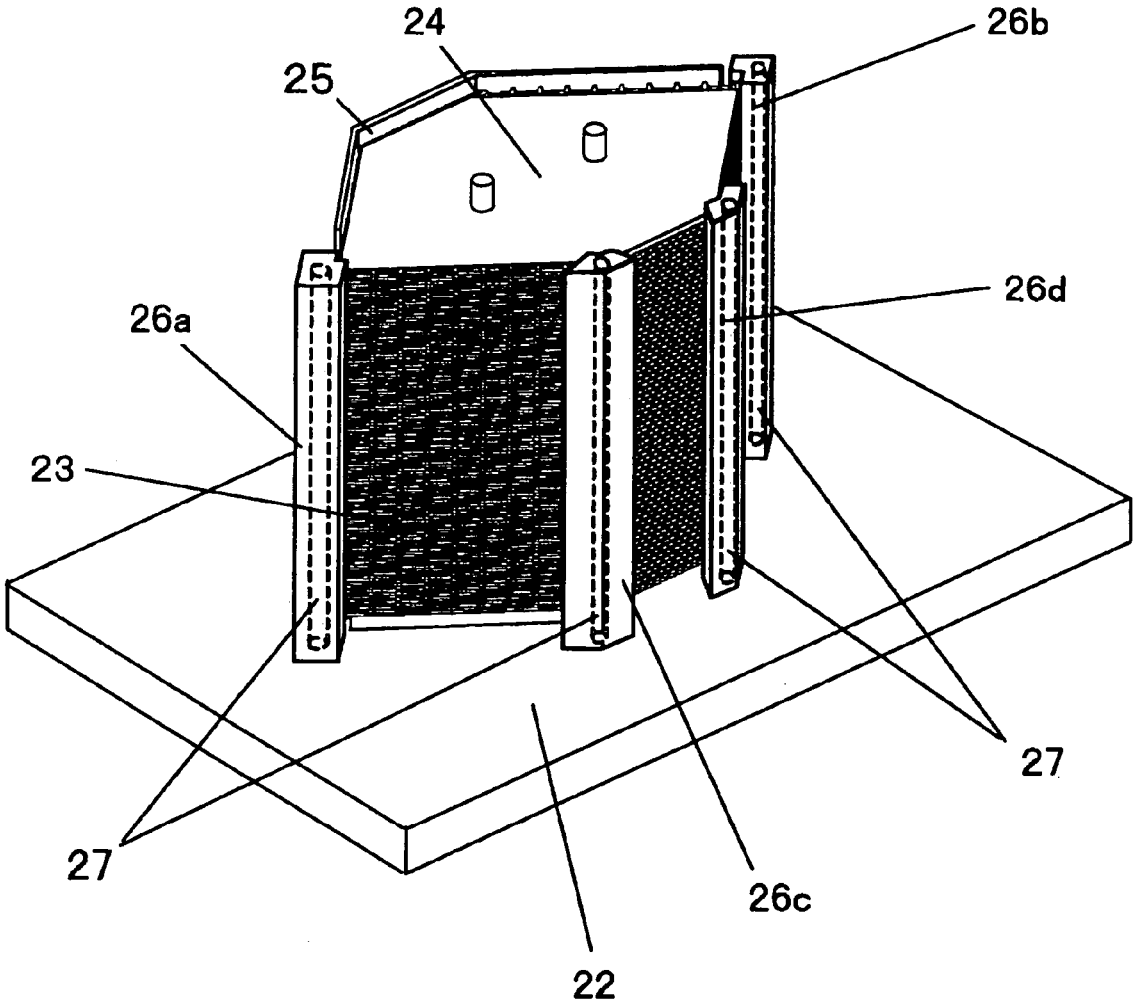
FIG. 15 is a schematic perspective view showing a thermal welding apparatus in accordance with Example 3.

FIG. 14 is a schematic perspective view showing a heat exchanger used in this Example in which corer portions are thermally welded; and FIG. 15 is a schematic perspective view showing a thermal welding apparatus thereof.

As shown in FIG. 14, heat exchanger 21 is obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom, and thermally welding the outer side surfaces of the laminated adjacent heat transfer plates at six corner portions.

FIG. 15 shows thermal welding apparatus 22, including press plate 24 which suppresses dislocation in the laminating direction of sheet block 23 obtained by laminating 61 sheets each of heat transfer plates A1 and heat transfer plates B2 alternately with heat transfer plate A1 disposed at the bottom and regulates the height of laminated sheet block 23, for example, regulates it to 280 mm; support plate 25 which suppresses dislocation in the horizontal direction of the heat transfer plates constituting sheet block 23 and has a shape corresponding to the outer side surface on which the inlets and outlets of air flow passages A3 and air flow passages B4 of the heat transfer plate are formed and the outer side surface of outer peripheral rib A12; heater blocks 26*a* and 26*b* which are thermal welding means for thermally welding the corner portion of the adjacent inlet and outlet portions of air flow passages of sheet block 23 fixed by press plate 24 and support plate 25 and which have a welding surface formed to have the width equal to that of the end surfaces of air flow passage end surface cover 15*a* and outer peripheral rib B13; and heater blocks 26*c* and 26*d* which are thermal welding means for thermally welding the corner portions of both ends of outer peripheral rib B13 and which have a welding surface formed to have the width equal to that of the end surface of air flow passage end surface cover 15*b* and outer peripheral rib A12. Heater blocks 26*a* to 26*d* are provided with cylindrical electric heaters 27 therein.

On thermal welding apparatus 22, sheet block 23 is disposed in close contact with support plate 25. Thereafter, by pressing press plate 24 to the top surface of sheet block 23, sheet block 23 is fixed to thermal welding apparatus 22.

By pressing heater blocks 26*a*, 26*b*, 26*c* and 26*d* whose surface temperatures were set to, for example, 140° C. to sheet block 23 fixed to thermal welding apparatus 22 for, for example, five seconds, four corners of sheet block 23 are thermally welded. Then, press plate 24 is once removed from sheet block 23, the direction in which sheet block 23 is disposed is rotated by 180°. Then, sheet block 23 is fixed by press plate 24 and support plate 25 again and heater blocks 26*c* and 26*d* are pressed to the corner portions of sheet block 23. Thereby, heat exchanger 21 is manufactured, in which six corer portions of sheet block 23 are thermally welded over the entire length in the laminating direction.

According to the above-mentioned Example, in the laminated adjacent heat transfer plates, air flow passage end surface cover 15 and the end surface of outer peripheral rib A12, air flow passage end surface cover 15 and the end surface of outer peripheral rib B13, air flow passage end surface 7 and the side surface of outer peripheral rib B13, and side surfaces of outer peripheral ribs A12 are thermally welded to be fixed. Thus, deterioration of the sealing property of the air flow passages due to dislocation is prevented, and the sealing property is improved. Since adjacent portions to be thermally welded that are not present on the same plane are thermally welded simultaneously, it is possible to obtain a heat exchanger with high productive efficiency.

In this Example, sheet block 23 is disposed to thermal welding apparatus 22 in a way in which the heat transfer plates are laminated in the vertical direction. However, the same effect can be obtained even when sheet block 23 is disposed by using thermal welding apparatus 22 in which the heat transfer plates are laminated in the horizontal direction. Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like.

Furthermore, a heat transfer plate to be disposed at the bottom is not particularly limited to heat transfer plate A1. The same effect can be obtained by laminating heat transfer plates with heat transfer plate B disposed at the bottom.

Furthermore, temperature, number and welding time of heater block 26 are described as examples but they are not particularly limited to the examples. The same effect can be obtained even when they are determined so as to obtain an excellent welding state.

EXAMPLE 4

Next, Example 4 of the present invention is described with reference to FIGS. 16 and 17.

The same members as those in Examples 1, 2 and 3 are designated with the same reference numbers and regarded as having the same effects, and therefore detailed description thereof is omitted herein.

Figure 16:
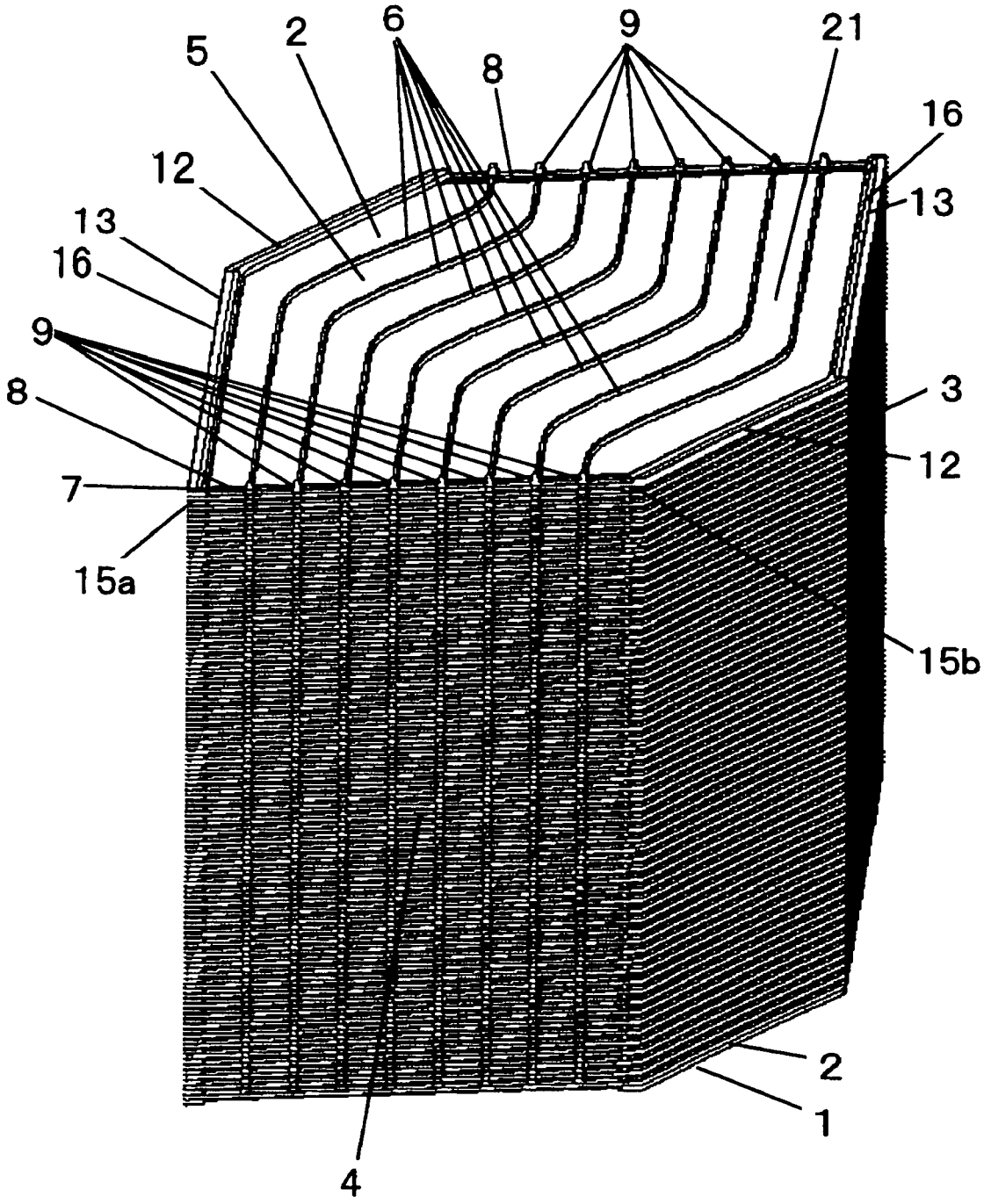
FIG. 16 is a schematic perspective view showing a heat exchanger in accordance with Example 4 of the present invention.
Figure 17:
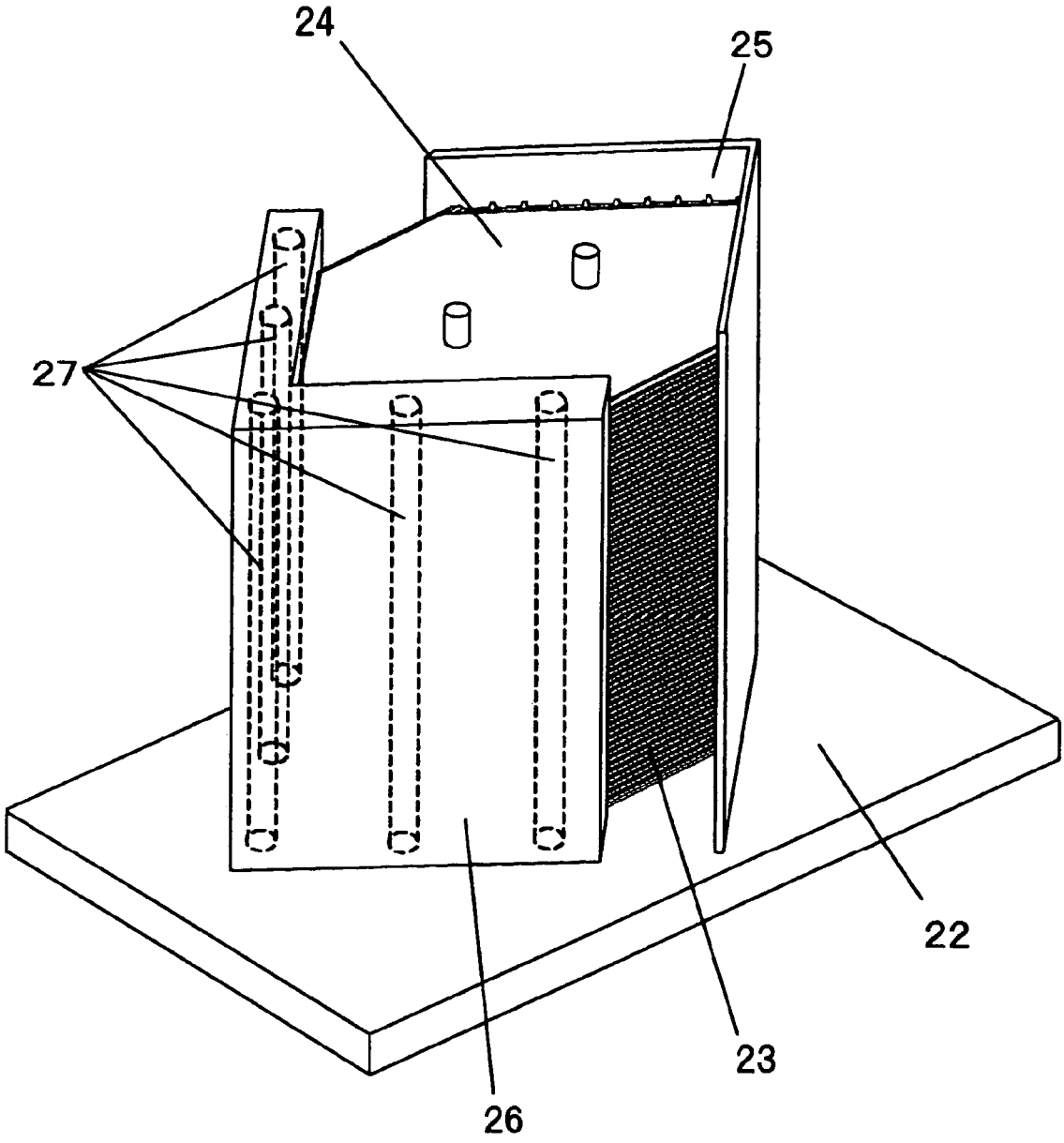
FIG. 17 is a schematic perspective view showing the thermal welding apparatus in accordance with Example 4.

FIG. 16 is a schematic perspective view showing a heat exchanger used in this Example in which surfaces on which the inlets and outlets of air flow passages A3 and air flow passages B4 are formed are thermally welded; and FIG. 17 is a schematic perspective view showing a thermal welding apparatus thereof.

As shown in FIG. 16, heat exchanger 21 is obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom, and entire four surfaces on which the inlets and outlets of air flow passages A3 and air flow passages B4 are formed are thermally welded.

FIG. 17 shows thermal welding apparatus 22, including press plate 24 which suppresses dislocation in the laminating direction of sheet block 23 obtained by laminating 61 sheets each of heat transfer plates A1 and heat transfer plates B2 alternately with heat transfer plate A1 disposed at the bottom and regulates the height of laminated sheet block 23, for example, regulates it to 280 mm; support plate 25 which suppresses dislocation in the horizontal direction of the heat transfer plates constituting sheet block 23 and has a shape corresponding to the outer side surface on which the inlets and outlets of air flow passages A3 and air flow passages B4 of the heat transfer plate are formed; and heater block 26 as a thermal welding means for thermally welding adjacent surfaces on which the inlets and outlets of air flow passages A3 and air flow passages B4 of sheet block 23 fixed by press plate 24 and support plate 25 are formed. In heater block 26, both ends protrude from the surface on which the inlets and outlets of air flow passages A3 and air flow passages B4 are formed, for example, protrude by 10 mm each; and the top and bottom ends protrude in the vertical direction of sheet block 23, for example, protrude by 10 mm each. Inside heater block 26, a plurality of, for example, five electric cylindrical electric heaters 27 are provided.

On thermal welding apparatus 22, sheet block 23 is disposed in close contact with support plate 25. Thereafter, by pressing press plate 24 to the top surface of sheet block 23, sheet block 23 is fixed to thermal welding apparatus 22.

By pressing heater block 26 whose surface temperature was set to, for example, 140° C. to sheet block 23 fixed to thermal welding apparatus 22 for, for example, five seconds, two adjacent surfaces on which the inlets and outlets of air flow passages A3 and air flow passages B4 of sheet block 23 are formed are thermally welded simultaneously. Then, press plate 24 is once removed from sheet block 23, the direction in which sheet block 23 is disposed is rotated by 180°. Then, sheet block 23 is fixed by press plate 24 and support plate 25 again, and heater block 26 is pressed to two adjacent surfaces on which the inlets and outlets of air flow passages A3 and air flow passages B4 of sheet block 23 are formed. Thereby, heat exchanger 21 is manufactured, in which portions on which side surfaces of heat transfer plates A1 and heat transfer plates B2 are overlapped with each other are thermally welded on entire four surfaces on which the inlets and outlets of air flow passages A3 and air flow passages B4 of sheet block 23 are formed.

According to the above-mentioned Example, on the surface on which the inlets and outlets of air flow passages A3 and air flow passages B4 of the laminated adjacent heat transfer plates are formed, air flow passage end surface 7 and the side surface of outer peripheral rib B13, air flow passage end surface cover 15*a* and the end surface of outer peripheral rib B13, and air flow passage end surface cover 15*b* and end surface of outer peripheral rib A12 are welded by thermal welding. Thus, the outer side surface of outer peripheral ribs B13 of another air flow passage facing the inlet and outlet portion of one air flow passage is sealed. Dislocation of heat transfer plates is suppressed so as to improve the sealing property of the air flow passage, and the sealing property of the air flow passage is prevented from being deteriorated due to the dislocation of the heat transfer plates. Since the sealing properties of air flow passage A3 and air flow passage B4 are high and thermal welding is carried out simultaneously with respect to the two adjacent surfaces on which the inlets and outlets of air flow passages A3 and air flow passages B4 are formed and which are not present in the same plane. Thus, it is possible to obtain a heat exchanger with high production efficiency.

In this Example, one heater block 26 was used. However, by configuring support plate 25 to have a planar shape that is brought into close contact with the side surface of outer peripheral rib A12 of sheet block 23 in which two heater blocks 26 are pressed in the opposite direction so as to allow heater block 26 to have functions of both a thermal welding means and a supporting means of sheet block 23, entire four surfaces on which the inlets and outlets of air flow passages A3 and air flow passages B4 are formed and which are not present on one plane can be thermally welded simultaneously, thus productive efficiency can be further enhanced. Furthermore, sheet block 23 is disposed to thermal welding apparatus 22 in a way in which the heat transfer plates are laminated in the vertical direction. However, the same effect can be obtained even when sheet block 23 is disposed by using thermal welding apparatus 22 in which the heat transfer plates are laminated in the horizontal direction.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

Furthermore, temperature, number and welding time of heater block 26 are described as examples and they are not particularly limited to the examples. The same effect can be obtained when they are determined so as to obtain an excellent welding state.

EXAMPLE 5

Next, Example 5 of the present invention is described with reference to FIGS. 18 and 19.

The same members as those in Examples 1, 2, 3 and 4 are designated with the same reference numbers and regarded as having the same effects, and therefore detailed description thereof is omitted herein.

Figure 18:
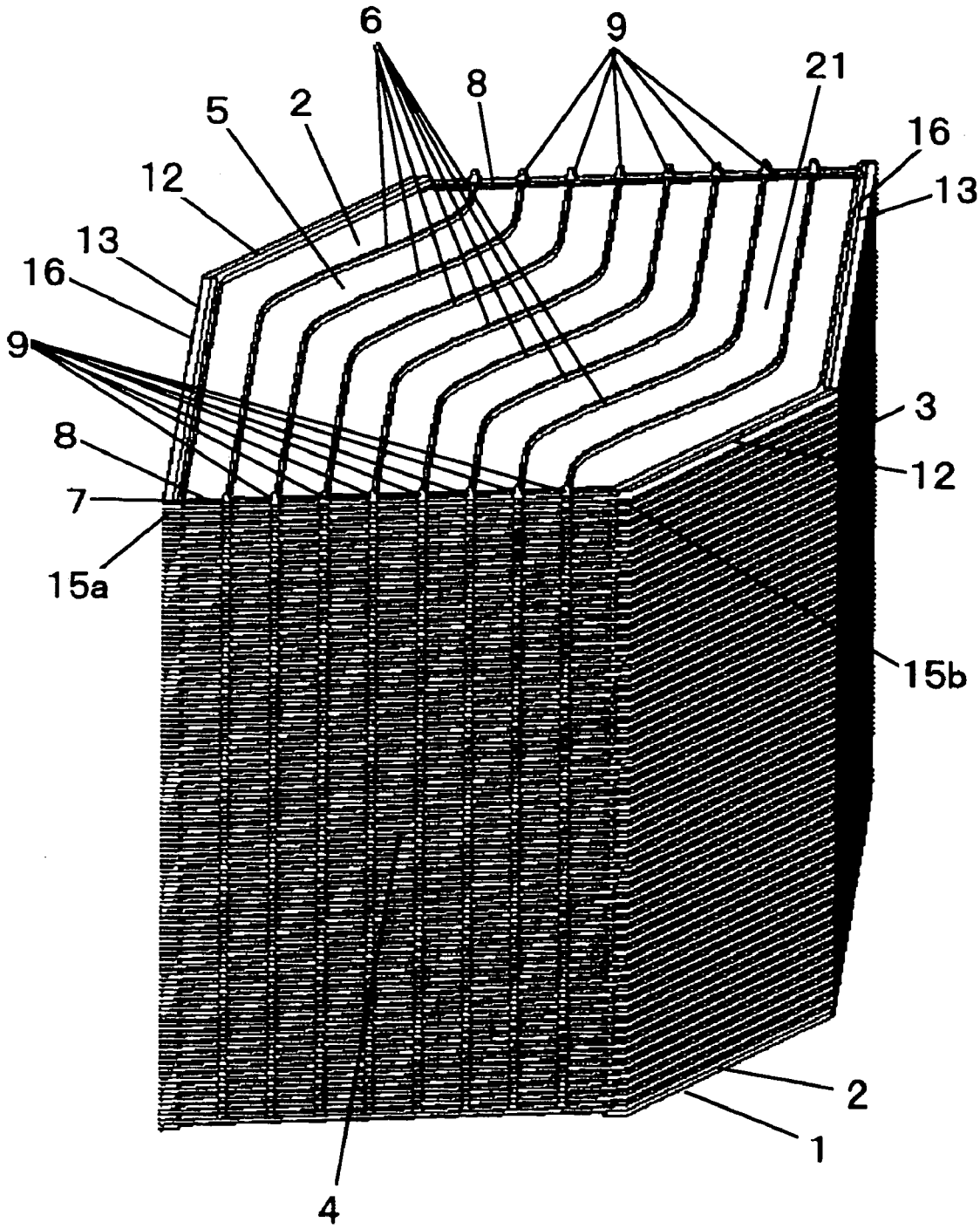
FIG. 18 is a schematic perspective view showing a heat exchanger in accordance with Example 5 of the present invention.
Figure 19:
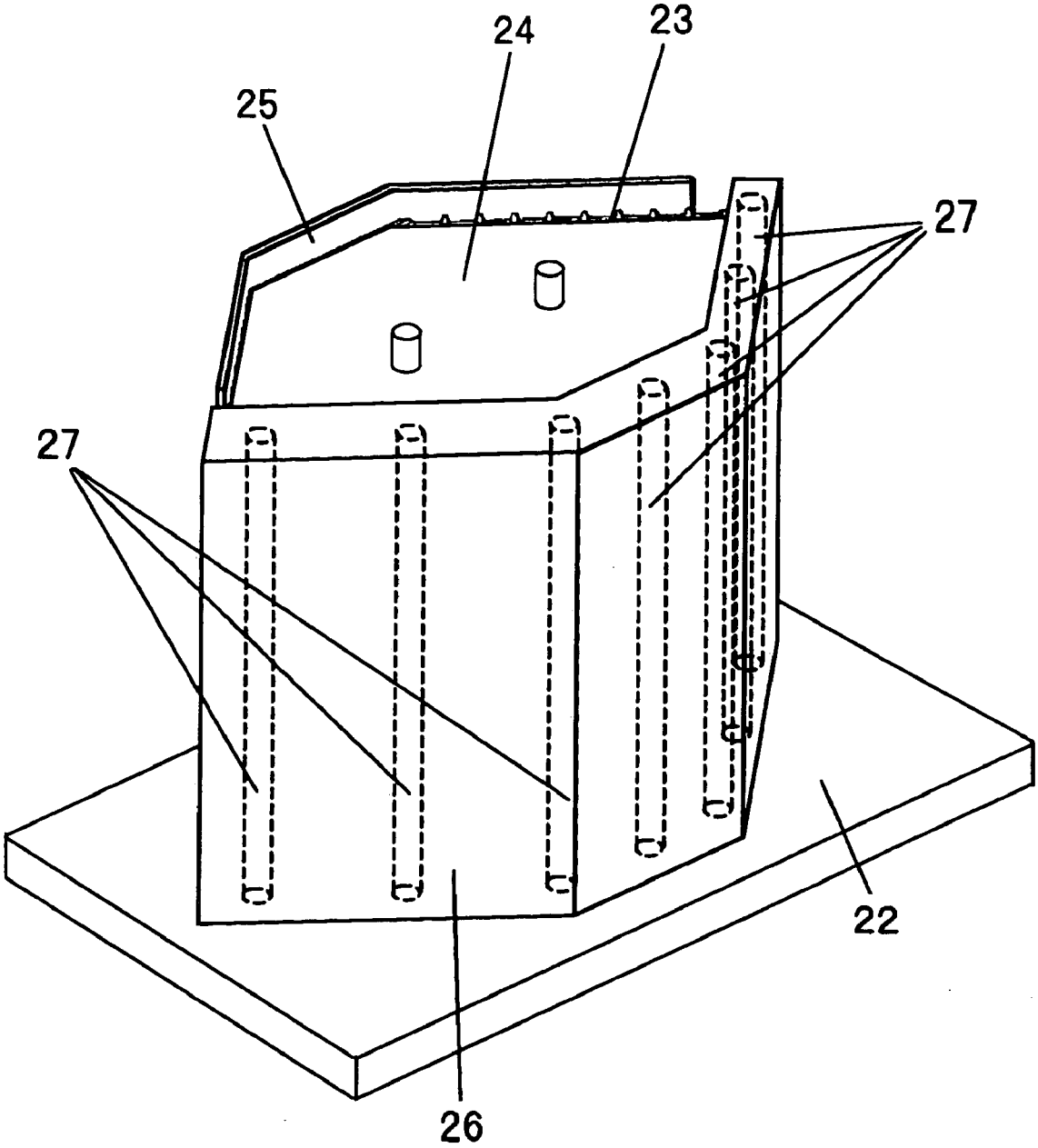
FIG. 19 is a schematic perspective view showing a thermal welding apparatus in accordance with Example 5.

FIG. 18 is a schematic perspective view showing a heat exchanger used in this Example in which thermal welding is carried out to a front surface of the outer side surface; and FIG. 19 is a schematic perspective view showing a thermal welding apparatus thereof.

As shown in FIG. 18, heat exchanger 21 is produced by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom and welding entire six surfaces, i.e., the surfaces on which the inlets and outlets of air flow passages A3 and air flow passages B4 are formed and the outer side surfaces of outer peripheral ribs A12 by thermal welding.

FIG. 19 shows thermal welding apparatus 22, including press plate 24 which suppresses dislocation in the laminating direction of sheet block 23 obtained by laminating 61 sheets each of heat transfer plates A1 and heat transfer plates B2 alternately with heat transfer plate A1 disposed at the bottom and regulates the height of laminated sheet block 23, for example, regulates it to 280 mm; support plate 25 which suppresses dislocation in the horizontal direction of the heat transfer plates constituting sheet block 23 and has a shape corresponding to the outer side surface on which the inlets and outlets of air flow passages A3 and air flow passages B4 of the heat transfer plate are formed and the outer side surface of outer peripheral rib A12; and heater block 26 as a thermal welding means for thermally welding the surface on which the inlets and outlets of air flow passages A3 and air flow passages B4 are formed and the outer side surface of the outer peripheral rib A12, facing the surface that is brought into close contact with support plate 25 of sheet block 23 fixed by press plate 24 and support plate 25. Heater block 26 has a thermally welding surface corresponding to the surface on which the inlets and outlets of air flow passages A3 and air flow passages B4 are formed and the outer side surface of outer peripheral ribs A12. In heater block 26, both ends protrude from the surface on which the inlets and outlets of air flow passages A3 and air flow passages B4 are formed, for example, protrude by 10 mm each; and the top and bottom ends protrude in the vertical direction of sheet block 23, for example, protrude by 10 mm each. Inside heater block 26, a plurality of, for example, seven electric cylindrical electric heaters 27 are provided.

To thermal welding apparatus 22, sheet block 23 is disposed in close contact with support plate 25. Thereafter, by pressing press plate 24 to the upper surface of sheet block 23, sheet block 23 is fixed to thermal welding apparatus 22.

By pressing heater block 26 whose surface temperature was set to, for example, 140° C. to sheet block 23 fixed to thermal welding apparatus 22 for, for example, five seconds, the outer side surface of outer peripheral rib A12 of sheet block 23 and two surfaces which are adjacent to outer peripheral rib A12 and on which the inlets and outlets of air flow passages A3 and air flow passages B4 are formed, that is, three surfaces in total are thermally welded simultaneously. Then, press plate 24 is once removed from sheet block 23, the direction in which sheet block 23 is set is rotated by 180°. Then, sheet block 23 is fixed by press plate 24 and support plate 25 again, and heater block 26 is pressed to sheet block 23. Thereby, heat exchanger 21 is manufactured, in which portions on which side surfaces of heat transfer plates A1 and heat transfer plates B2 are overlapped with each other are thermally welded on entire six surfaces of sheet block 23 including the outer side surfaces of outer peripheral ribs A12 of sheet block 23 and the surfaces on which the inlets and outlets of air flow passages A3 and air flow passages B4 are formed.

According to the above-mentioned Example, on the surface on which the inlets and outlets of air flow passages A3 and air flow passages B4 are formed of laminated adjacent heat transfer plates, air flow passage end surface 7 and the side surface of outer peripheral rib B13, air flow passage end surface cover 15*a* and the end surface of outer peripheral rib B13, and air flow passage end surface cover 15*b* and the end surface of outer peripheral rib A12 are welded by heater block 26. Thus, the outer side surfaces of outer peripheral ribs B13 at another side of air flow passage facing the inlet and outlet portions of one side of air flow passages are sealed. On the outer side surfaces of outer peripheral ribs A12 of the laminated adjacent heat transfer plates, outer side surfaces of outer peripheral rib A12 are thermally welded by heater block 26. Thereby, the outer peripheral portions of entire air flow passages are sealed. Furthermore, dislocation of heat transfer plates is suppressed and the sealing property of air flow passages is improved. The sealing property of the air flow passage is prevented from being deteriorated due to the dislocation of the heat transfer plates. The sealing properties of air flow passage A3 and air flow passage B4 are high, the outer side surface of outer peripheral rib A12 and the two adjacent surfaces on which the inlets and outlets of air flow passages A3 and air flow passages B4 are formed, that is, three surfaces in total, which are not present in the same plane, are thermally welded simultaneously. Thus, it is possible to obtain a heat exchanger with high production efficiency.

Note here that sheet block 23 is disposed to thermal welding apparatus 22 in a way in which the heat transfer plates are laminated in a vertical direction. However, the same effect can be obtained even when sheet block 23 is disposed by using thermal welding apparatus 22 in which the heat transfer plates are laminated in a horizontal direction.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

Furthermore, temperature, number and welding time of heater block 26 are described as examples but they are not particularly limited to the examples. The same effect can be obtained even when they are determined so as to obtain an excellent welding state.

EXAMPLE 6

Next, Example 6 of the present invention is described with reference to FIGS. 20 and 21.

The same members as those in Examples 1, 2, 3, 4 and 5 are designated with the same reference numbers and regarded as having the same effects, and therefore detailed description thereof is omitted herein.

Figure 20:
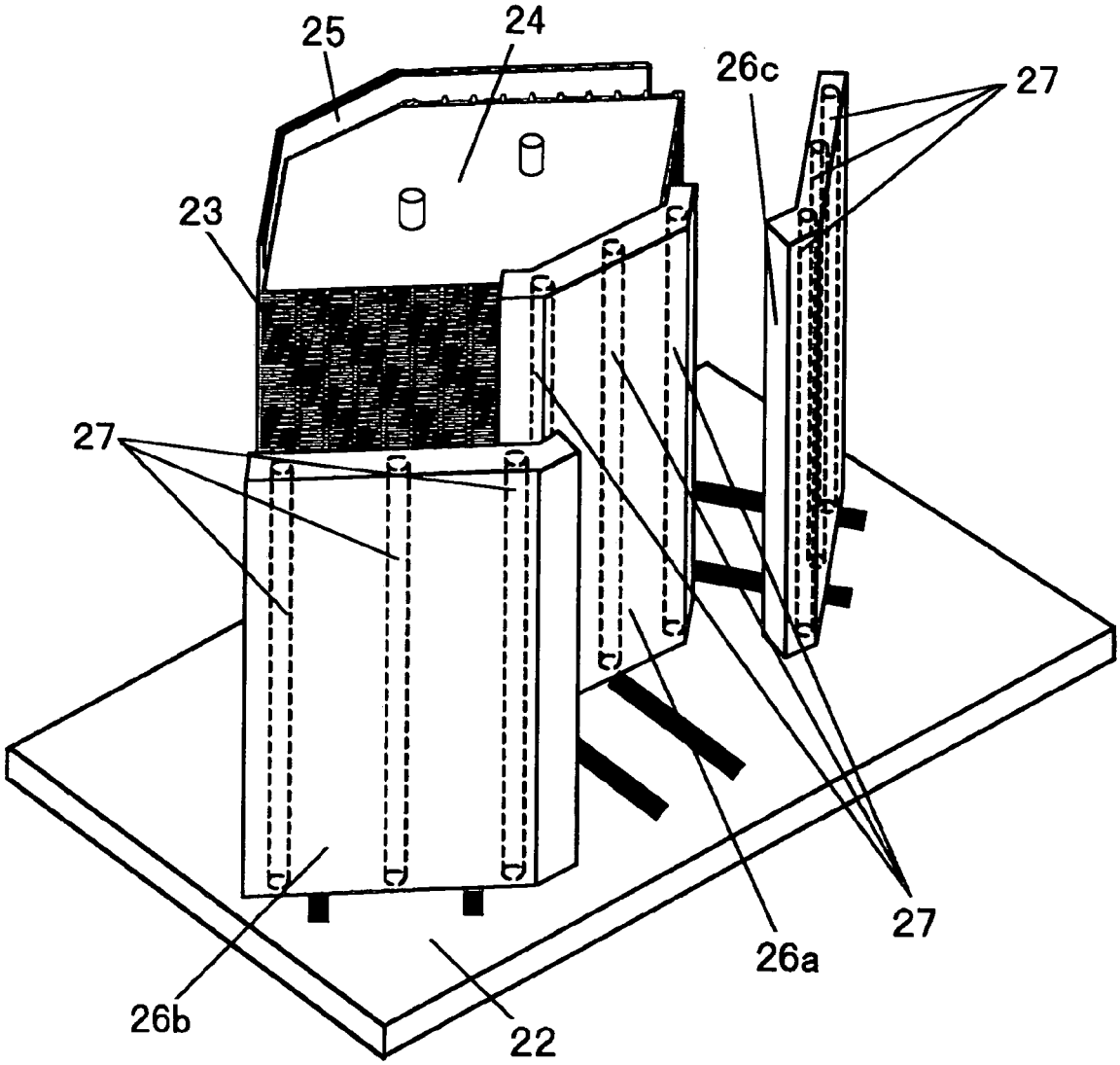
FIG. 20 is a schematic perspective view showing a first process of a thermal welding apparatus in accordance with Example 6 of the present invention.
Figure 21:
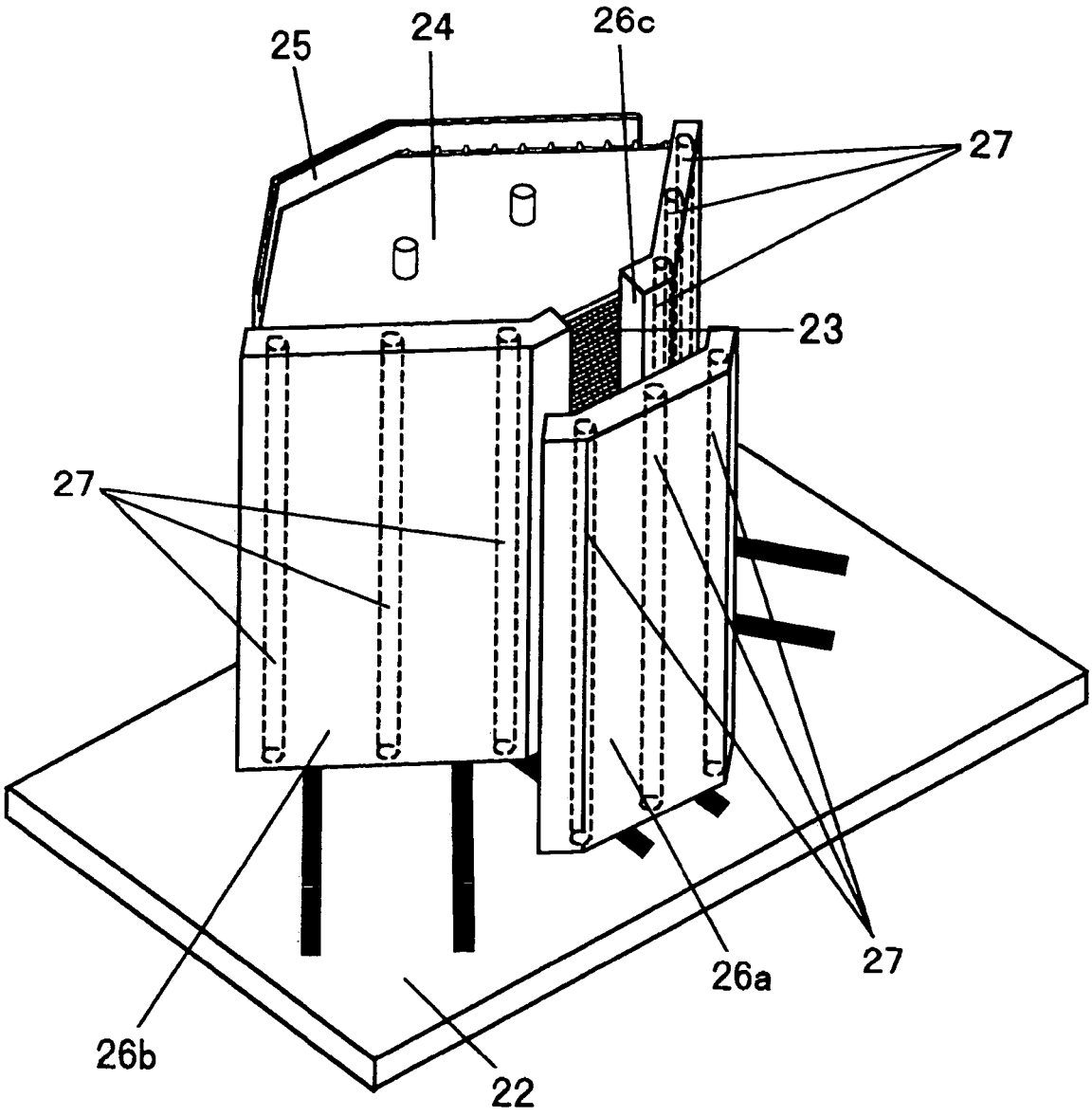
FIG. 21 is a schematic perspective view showing the first process of a thermal welding apparatus in accordance with Example 6.

FIG. 20 is a schematic perspective view showing a first process of a thermal welding apparatus in accordance with this Example; and FIG. 21 is a schematic perspective view showing the second process thereof.

As shown in FIG. 20, thermal welding apparatus 22 includes press plate 24 which suppresses dislocation in the laminating direction of sheet block 23 obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom and regulates the height of laminated sheet block 23, for example, regulates it to 280 mm; and support plate 25 which suppresses dislocation in the horizontal direction of the heat transfer plates constituting sheet block 23 and which has a shape corresponding to the outer side surface on which the inlets and outlets of air flow passages A3 and air flow passages B4 are formed and the outer side surface of outer peripheral rib A12 of the heat transfer plates; heater blocks 26*a* as a thermal welding means for thermally welding the outer side surface of outer peripheral rib A12 facing the surface that is brought into close contact with support plate 25 of sheet block 23 fixed by press plate 24 and support plate 25; and blocks 26*b* and 26*c* as thermal welding means for thermally welding two surfaces on which the inlets and outlets of air flow passages A3 and air flow passages B4 are formed facing the surface that is brought into close contact with support plate 25 of sheet block 23 fixed by press plate 24 and support plate 25. Heater block 26*a* has a shape in which thermal welding surface protrudes to positions capable of thermally welding air flow passage end surface cover 15*b* for the surface, which are adjacent to the both ends thereof, on which the inlets and outlets of air flow passages A3 and air flow passages B4 are formed. Each of heater block 26*b* and 26*c* has a thermal welding surface protruding in the direction of the adjacent outer peripheral rib A12 and capable of thermally welding a part of the outer side surface of adjacent outer peripheral rib A12, for example, a position that is 10 mm from the corner at one end. At another end, each of heater block 26*b* and 26*c* has a shape protruding from the surface on which the inlets and outlets of air flow passages A3 and air flow passages B4 are formed, for example, protruding by 10 mm each. The upper and lower ends of heater blocks 26*a*, 26*b* and 26*c* protrude in the vertical direction of sheet block 23, for example, protrude by 10 mm each. Heater blocks 26*a*, 26*b* and 26*c* include a plurality of, for example, three cylindrical electric heaters 27 inside, respectively.

On thermal welding apparatus 22, sheet block 23 is disposed in close contact with support plate 25. Thereafter, by pressing press plate 24 to the top surface of sheet block 23, sheet block 23 is fixed to thermal welding apparatus 22.

As a first process of thermal welding, heater block 26*a* whose surface temperature was set to, for example, 140° C. is vertically pressed to the side surface of outer peripheral ribs A12 of sheet block 23 fixed to thermal welding apparatus 22 for, for example, five seconds, air flow passage end surface cover 15*b* provided on outer side surface of peripheral rib A12 and the surface which is adjacent to the outer side surface of the outer peripheral rib A12 and on which air flow passage A3 and air flow passage B4 are formed and the end surface of outer peripheral rib A12 are thermally welded in sheet block 23. Thereafter, the heater block 26*a* is removed from sheet block 23. Then, as a second process, as shown in FIG. 21, by vertically pressing heater blocks 26*b* and 26*c* whose surface temperatures were set to, for example, 130° C. to respective surfaces on which the inlets and outlets of air flow passages A3 and air flow passages B4 of sheet block 23 are formed for, for example, three seconds, the respective surfaces on which the inlets and outlets of air flow passages A3 and air flow passages B4 are formed and a corner portion between the respective surfaces on which the inlets and outlets of air flow passages A3 and air flow passages B4 are formed and outer peripheral ribs A12 are thermally welded. With the first and second process, the outer side surface of outer peripheral ribs A12 facing the surface that is brought into close contact with support plate 25 and two surfaces on which the inlets and outlets of air flow passages A3 and air flow passages B4 are formed, i.e., three surfaces in total are thermally welded.

Then, press plate 24 is once removed from sheet block 23, the direction in which sheet block 23 is set is rotated by 180°. Then, sheet block 23 is fixed by press plate 24 and support plate 25 again. Similar to the first process and second process, as a third process of thermal welding, by vertically pressing heater block 26*a* to the side surface of outer peripheral ribs A12 of sheet block 23 fixed to thermal welding apparatus 22, air flow passage end surface cover 15*b* provided on outer side surface of peripheral rib A12 and the surface which is adjacent to the outer side surface of the outer peripheral rib A12 and on which air flow passage A3 and air flow passage B4 are formed and the end surface of outer peripheral rib A12 are thermally welded in sheet block 23. Thereafter, the heater block 26*a* is removed from sheet block 23. Then, as a fourth process, by vertically pressing heater blocks 26*b* and 26*c* to the respective surfaces on which the inlets and outlets of air flow passages A3 and air flow passages B4 of sheet block 23 are formed, the respective surfaces on which the inlets and outlets of air flow passages A3 and air flow passages B4 are formed and a corner portion between the respective surfaces on which the inlets and outlets of air flow passages A3 and air flow passages B4 are formed and outer peripheral rib A12 are thermally welded. With the third process and fourth process, the outer side surface of outer peripheral rib A12 facing a surface that is brought into close contact with support plate 25 and two surfaces on which the inlets and outlets of air flow passages A3 and air flow passages B4 are formed, that is, three surfaces in total are thermally welded. With the first, second, third and fourth processes, heat exchanger 21 is manufactured in which the outer side surface of outer peripheral ribs A12 and the surface on which the inlets and outlets of air flow passages A3 and air flow passages B4 of sheet block 23 are formed, that is, entire six surfaces, portions in which side surfaces of heat transfer plate A1 and heat transfer plate B2 are overlapped with each other are thermally welded.

According to the above-mentioned Example, the corner portions of the surfaces on which the inlets and outlets of air flow passages A3 and air flow passages B4 are formed and outer peripheral rib A12 are thermally welded twice by using heater blocks 26*a*, 26*b* or 26*c*. Thereby, it is possible to reliably carry out thermal welding of the corner portion that cannot be thermally welded easily. When thermal welding is carried out by vertically pressing heater blocks 26*a*, 26*b* and 26*c* to a thermally welded surface of sheet block 23, respectively, the sealing property of the portion in which the outer side surfaces of the heat transfer plates are overlapped with each other is enhanced, on the surface on which the inlets and outlets of air flow passages A3 and air flow passages B4 are formed in the laminated adjacent heat transfer plates, air flow passage end surface 7 and the side surface of outer peripheral rib B13, air flow passage end surface cover 15*a* and the end surface of outer peripheral rib B13, and air flow passage end surface cover 15*b* and the end surface of outer peripheral rib A12 are thermally welded by heater blocks 26*b* and 26*c*. Thus, the outer side surfaces of outer peripheral ribs B13 at another side of air flow passage facing the inlet and outlet portions of one side of air flow passages are sealed. On the outer side surface of outer peripheral ribs A12 of the laminated adjacent heat transfer plates, outer side surfaces of outer peripheral ribs A12 are thermally welded by heater block 26. Thereby entire peripheral portions of the air flow passages are sealed. Furthermore, dislocation of the heat transfer plates is suppressed so as to improve the sealing property of the air flow passage. Thus, the sealing property of the air flow passage is prevented from being deteriorated due to the dislocation of the heat transfer plates. Thus, it is possible to obtain a heat exchanger with a high sealing property of air flow passage A3 and air flow passage B4.

Note here that the same effect can be obtained even when the order of the first process and second process and the order of the third process and fourth process in the thermal welding process are reverse. Furthermore, sheet block 23 is disposed to thermal welding apparatus 22 in a way in which the heat transfer plates are laminated in the vertical direction. However, the same effect can be obtained even when sheet block 23 is disposed by using thermal welding apparatus 22 in which the heat transfer plates are laminated in the horizontal direction.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

Furthermore, temperature, number and welding time of heater block 26 are described as examples but they are not particularly limited to the examples. The same effect can be obtained even when they are determined so as to obtain an excellent welding state.

EXAMPLE 7

Next, Example 7 of the present invention is described with reference to FIG. 22.

The same members as those in Examples 1, 2, 3, 4, 5 and 6 are designated with the same reference numbers and regarded as having the same effects, and therefore detailed description thereof is omitted herein.

Figure 22:
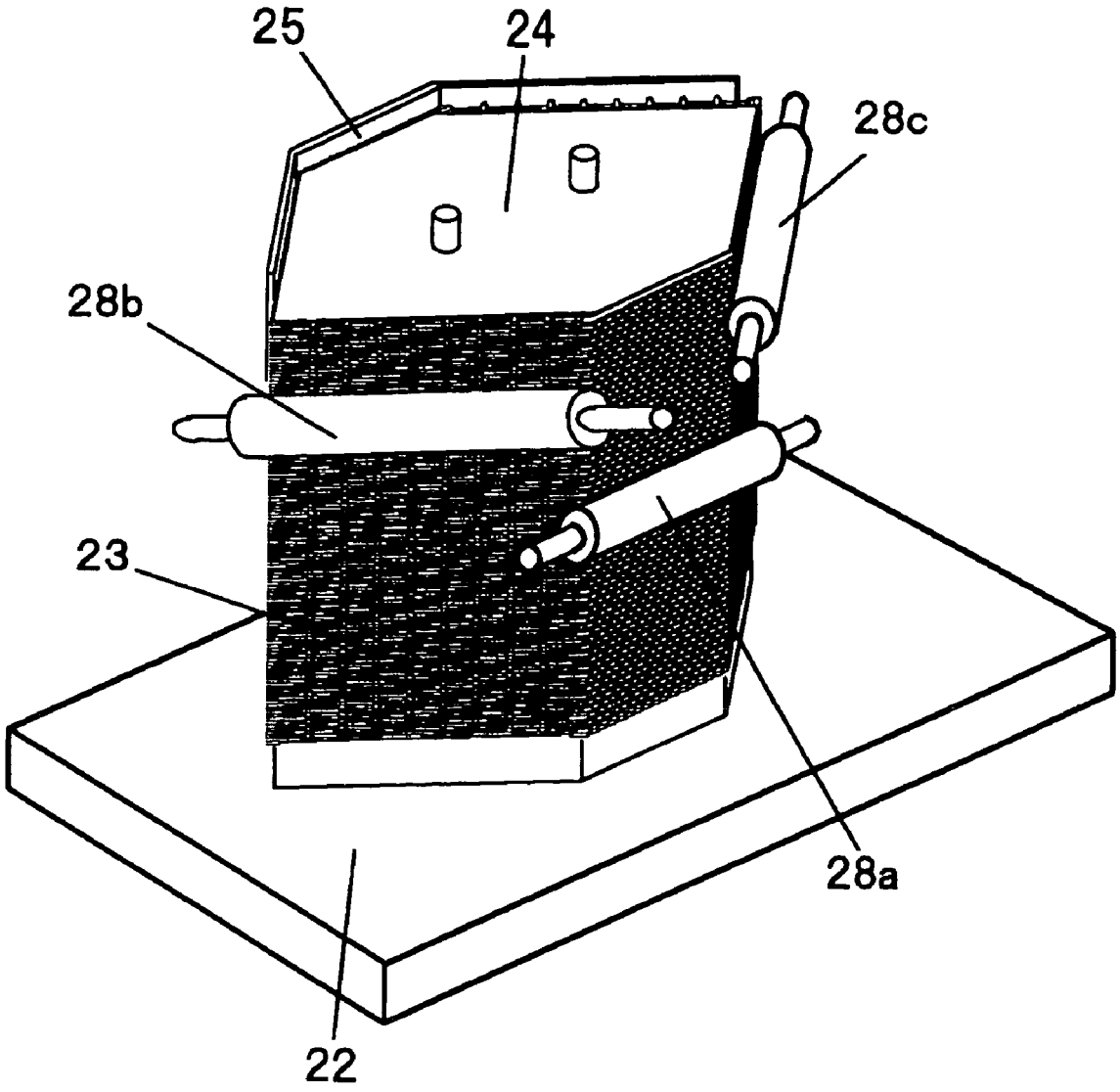
FIG. 22 is a schematic perspective view showing a thermal welding apparatus in accordance with Example 7 of the present invention.

FIG. 22 is a schematic perspective view showing a thermal welding apparatus used in this Example.

As shown in FIG. 22, thermal welding apparatus 22 includes press plate 24 which suppresses dislocation in the laminating direction of sheet block 23 obtained by laminating a predetermined number of sheets alternately, for example, laminating 61 sheets each of heat transfer plates A1 and heat transfer plates B2 alternately with heat transfer plate A1 disposed at the bottom and regulates the height of laminated sheet block 23, for example, regulates it to 280 mm; support plate 25 which suppresses dislocation in the horizontal direction of the heat transfer plates constituting sheet block 23 and which has a shape corresponding to the outer side surface on which the inlets and outlets of air flow passages A3 and air flow passages B4 are formed and the outer side surface of outer peripheral ribs A12 of the heat transfer plates; heater roller 28*a* as a thermal welding means for thermally welding the outer side surface of outer peripheral rib A12 facing the surface that is brought into close contact with support plate 25 of sheet block 23 fixed by press plate 24 and support plate 25; and heater rollers 28*b* and 28*c* as a thermal welding means for thermally welding two surfaces on which the inlets and outlets of air flow passages A3 and air flow passages B4 are formed and which face the surface that is brought into close contact with support plate 25 of sheet block 23 fixed by press plate 24 and support plate 25. Heater rollers 28*a*, 28*b* and 28*c* are formed in length protruding from respective thermally welded surfaces of sheet block 23, for example, protruding by 15 mm each.

On thermal welding apparatus 22, sheet block 23 is disposed in close contact with support plate 25. Thereafter, by pressing press plate 24 to the top surface of sheet block 23, sheet block 23 is fixed to thermal welding apparatus 22.

Thermal welding of the side surface of outer peripheral rib A12 is carried out by pressing heater roller 28*a* to the side surface of outer peripheral rib A12 of sheet block 23 that is fixed to thermal welding apparatus 22 and moving while rotating it from an upper part to a lower part in the laminating direction. Thereafter, at predetermined intervals, for example, at an interval of 30 mm, by pressing heater rollers 28*b* and 28*c* to respective surfaces on which the inlets and outlets of air flow passages A3 and air flow passages B4 are formed and moving while rotating it from an upper part to a lower part in the laminating direction, the respective surfaces on which the inlets and outlets of air flow passages A3 and air flow passages B4 are formed and the respective surfaces on which the inlets and outlets of air flow passages A3 and air flow passages B4 are formed are thermally welded. Thus, the outer peripheral side surfaces of outer peripheral ribs A12 and two surfaces on which the inlets and outlets of air flow passages A3 and air flow passages B4 are formed, which face the surface that is brought into close contact with support plate 25, three surfaces in total are thermally welded.

Then, press plate 24 is once removed from sheet block 23, the direction in which sheet block 23 is set is rotated by 180°. Then, sheet block 23 is fixed by press plate 24 and support plate 25 again. Thermal welding of the side surface of outer peripheral rib A12 is carried out by pressing heater roller 28*a* to the side surface of outer peripheral ribs A12 of sheet block 23 fixed to thermal welding apparatus 22, and moving while rotating it from an upper part to a lower part in the laminating direction. Thereafter, at predetermined intervals, by pressing heater rollers 28*b* and 28*c* to respective surfaces on which the inlets and outlets of air flow passages A3 and air flow passages B4 are formed and moving while rotating it from an upper part to a lower part in the laminating direction, the respective surfaces on which the inlets and outlets of air flow passages A3 and air flow passages B4 are formed and the respective surfaces on which the inlets and outlets of air flow passages A3 and air flow passages B4 are formed are thermally welded. Thus, the outer peripheral side surfaces of outer peripheral ribs A12 and two surfaces on which the inlets and outlets of air flow passages A3 and air flow passages B4 are formed, which face the surface that is brought into close contact with support plate 25, three surfaces in total are thermally welded. Heat exchanger 21 is manufactured in which a portion in which side surfaces of heat transfer plate A1 and heat transfer plate B2 are overlapped with each other are thermally welded on the outer side surface of outer peripheral ribs A12 of sheet block 23 and surfaces on which the inlets and outlets of air flow passages A3 and air flow passages B4 are formed, that is, entire six surfaces are thermally welded According to the above-mentioned Example, since heater roller 28 moves while rotating from an upper part to a lower part along the laminating direction of the heat transfer plates and the direction in which the heater roller is rotated and the direction in which the outer peripheral side surfaces of the heat transfer plates are folded are the same, occurrence of warp or folding of the outer peripheral side surface of the heat transfer plates at the time of thermal welding is prevented. Furthermore, since the direction of level difference between a cut portion of the outer side surface of the heat transfer plate and the outer peripheral side surface of the heat transfer plate located in the lower part, which occurs due to overlapping of the outer side surfaces of the heat transfer plates, is substantially parallel to heater roller 28, defective thermal welding due to the level difference in the outer side surfaces of the heat transfer plates is prevented. Thus, a heat exchanger with a high sealing property can be obtained.

In this Example, sheet block 23 is disposed to thermal welding apparatus 22 in a way in which the heat transfer plates are laminated in the vertical direction. However, the same effect can be obtained even when sheet block 23 is disposed by using thermal welding apparatus 22 in which the heat transfer plates are laminated in the horizontal direction.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

EXAMPLE 8

Next, Example 8 of the present invention is described with reference to FIGS. 23 and 24.

The same members as those in Examples 1, 2, 3, 4, 5, 6 and 7 are designated with the same reference numbers and regarded as having the same effects, and therefore detailed description thereof is omitted herein.

Figure 23:
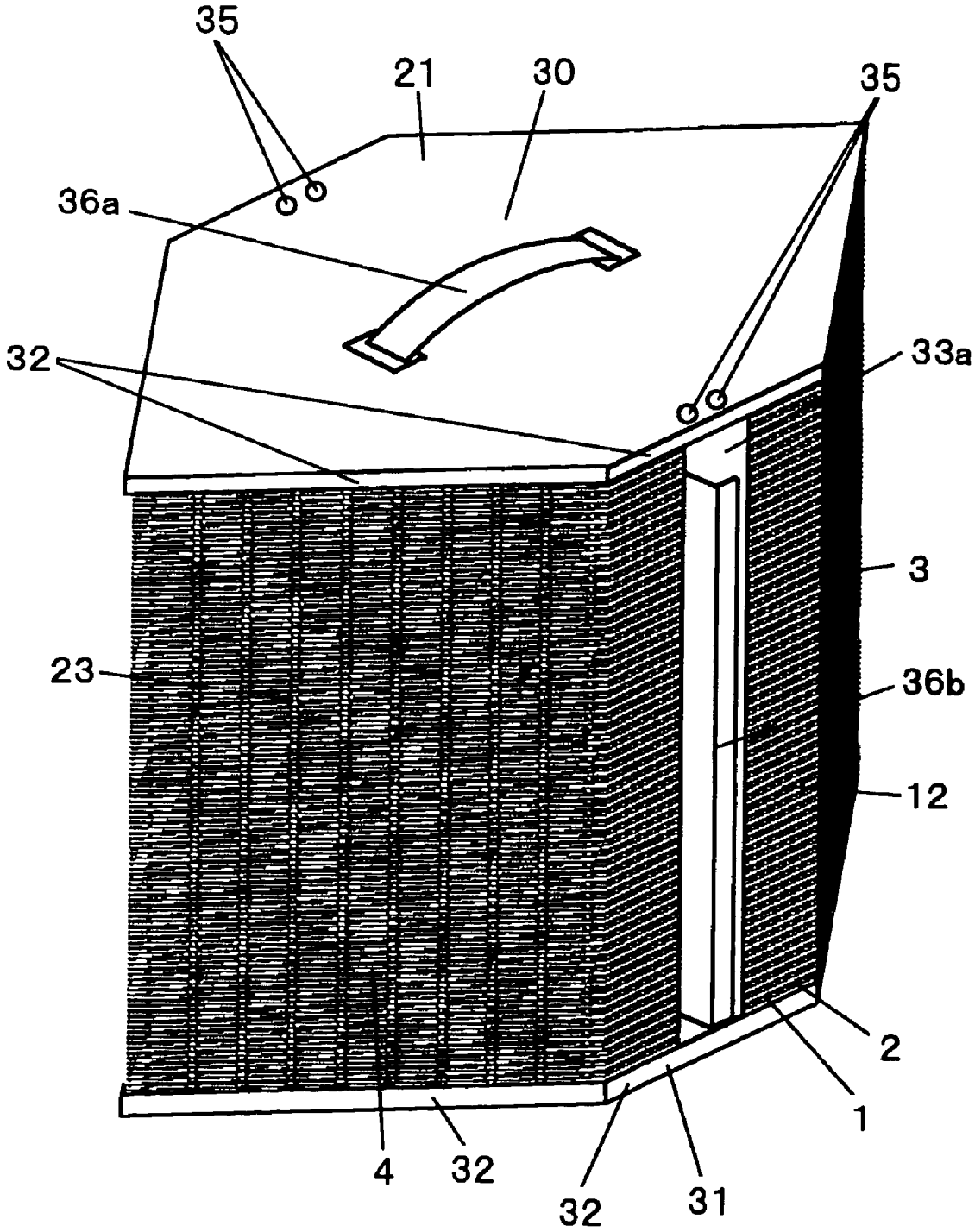
FIG. 23 is a schematic perspective view showing a heat exchanger in accordance with Example 8 of the present invention.
Figure 24:
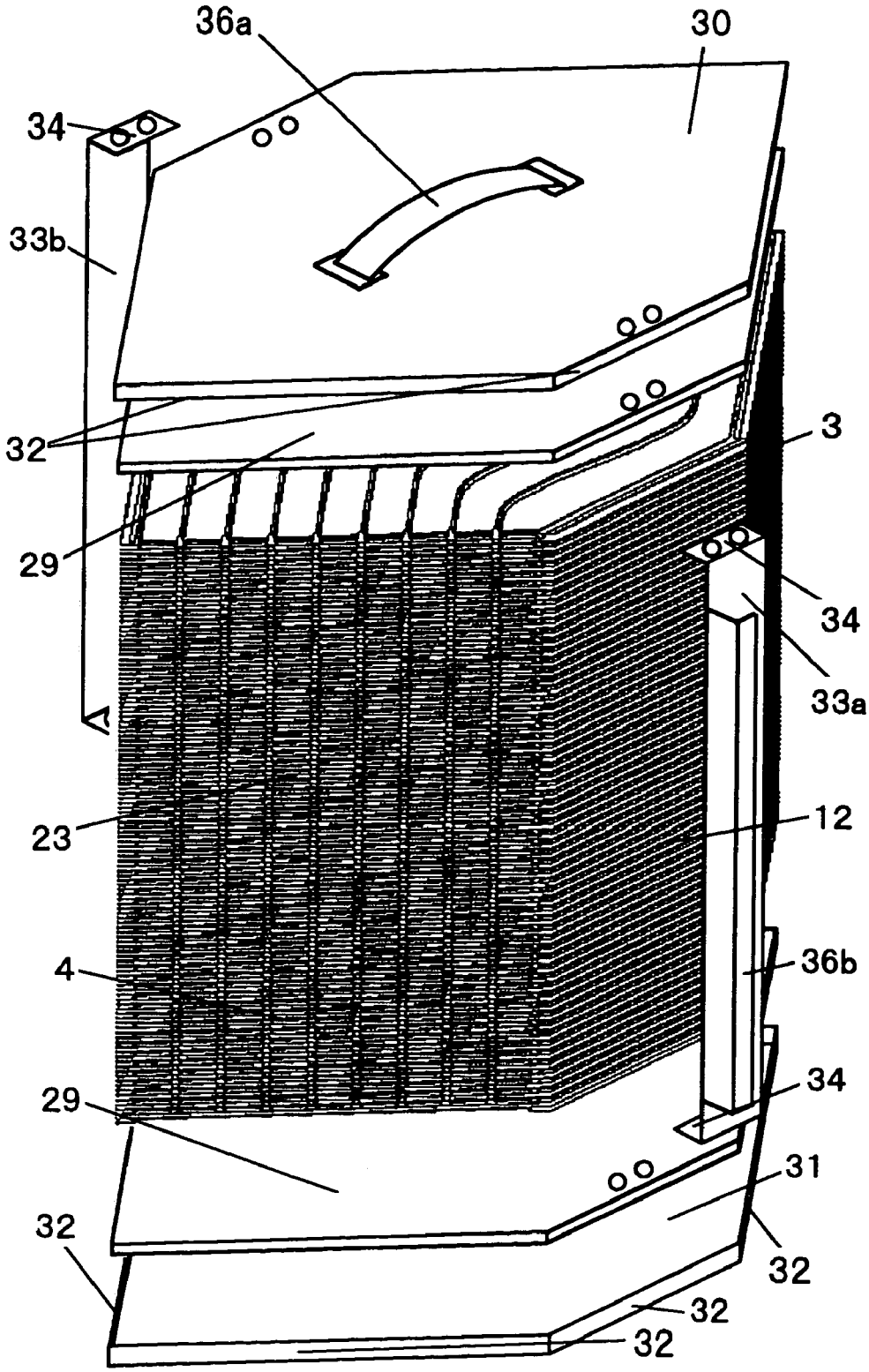
FIG. 24 is a schematic exploded view showing the heat exchanger in accordance with Example 8.

FIG. 23 is a schematic perspective view showing a heat exchanger used in this Example; and FIG. 24 is a schematic exploded view thereof.

As shown in FIGS. 23 and 24, heat exchanger 21 includes urethane foam sheets 29 as an elastic body at both ends in the laminating direction of sheet block 23 obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom. Urethane foam sheet 29 has a thickness of, for example, 5 mm and has a hexagonal shape that is the same as the planar shape of heat transfer plate A1 and heat transfer plate B2. Heat exchanger 21 includes top plate 30 and bottom plate 31 as the first end surface members provided at both ends in the laminating direction of sheet blocks 23 via urethane foam sheets 29. Top plate 30 and bottom plate 31 include side surface covers 32 covering the outer side surfaces of urethane foam sheet 29 and heat transfer plate A1 or heat transfer plate B2 disposed at both ends of and sheet block 23. Heat exchanger 21 includes side plates 33*a* and 33*b* as support members for connecting top plate 30 and bottom plate 31 at both surfaces of the side surfaces of outer peripheral ribs A12 of sheet block 23. Both ends of side plates 33*a* and 33*b* are provided with folded connection portions 34 between top plate 30 and bottom plate 31. Connection portions 34 provided at top plate 30 and bottom plate 31 as well as side plate 33*a* and side plate 33*b* are fastened with screw 35. The upper surface of top plate 30 is provided with handle 36*a*. Side plate 33*a* is provided with handle 36*b* folded in a rectangular U shape in the direction that is opposite to sheet block 23. Top plate 30, bottom plate 31 and side plate 33 are manufactured by a thin iron plate having a thickness of, for example, 0.5 mm.

Handle 36*a* is provided in the direction perpendicular to the direction in which heat transfer plates are laminated and handle 36*b* is provided in the direction perpendicular to the laminating direction, that is, on a side surface of outer peripheral ribs A12. Thereby, a heat exchanger can be attached and detached to/from equipment in the laminating direction of heat transfer plates and in the direction of the side surfaces of outer peripheral ribs A12. With side surface covers 32 provided on top plate 30 and bottom plate 31 and urethane sheets 29, the sealing of air flow passages A3 and air flow passages B 4 is carried out between top plate 30, bottom plate 31 and sheet block 23. Furthermore, with side surface cover 32, positioning can be carried out easily when urethane sheet 29, sheet block 23, top plate 30 and bottom plate 31 are assembled. By disassembling top plate 30, bottom plate 31 and side plate 33, sheet block 23 can be replaced, and urethane foam sheet 29, top plate 30, bottom plate 31 and side plate 33 and screw 35 can be reused. Since sheet block 23 is also composed of only polystyrene, a heat exchanger with a high recycling property can be obtained.

Figure 25:
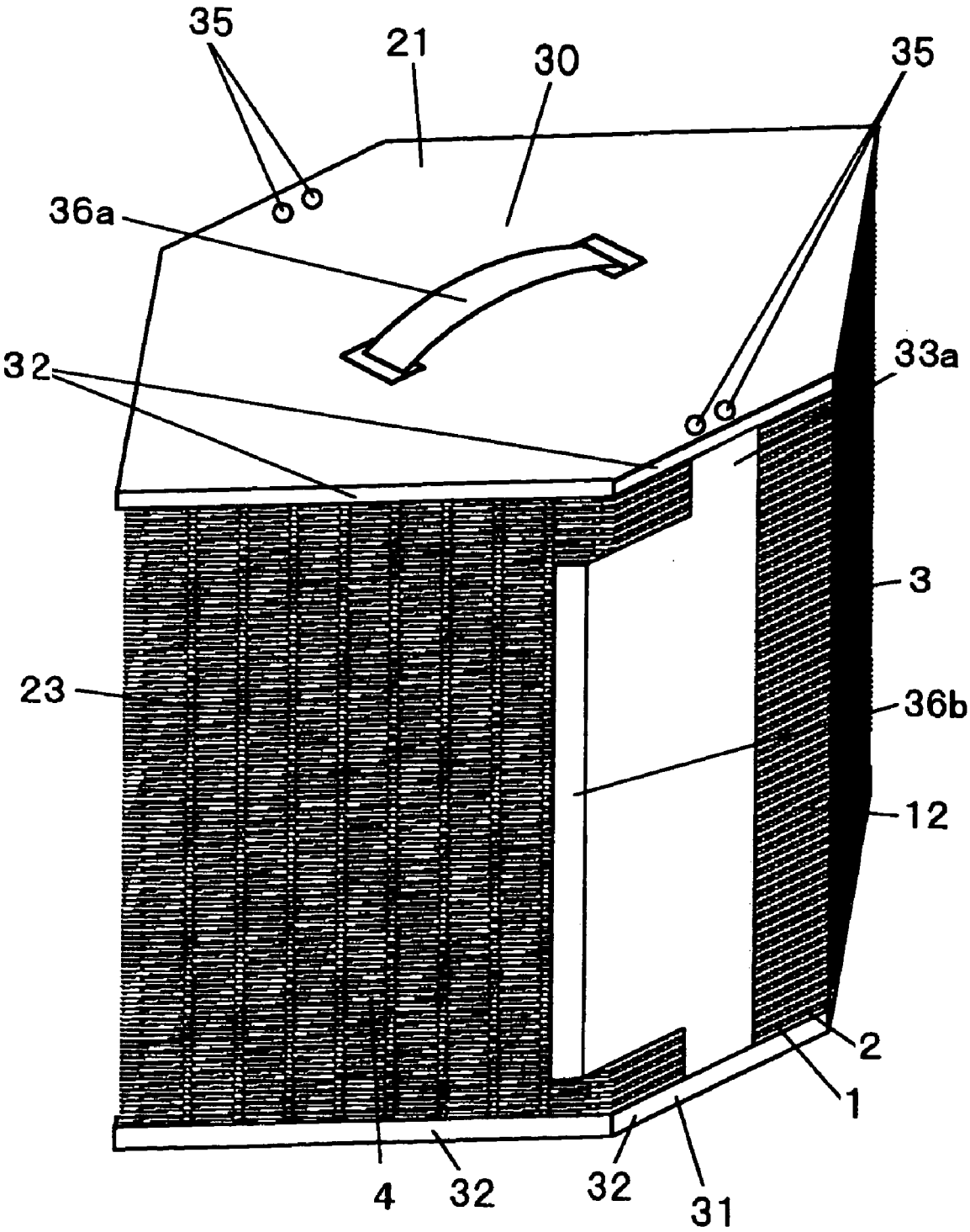
FIG. 25 is a schematic perspective view showing another embodiment of a heat exchanger in accordance with Example 8.
Figure 26:
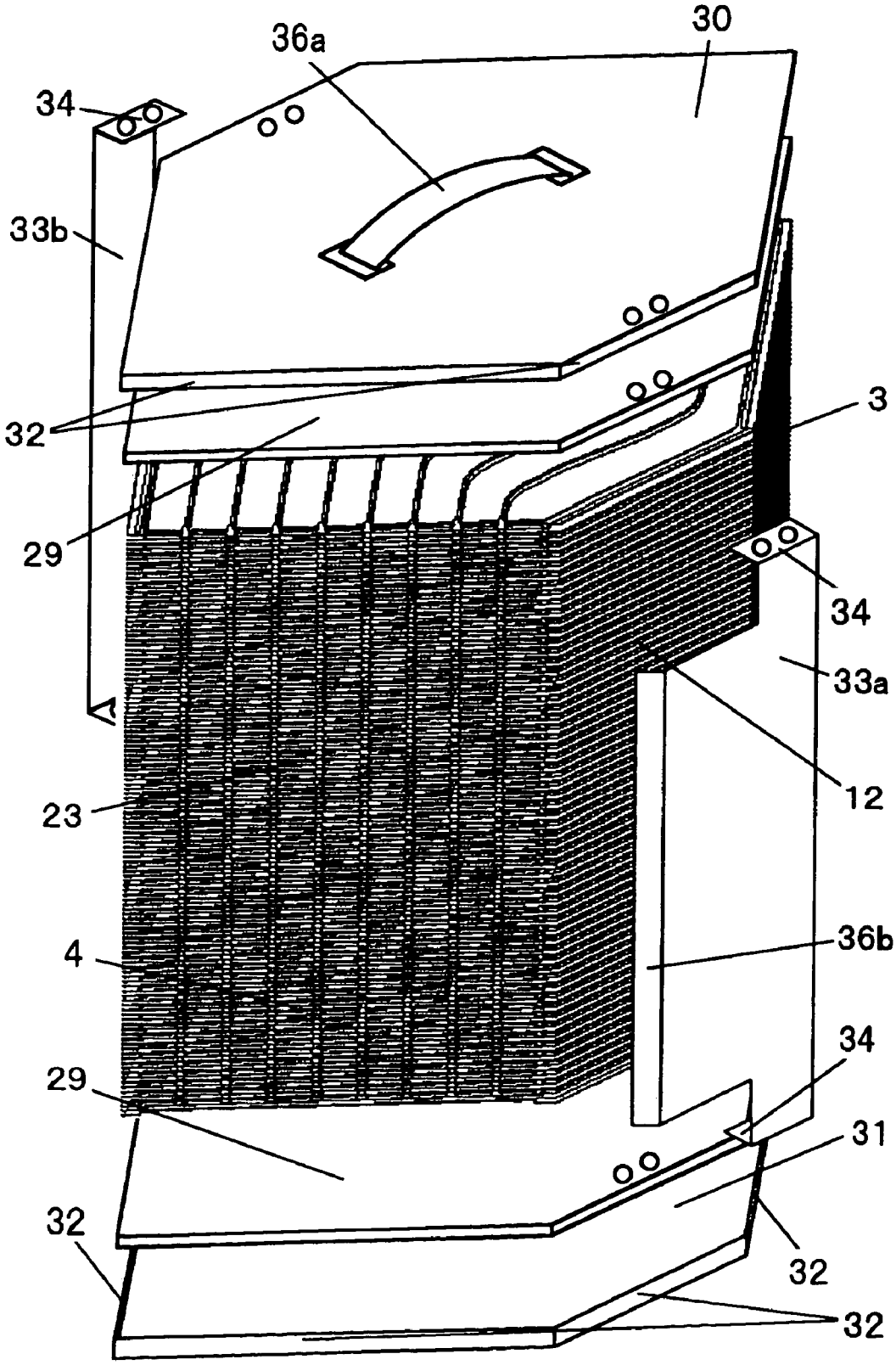
FIG. 26 is a schematic exploded view showing the heat exchanger in accordance with Example 8.

Note here that in this Example, handle 36*b* was formed by folding side plate 31*a* in a rectangular U-shape. As shown in FIGS. 25 and 26, however, the same effect can be obtained even when a shape in which the plate protrudes in the direction of the inlets and outlets of air flow passages A3 or air flow passages B4. Urethane sheet 29 was used as an elastic body. However, the same effect can be obtained even when foam of other resin such as ethylene foam, styrene foam, and the like, or rubber foam is used. The thickness thereof is described as an example and is not particularly limited as long as it can secure the sealing of air flow passages A3 and air flow passages B4 between top plate 30, bottom 31 and sheet block 23.

Urethane sheet 29 was made in a hexagonal shape that is the same as planar shape of heat transfer plate A1 and heat transfer plate B2. However, the same effect can be obtained by making urethane sheet 29 in an annular shape in which the central part is punched out. Furthermore, top plate 30, bottom plate 31 and side plate 33 were made of sheet metal, however, the same effect can be obtained even when other sheet metal such as aluminum or resin is used.

Furthermore, when the direction in which heat exchanger 21 is attached and detached is limited, handle 36 may be provided only in the direction in which heat exchanger 21 is attached and detached.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

EXAMPLE 9

Next, Example 9 of the present invention is described with reference to FIGS. 27 and 28.

The same members as those in Examples 1, 2, 3, 4, 5, 6, 7 and 8 are designated with the same reference numbers and regarded as having the same effects, and therefore detailed description thereof is omitted herein.

Figure 27:
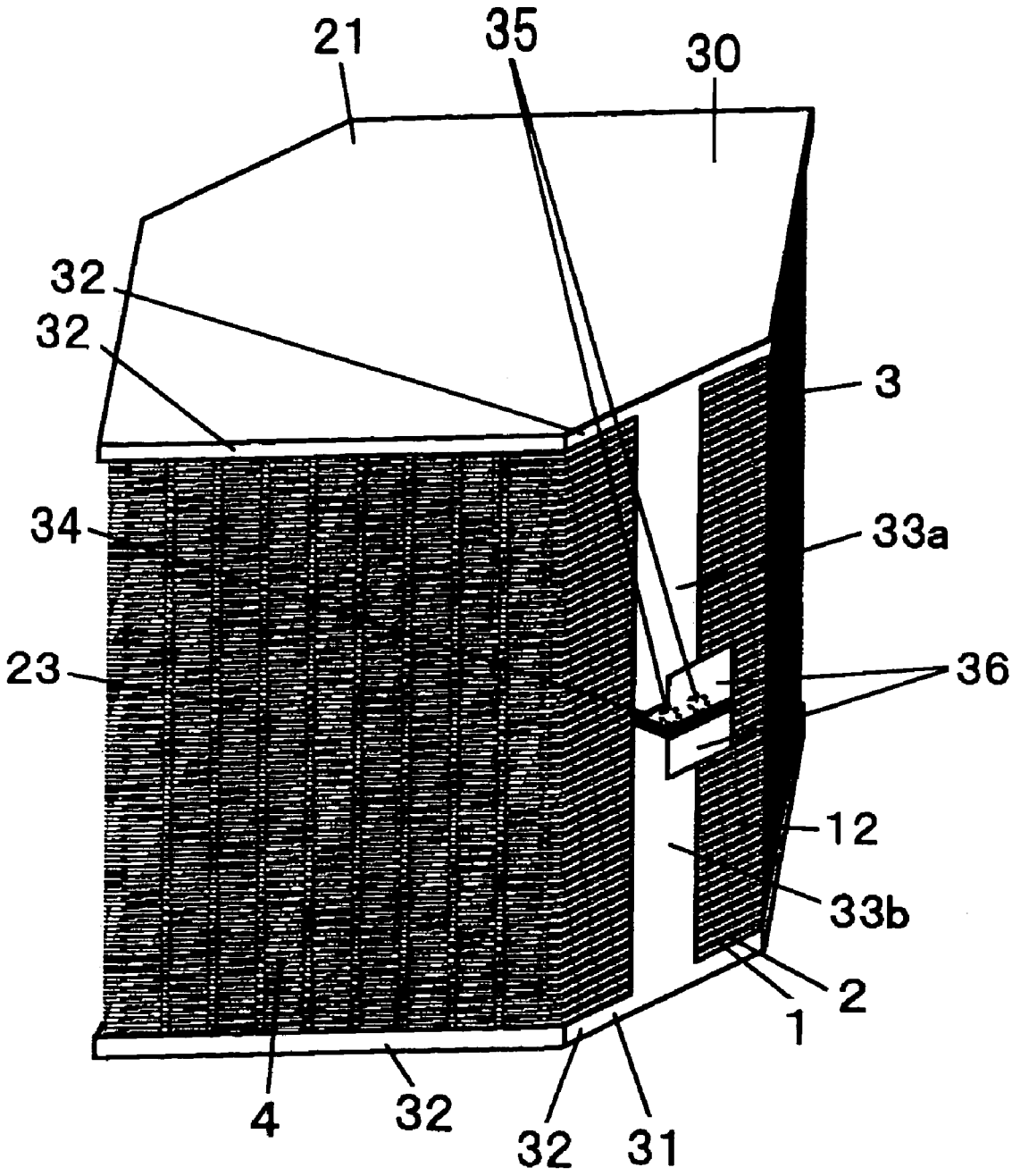
FIG. 27 is a schematic perspective view showing a heat exchanger in accordance with Example 9 of the present invention.
Figure 28:
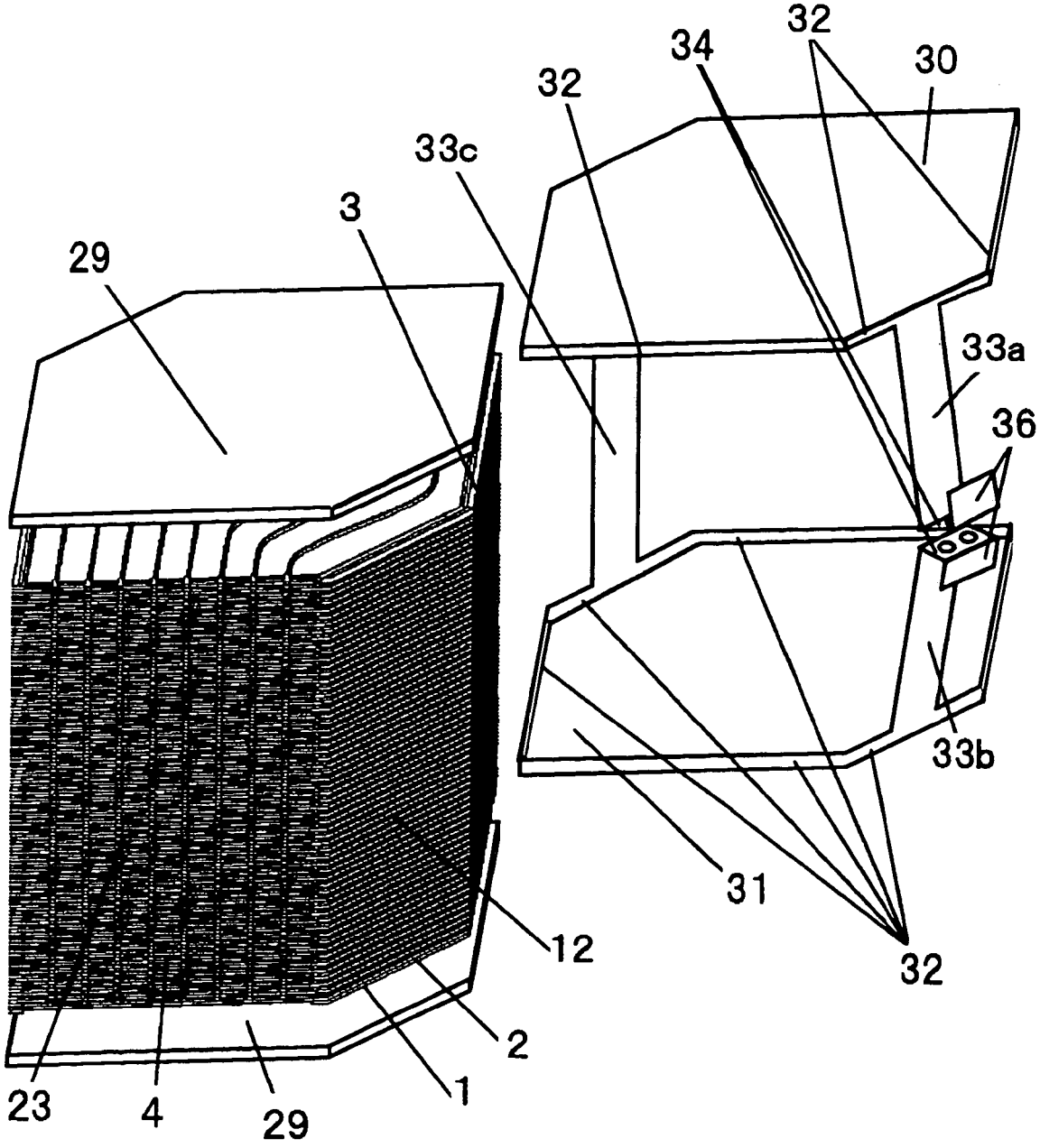
FIG. 28 is a schematic exploded view showing the heat exchanger in accordance with Example 9.

FIG. 27 is a schematic perspective view showing a heat exchanger used in this Example; and FIG. 28 is a schematic exploded view thereof.

As shown in FIGS. 27 and 28, heat exchanger 21 includes urethane foam sheets 29 as an elastic body at both ends in the laminating direction of sheet block 23 obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom. Urethane foam sheet 29 has a thickness of, for example, 5 mm and has a hexagonal shape that is the same as planar shapes of heat transfer plate A1 and heat transfer plate B2. Heat exchanger 21 includes top plate 30 and bottom plate 31 as the first end surface members via urethane foam sheets 29 at both ends in the laminating direction of sheet blocks 23. Top plate 30 and bottom plate 31 include side surface covers 32 covering the outer side surfaces of urethane foam sheet 29 and heat transfer plate A1 and heat transfer plate B2 disposed at both ends of and sheet block 23. On one side of the side surfaces of outer peripheral rib A12 of sheet block 23, side plate 33*a* that is a support member continuing to top plate 30 and side plate 33*b* continuing to bottom plate 31 are provided, and side surface 33*a* and side surface 33*b* are fastened by screw 35 in a connection portion formed by folding the ends of side surface 33*a* and side surface 33*b* in a rectangular U shape. On another side of the side surfaces of outer peripheral rib A12 of sheet block 23, side plate 33*c* continuing to top plate 30 and bottom plate 31 is provided. Top plate 30, bottom plate 31 and side plates 33*a*, 33*b* and 33*c* are manufactured by a thin iron plate having a thickness of, for example, 0.5 mm.

Since rectangular U-shaped connection portion 34 that connects side plate 33*a* and side plate 33*b* provided on the side surfaces of outer peripheral ribs A12 of sheet block 23 functions as also a handle of heat exchanger 21, a heat exchanger can be attached and detached to/from equipment in the direction of the side surfaces of outer peripheral ribs A12. Since top plate 30, bottom plate 31, and side plates 33*a*, 33*b* and 33*c* are integrated with each other, assembling is easy. By removing screw 35 that fastens side plate 33*a* and side plate 33*b*, sheet block 23 can be replaced. Urethane foam sheet 29, top plate 30, bottom plate 31, side plate 33 and screw 35 can be reused. Further, sheet block 23 is composed of only polystyrene, a heat exchanger with a high recycling property can be obtained.

Note here that urethane sheet 29 was used as an elastic body. However, the same effect can be obtained even when foam of other resin such as ethylene foam, styrene foam, and the like, or rubber foam is used. The thickness thereof is described as an example and is not particularly limited as long as it can secure the sealing of air flow passages A3 and air flow passages B4 between top plate 30, bottom 31 and sheet block 23.

Urethane sheet 29 was made in a hexagonal shape that is the same as planar shape of heat transfer plate A1 and heat transfer plate B2. However, the same effect can be obtained by making urethane sheet 29 in an annular shape in which the central part is punched out. Furthermore, top plate 30, bottom plate 31 and side plate 33 were made of sheet metal, however, the same effect can be obtained even when other sheet metal such as aluminum or resin is used.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

EXAMPLE 10

Next, Example 10 of the present invention is described with reference to FIGS. 29 and 30.

The same members as those in Examples 1, 2, 3, 4, 5, 6, 7, 8 and 9 are designated with the same reference numbers and regarded as having the same effects, and therefore detailed description thereof is omitted herein.

Figure 29:
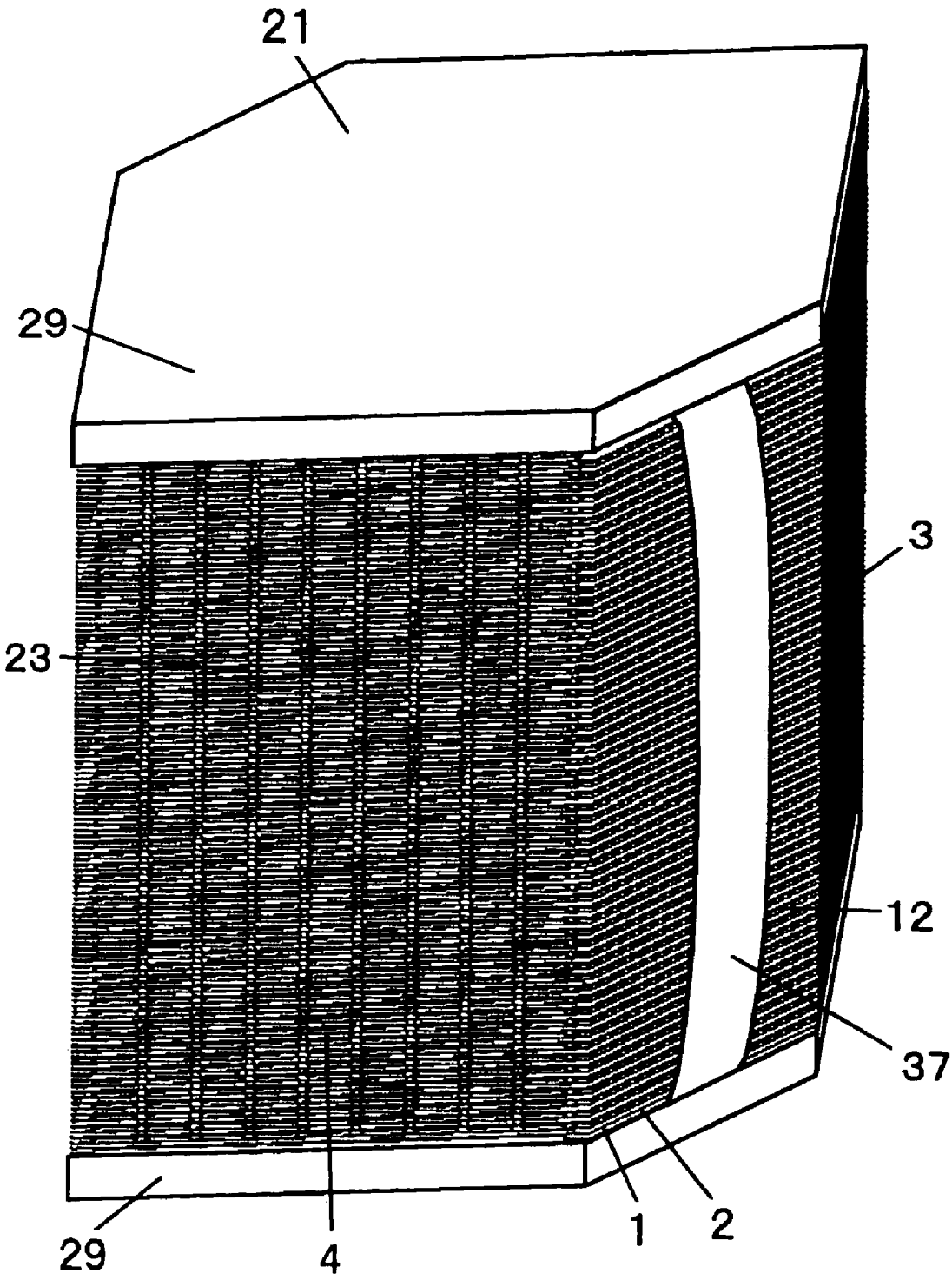
FIG. 29 is a schematic perspective view showing a heat exchanger in accordance with Example 10 of the present invention.
Figure 30:
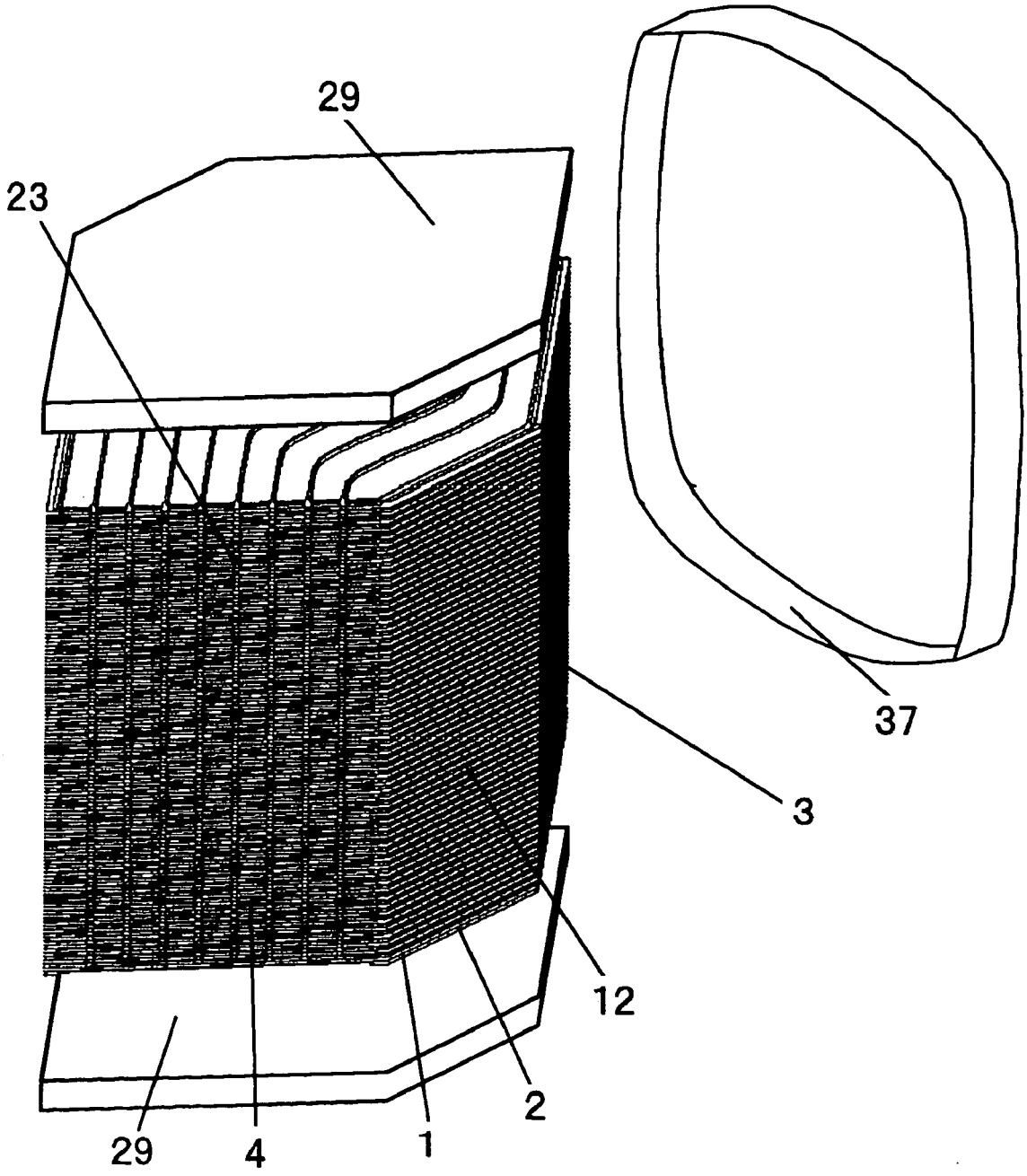
FIG. 30 is a schematic exploded view showing the heat exchanger in accordance with Example 10.

FIG. 29 is a schematic perspective view showing a heat exchanger used in this Example; and FIG. 30 is a schematic exploded view thereof.

As shown in FIGS. 29 and 30, heat exchanger 21 includes resin band 37 as a band-like handle member along the both surfaces of the side surfaces of outer ribs A12 of sheet block 23 obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom; and urethane foam sheets 29 as second end surface members at both ends in the laminating direction of sheet block 23. Urethane foam sheet 29 has a thickness of, for example, 10 mm and has a hexagonal shape that is the same as planar shapes of heat transfer plate A1 and heat transfer plate B2 and an adhesive agent is applied to one side thereof. Resin band 37 is fixed to the heat transfer plate at both ends in the laminating direction of sheet block 23 when urethane foam sheet 29 is affixed.

Since by attaching urethane foam sheets 29 to the both ends of sheet block 23 in the lamination direction, fixing of resin band 37 can be carried out simultaneously, a heat exchanger 21 can be manufactured with fewer man-hours. When heat exchanger 21 is mounted onto equipment, urethane foam sheet 29 can seal between the equipment and heat exchanger 21 at the end surfaces in the laminating direction of the heat transfer plates. Since resin band 37 is disposed on the outer side surfaces of outer peripheral ribs A12, heat exchanger 21 can be attached and detached in the direction of the side surfaces of outer peripheral ribs A12, and by peeling urethane foam sheet 29 from sheet block 23, sheet block 23 is composed of only polystyrene that is a sheet material. Thus, a heat exchanger with a high recycling property can be obtained.

Figure 31:
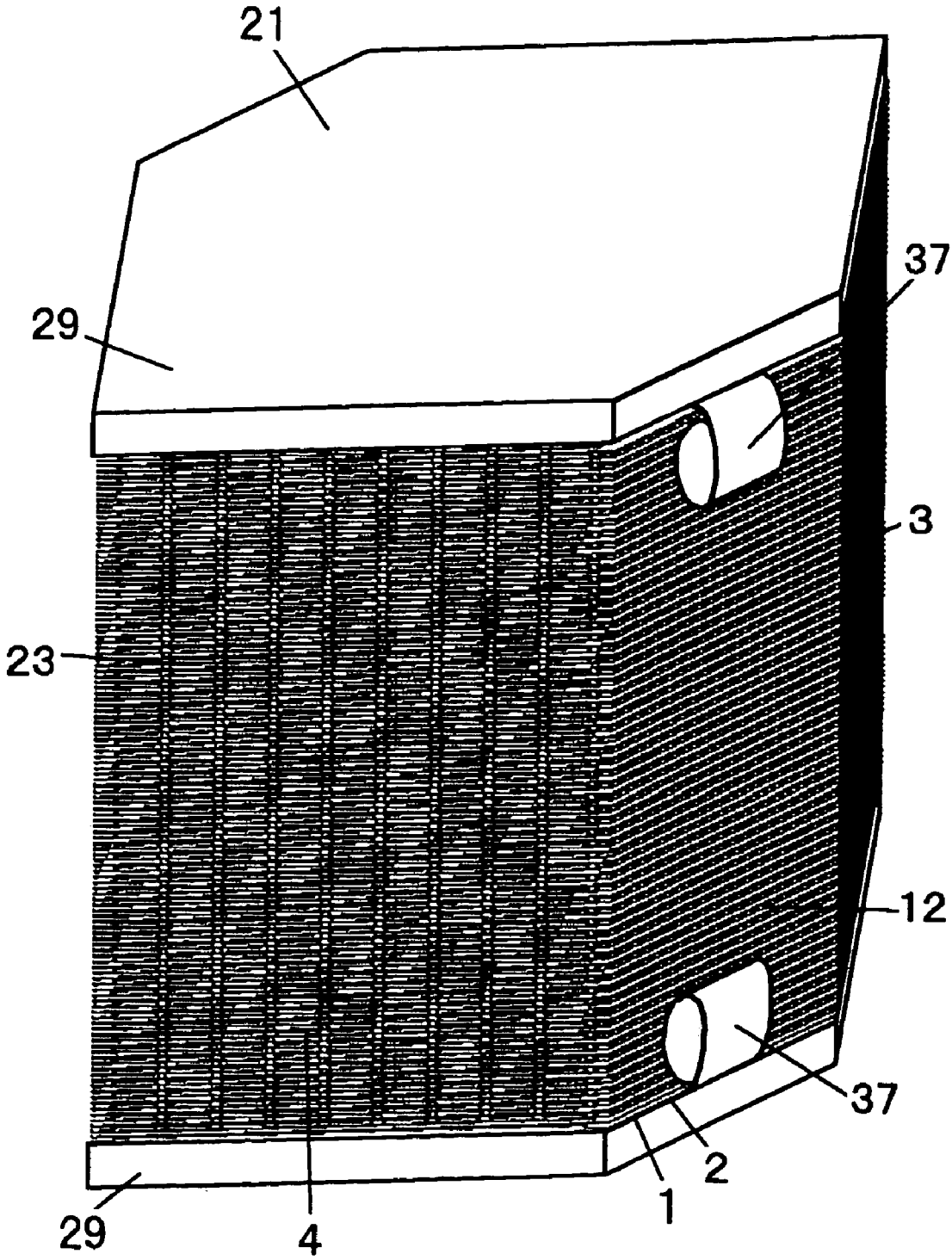
FIG. 31 is a schematic perspective view showing another embodiment of a heat exchanger in accordance with Example 10.
Figure 32:
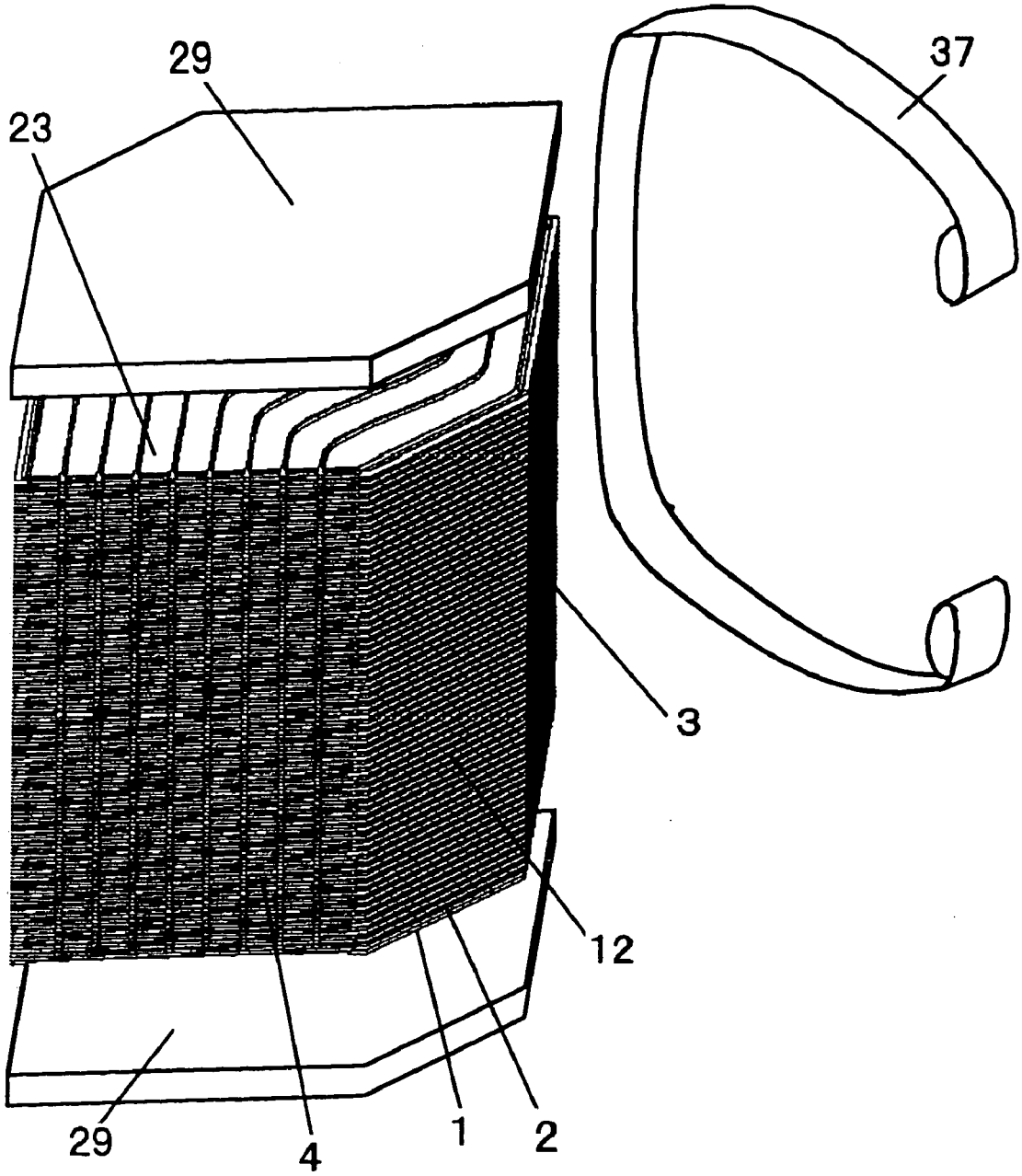
FIG. 32 is a schematic exploded view showing the heat exchanger in accordance with Example 10.

In this Example, resin band 37 has an annular structure. As shown in FIGS. 31 and 32, however, the same effect can be obtained even when it has a shape of one band with both ends protruding to one surface of the side surfaces of outer peripheral rib A12 of sheet block 23. In this Example, urethane sheet 29 was used as an elastic body. However, the same effect can be obtained even when foam of other resin such as ethylene foam, styrene foam, and the like, or rubber foam is used.

The thickness thereof is described as an example and is not particularly limited as long as it can secure the sealing of air flow passage A3 and air flow passage B4 between equipment and heat exchanger 21.

Urethane sheet 29 was made in a hexagonal shape that is the same as a planar shape of heat transfer plate A1 and heat transfer plate B2. However, the same effect can be obtained by making the planar shape in an annular shape in which the central part is punched out.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

EXAMPLE 11

Next, Example 11 of the present invention is described with reference to FIGS. 33 and 34.

The same members as those in Examples 1, 2, 3, 4, 5, 6, 7, 8, 9 and 10 are designated with the same reference numbers and regarded as having the same effects, and therefore detailed description thereof is omitted herein.

Figure 33:
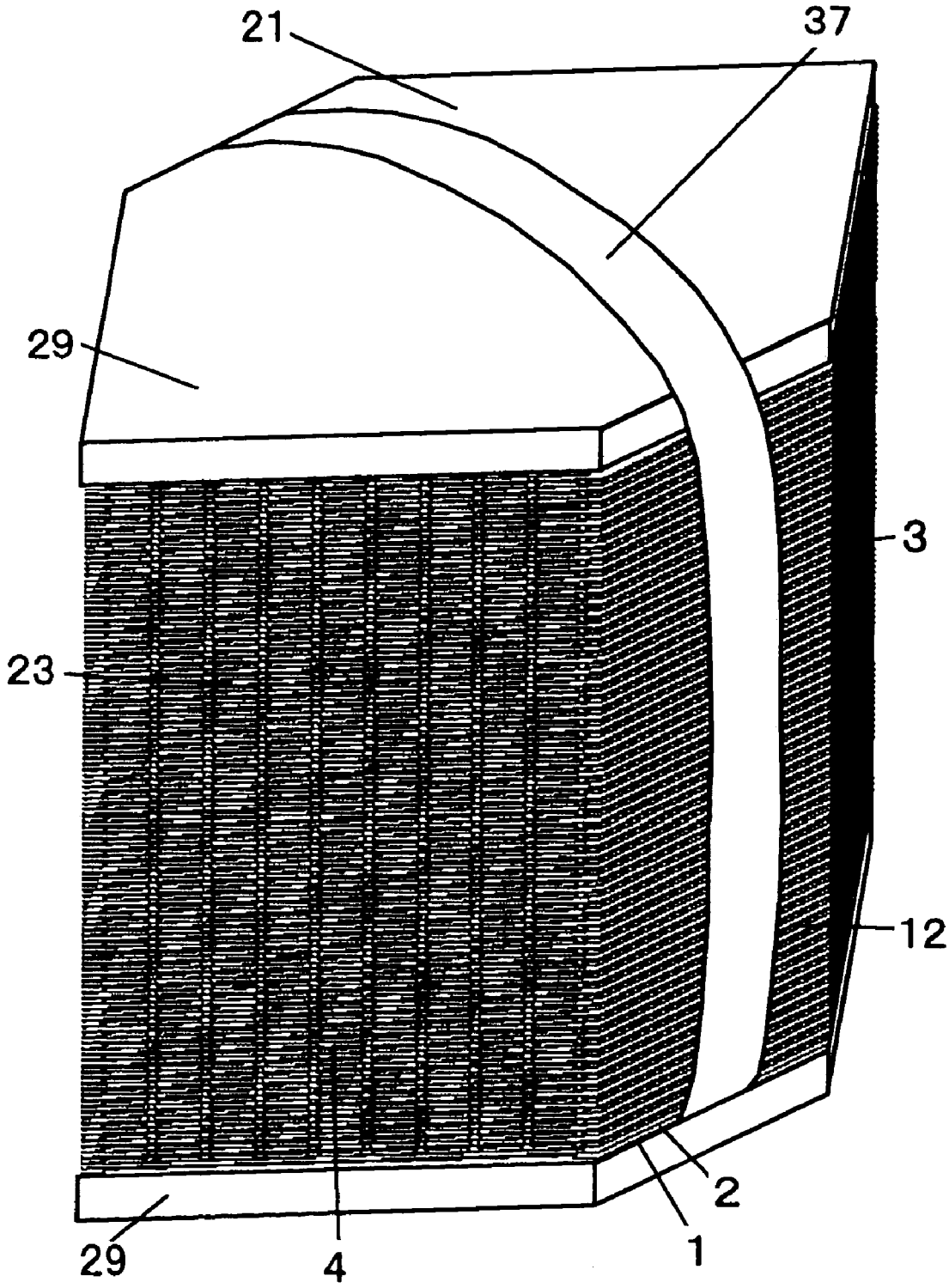
FIG. 33 is a schematic perspective view showing a heat exchanger in accordance with Example 11 of the present invention.
Figure 34:
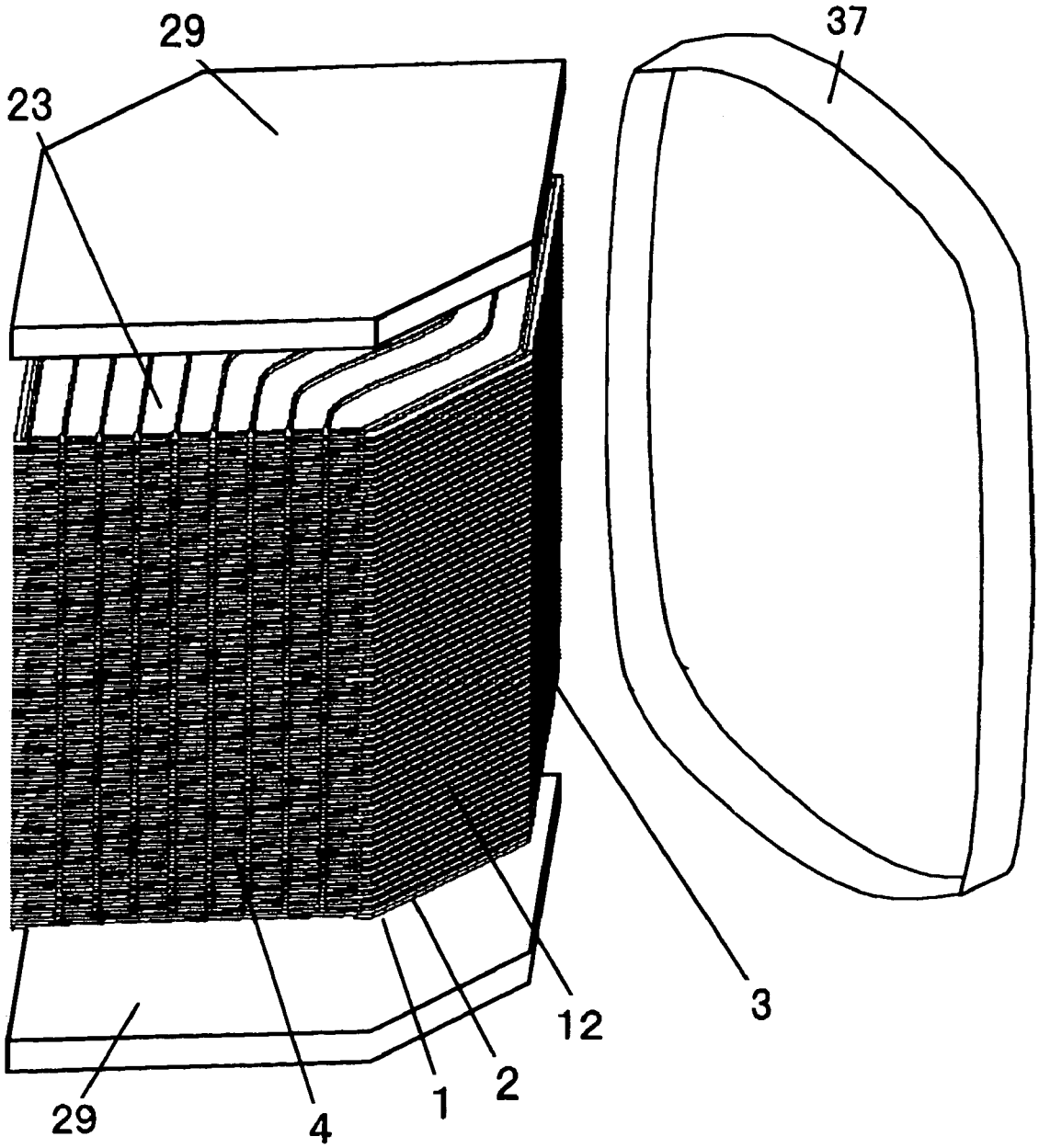
FIG. 34 is a schematic exploded view showing the heat exchanger in accordance with Example 11.

FIG. 33 is a schematic perspective view showing a heat exchanger used in this Example; and FIG. 34 is a schematic exploded view thereof.

As shown in FIGS. 33 and 34, heat exchanger 21 includes resin band 37 as a band-like handle member along the both surfaces of side surface of the outer peripheral rib A12 of sheet block 23 obtained by laminating a predetermined number of heat transfer plates A1 and heat transfer plates B2 alternately, for example, laminating 61 sheets each of heat transfer plates A1 and heat transfer plates B2 alternately with heat transfer plate A1 disposed at the bottom; and urethane foam sheets 29 as second end surface members at both ends in the laminating direction of sheet block 23. Urethane foam sheet 29 has a thickness of, for example, 10 mm and has a hexagonal shape that is the same as a planar shape of heat transfer plate A1 and heat transfer plate B2 and an adhesive agent is applied to one side thereof. Resin band 37 is fixed to the heat transfer plate A1 that is located at the bottom when urethane foam sheet 29 is attached at a lower end surface in the laminating direction of sheet block 23 and is disposed at the outside of urethane foam sheet 29 at an upper end surface.

With the above-mentioned configuration, since by attaching urethane foam sheets 29 to heat transfer plate A1 at the bottom, fixing of resin band 37 can be carried out simultaneously, a heat exchanger can be manufactured with fewer man-hours. When heat exchanger 21 is mounted onto equipment, urethane foam sheet 29 can seal between the equipment and heat exchanger 21 at end surfaces in the laminating direction of the heat transfer plates. Since resin band 37 is disposed at the outside of urethane sheet 29 affixed to the outer side surface and the upper surface of outer peripheral rib A12, the heat exchanger can be attached and detached both in the direction of the side surface of outer peripheral ribs A12 and in the laminating direction of heat transfer plates. By peeling urethane foam sheet 29 from sheet block 23, sheet block 23 is composed of only polystyrene that is a sheet material. Thus, a heat exchanger with a high recycling property can be obtained.

Note here that urethane sheet 29 was used as an elastic body. However, the same effect can be obtained even when foam of other resin such as ethylene foam, styrene foam, and the like, or rubber foam is used. Urethane sheet 29 was made in a hexagonal shape that is the same as a planar shape of heat transfer plate A1 and heat transfer plate B2. However, the same effect can be obtained by making the planar shape in an annular shape with the central part punched out.

The thickness thereof is described as an example and is not particularly limited as long as it can secure the sealing of air flow passage A3 and air flow passage B4 between equipment and heat exchanger 21.

Urethane sheet 29 was made in a hexagonal shape that is the same as a planar shape of heat transfer plate A1 and heat transfer plate B2. However, the same effect can be obtained by making the planar shape in an annular shape with the central part punched out.

Furthermore, the number of heat transfer plates A1 and heat transfer plates B2 to be laminated to constitute sheet block 23 is described as an example. The same effect can be obtained even when a heat exchanger is appropriately designed in terms of performance of the heat exchanger, for example, air-flow resistance, heat exchanging efficiency, and the like. Furthermore, a heat transfer plate to be disposed at the bottom is not particularly limited to heat transfer plate A1. The same effect can be obtained by laminating heat transfer plates with heat transfer plate B disposed at the bottom.

EXAMPLE 12

Next, Example 12 of the present invention is described with reference to FIGS. 35, 36, 37, 38 and 39.

The same members as those in Examples 1, 2, 3, 4, 5, 6, 7, 8, 9, 10 and 11 are designated with the same reference numbers and regarded as having the same effects, and therefore detailed description thereof is omitted herein.

Figure 35:
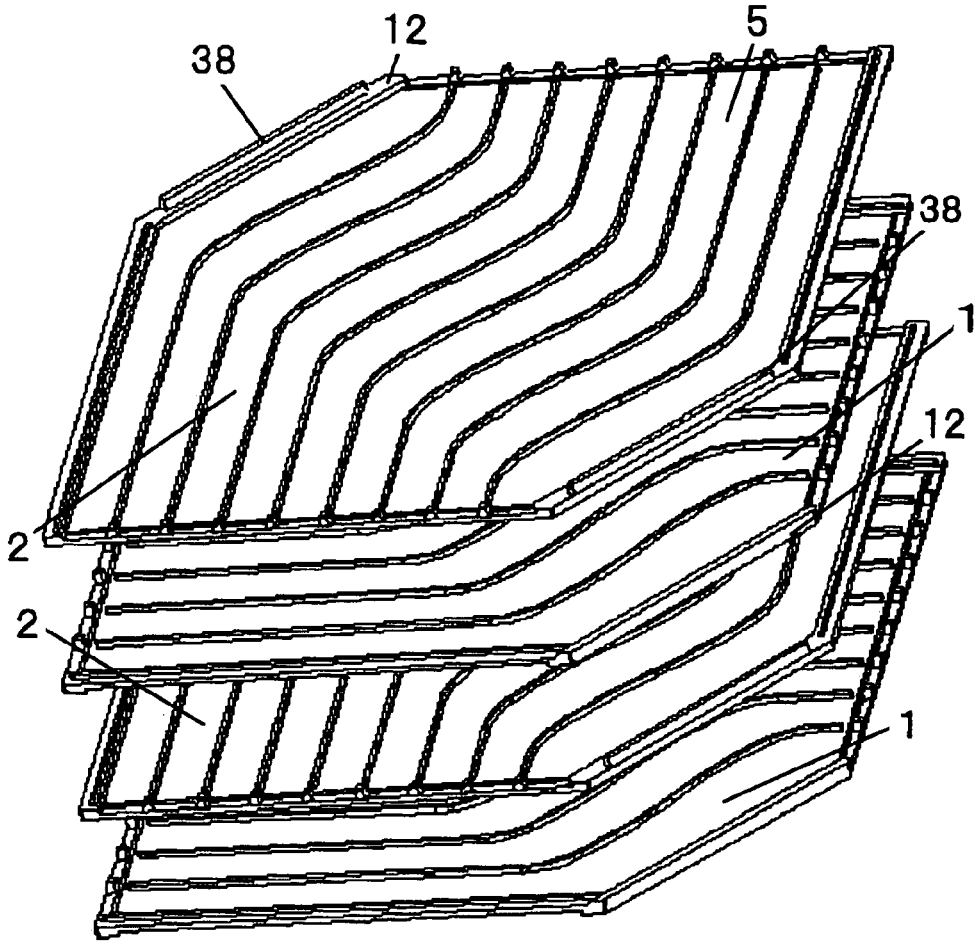
FIG. 35 is a schematic perspective view showing a heat exchanger in accordance with Example 12 of the present invention.
Figure 36:
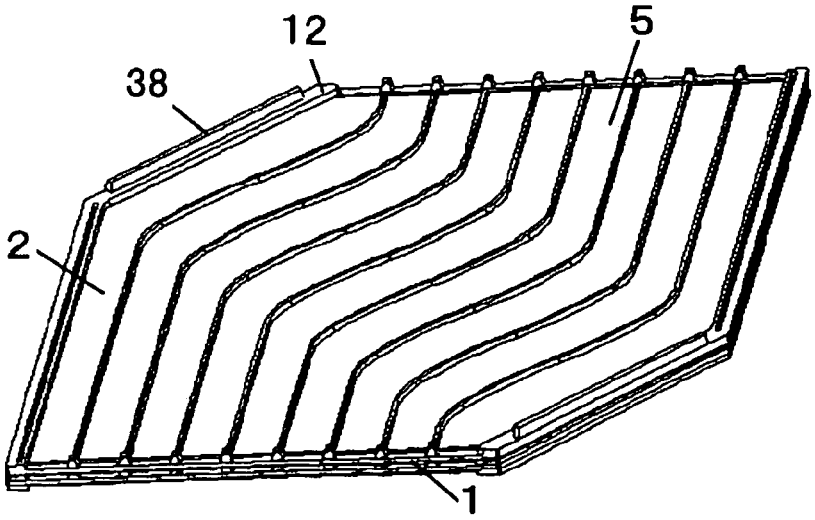
FIG. 36 is a schematic perspective view showing a laminated state in accordance with Example 12.

FIG. 35 is a schematic perspective view showing a heat exchanger used in this Example; FIG. 36 is a schematic perspective view showing a state in which the heat transfer plates are laminated; and FIG. 37 is a schematic sectional view thereof.

As shown in FIGS. 35 and 36, side surface reinforcement convex portion 38 is provided on the upper surface of outer peripheral rib A12 of heat transfer plate B2, and side surface reinforcement convex portion 38 is formed in a continuous shape with the width of, for example, 4 mm that is equal to the width of outer peripheral rib A12 of heat transfer plate A1 and with the convex height of 4 mm with respect to the surface of outer peripheral rib A12.

Figure 37:
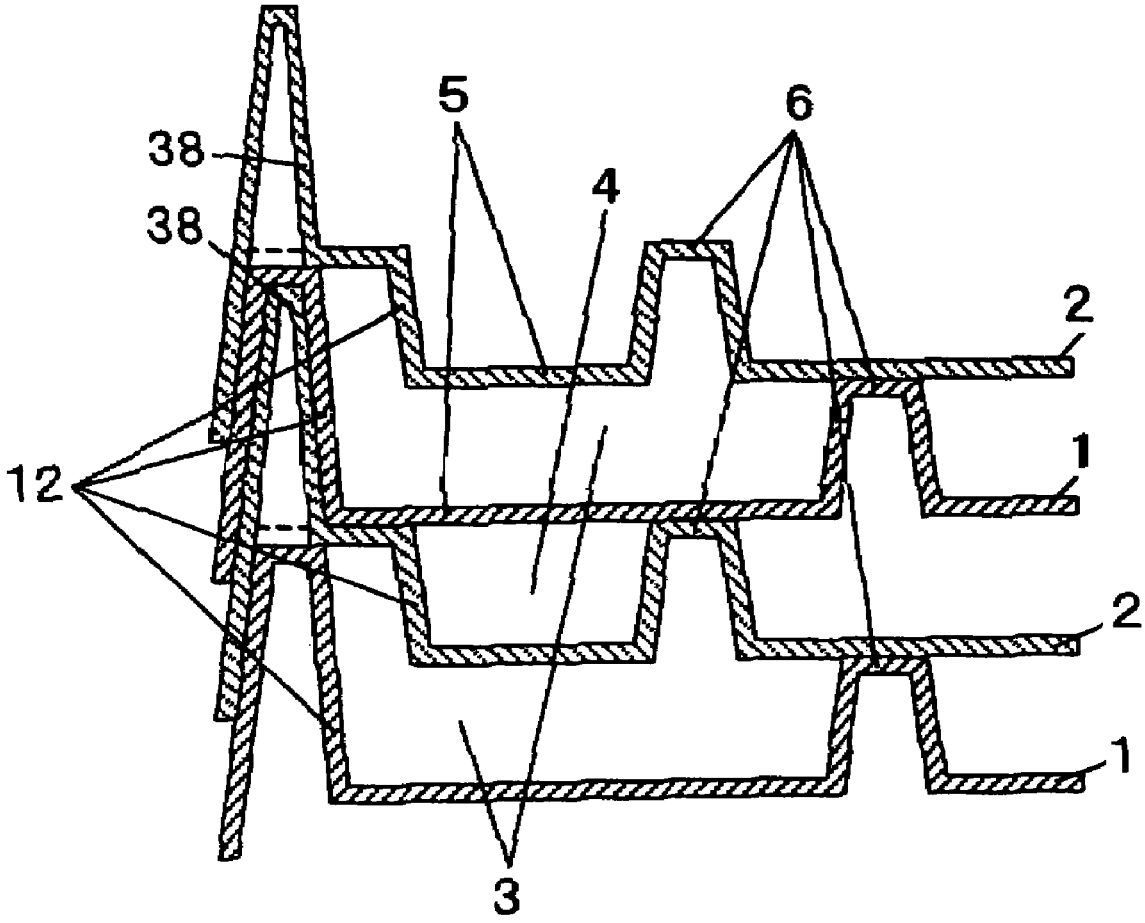
FIG. 37 is a schematic sectional view showing a laminated state of a side surface portion in accordance with Example 12.

When heat transfer plates A1 and heat transfer plates B2 are laminated alternately, as shown in FIG. 37, the upper surface of outer peripheral rib A12 formed on heat transfer plate A1 is brought into contact with the rear surface of outer peripheral rib A12 formed on heat transfer plate B2; the upper surface of outer peripheral rib A12 formed on heat transfer plate B2 is brought into contact with the rear surface of heat transfer surface 5 formed on heat transfer plate A1; and the upper surface and the side surface of side surface reinforcement convex portion 38 formed on outer peripheral rib A12 of heat transfer plate B2 are brought into contact with the rear surface and the side surface of outer peripheral rib A12 formed on heat transfer plate A1.

According to the above-mentioned configuration, when adjacent surfaces of the outer side surfaces of outer peripheral ribs A12 of heat exchanger 21 are thermally welded to each other, a hollow convex portion of outer peripheral rib A12 of heat transfer plate A1 is brought into contact with side surface reinforcement convex portion 38 of heat transfer plate B2. Thereby, after heated transfer plates are melted, when a temperature decreases and respective heat transfer plates are welded, deformation of the side surface portion due to temperature shrinkage is prevented, and deterioration of the sealing property due to the deformation is further prevented. Thus, the sealing property of the side surface portion can be improved.

Figure 38:
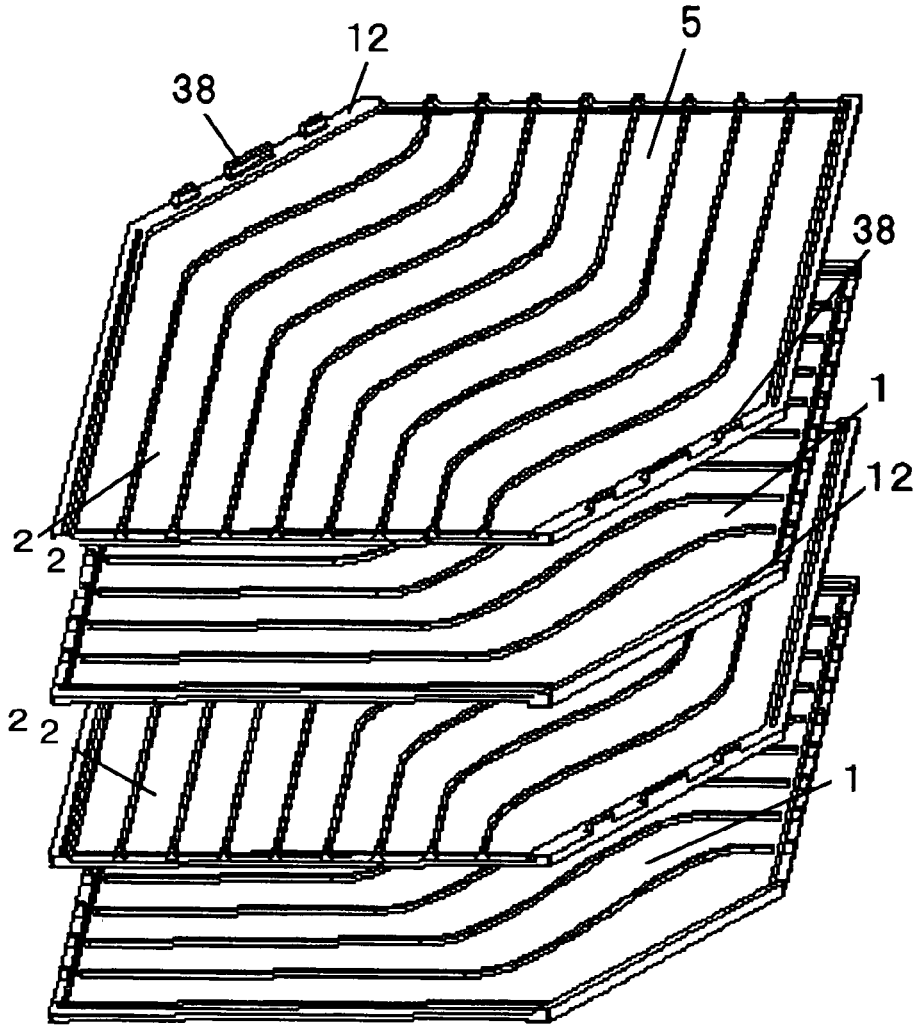
FIG. 38 is a schematic exploded perspective view showing the heat exchanger in accordance with Example 12.
Figure 39:
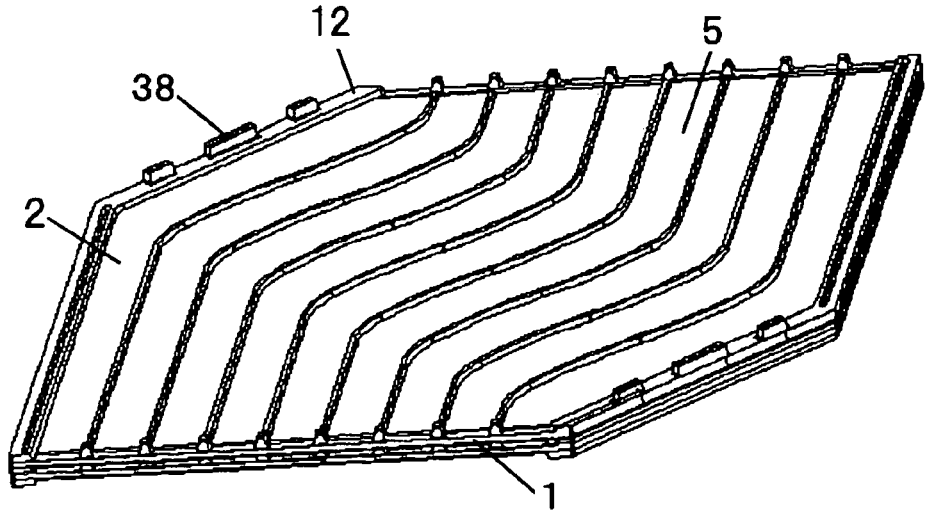
FIG. 39 is a schematic perspective view showing a laminated state in accordance with Example 12.

In this Example, side surface reinforcement convex portion 38 was described to have a continuous shape. As shown in FIGS. 38 and 39, even when side surface reinforcement convex portion 38 is configured to have a discontinuous shape, the same effect can be obtained.

EXAMPLE 13

Next, Example 13 of the present invention is described with reference to FIGS. 40 and 41.

The same members as those in Examples 1, 2, 3, 4, 5, 6, 7, 8, 9, 10, 11 and 12 are designated with the same reference numbers and regarded as having the same effects, and therefore detailed description thereof is omitted herein.

Figure 40:
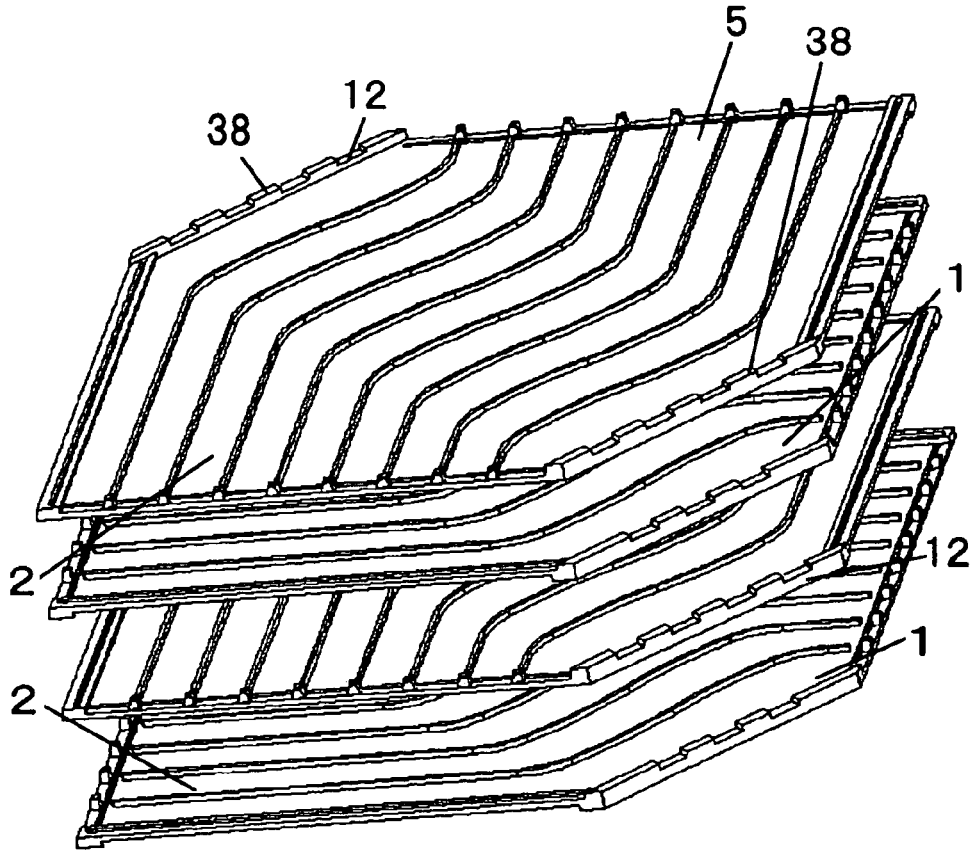
FIG. 40 is a schematic exploded perspective view showing a heat exchanger in accordance with Example 13 of the present invention.
Figure 41:
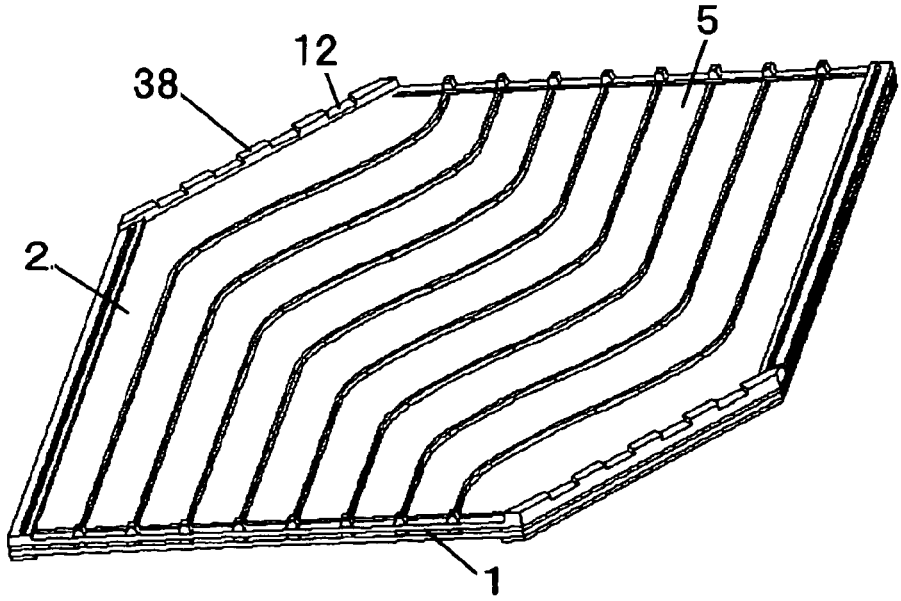
FIG. 41 is a schematic perspective view showing a laminated state in accordance with Example 13.

FIG. 40 is a schematic exploded perspective view showing a heat exchanger used in this Example; and FIG. 41 is a schematic perspective view showing a state in which heat transfer plates are laminated.

As shown in FIGS. 40 and 41, the width of outer peripheral rib A12 of heat transfer plate A1 and heat transfer plate B2 is made to be, for example, 4 mm and the convex height thereof is made to be 2 mm with respect to the surface of heat transfer surface 5. Heat transfer plate A1 and heat transfer plate B2 have discontinuous side surface reinforcement convex portion 38 on the upper surface of outer peripheral rib A12. The width of side surface reinforcement convex portion 38 is made to be 4 mm that is equal to the above-mentioned width of outer peripheral rib A12 and the convex height thereof is 2 mm with respect to the surface of outer peripheral rib A12. Furthermore, side surface reinforcement convex portions 38 of heat transfer plate A1 and heat transfer plate B2 are configured so as to be dislocated with respect to the laminating direction of heat transfer plates in which, when the heat transfer plates A1 and heat transfer plates B2 are laminated alternately, the upper surface and the side surface of side surface reinforcement convex portion 38 formed on heat transfer plate A1 are brought into contact with the rear surface and the side surface of outer peripheral rib A12 formed on heat transfer plate B2, and the upper surface and the side surface of side surface reinforcement convex portions 38 formed on heat transfer plate B2 are brought into contact with the rear surface and the side surface of outer peripheral rib A12 formed on heat transfer plate A1.

According to the above-mentioned configuration, when adjacent surfaces of the outer side surfaces of outer peripheral ribs A12 of heat exchanger 21 are thermally welded to each other, hollow convex portions of outer peripheral ribs A12 of heat transfer plate A1 and heat transfer plate B2 are brought into contact with respective side surface reinforcement convex portions 38. Thereby, after heated transfer plates are melted, when a temperature decreases and respective heat transfer plates are welded, deformation of the side surface portion due to temperature shrinkage is prevented, and deterioration of the sealing property due to the deformation is further prevented. Thus, the sealing property of the side surface portion can be improved.

EXAMPLE 14

Next, Example 14 of the present invention is described with reference to FIGS. 42 and 43.

The same members as those in Examples 1, 2, 3, 4, 5, 6, 7, 8, 9, 10, 11, 12 and 13 are designated with the same reference numbers and regarded as having the same effects, and therefore detailed description thereof is omitted herein.

Figure 42:
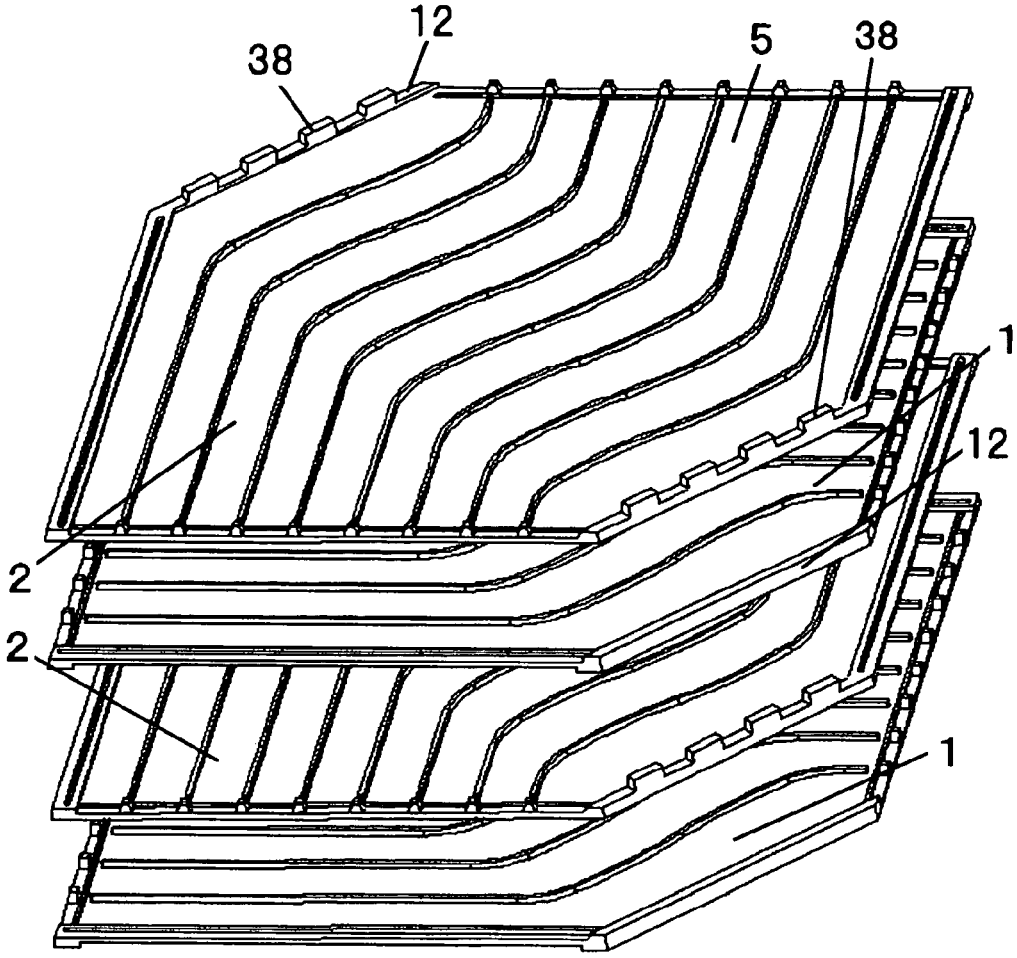
FIG. 42 is a schematic exploded perspective view showing a heat exchanger in accordance with Example 14 of the present invention.
Figure 43:
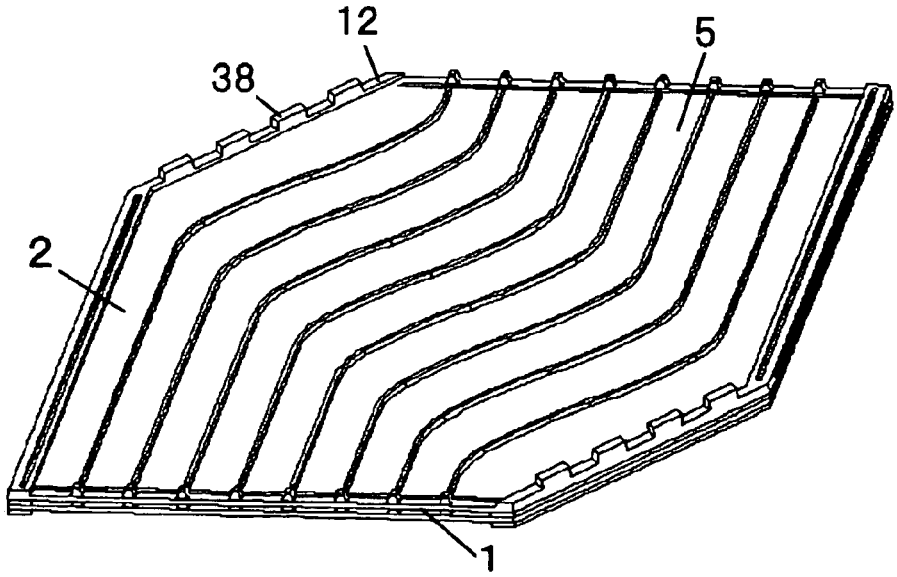
FIG. 43 is a schematic perspective view showing a laminated state in accordance with Example 14.
Figure 44:
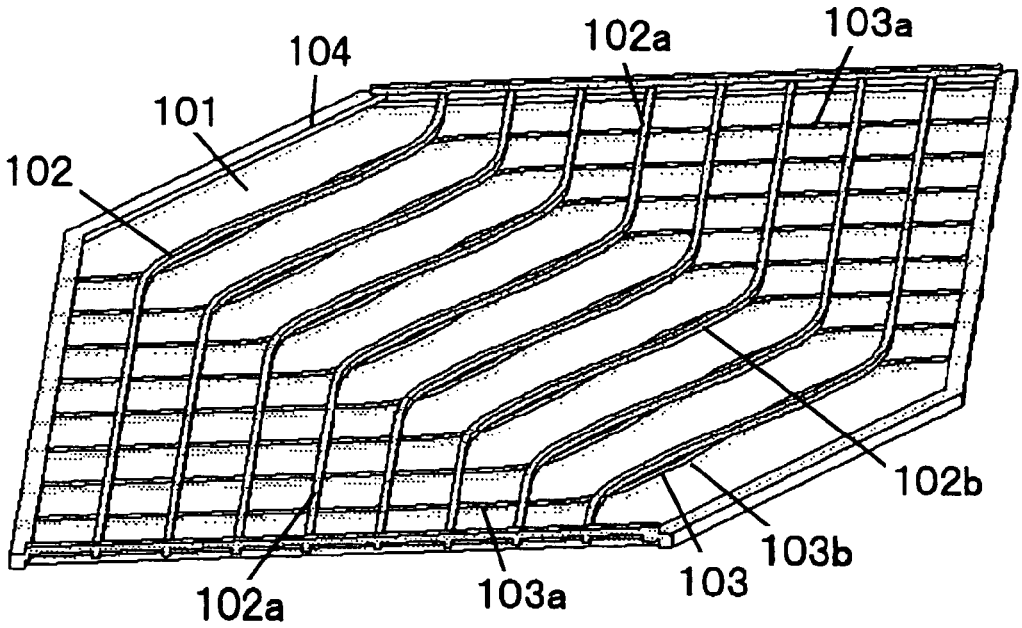
FIG. 44 is a schematic perspective view showing a unit member of a heat exchanger in accordance with a conventional Example.
Figure 45:
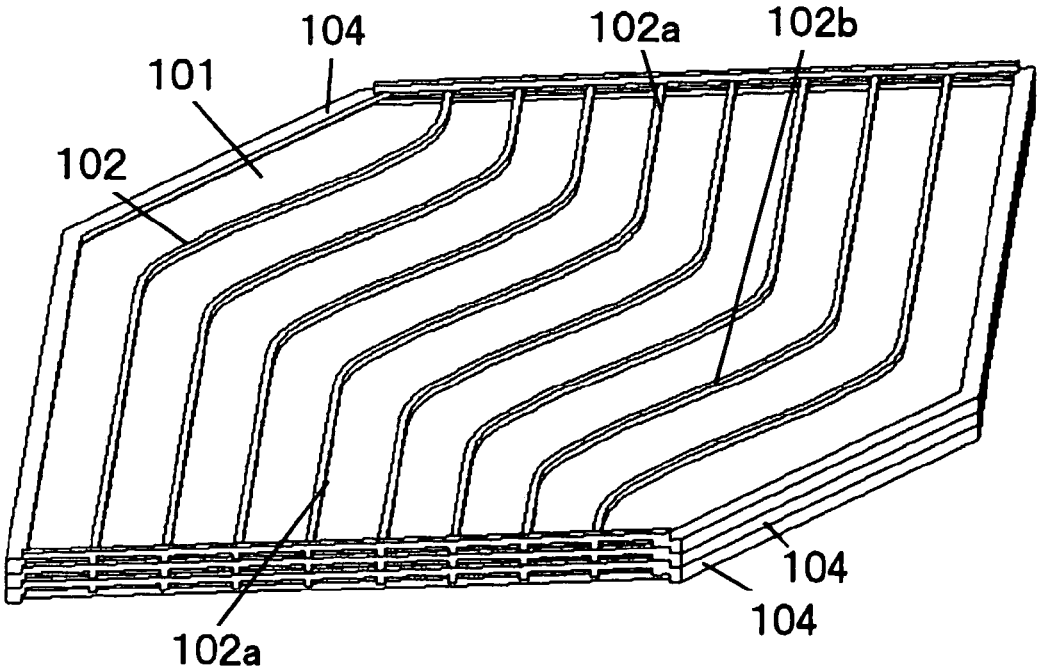
FIG. 45 is a schematic perspective view showing a laminated state in accordance with a conventional Example.
Figure 46:
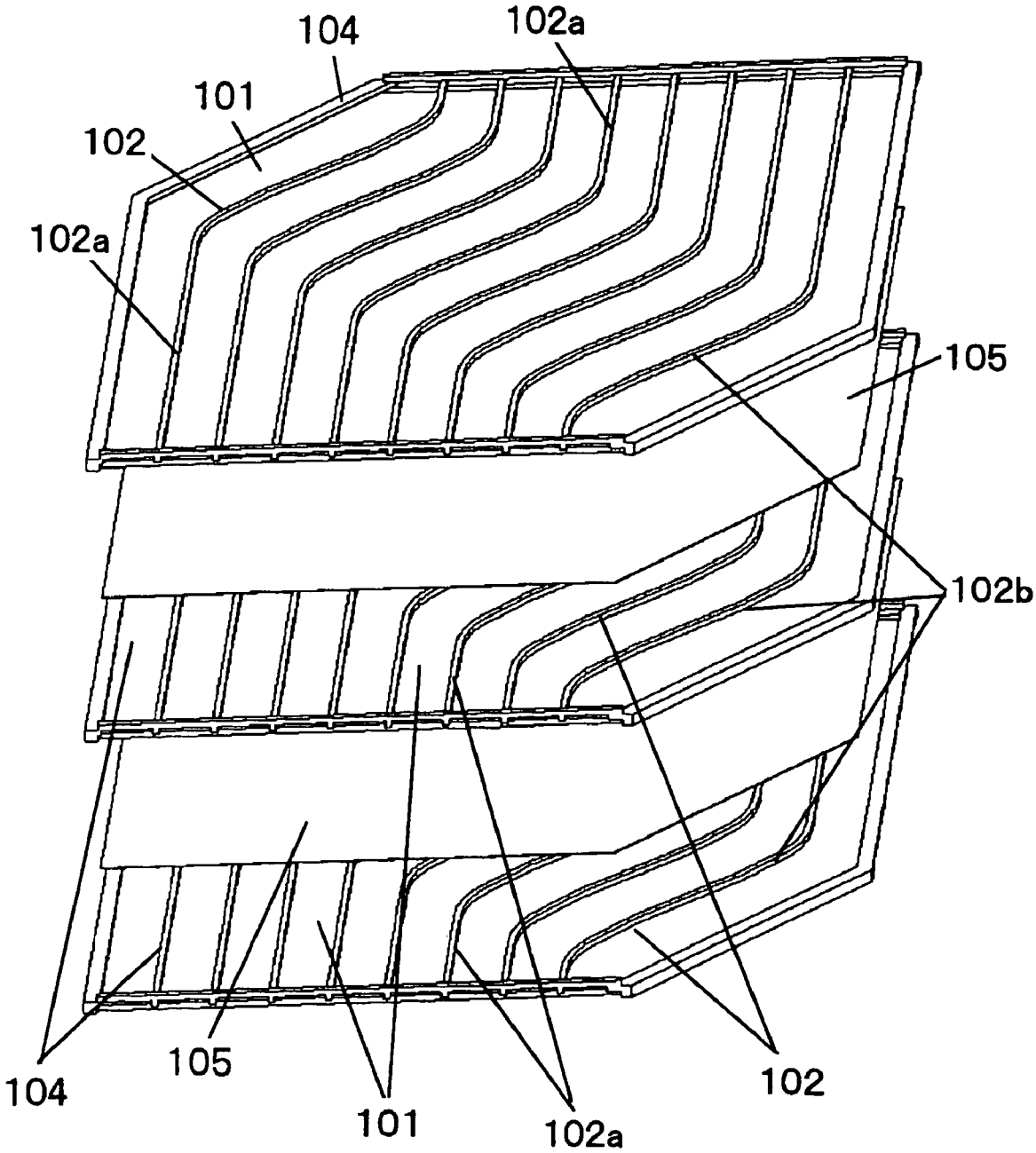
FIG. 46 is a schematic exploded view at the time of laminating in accordance with a conventional Example.
Figure 47:
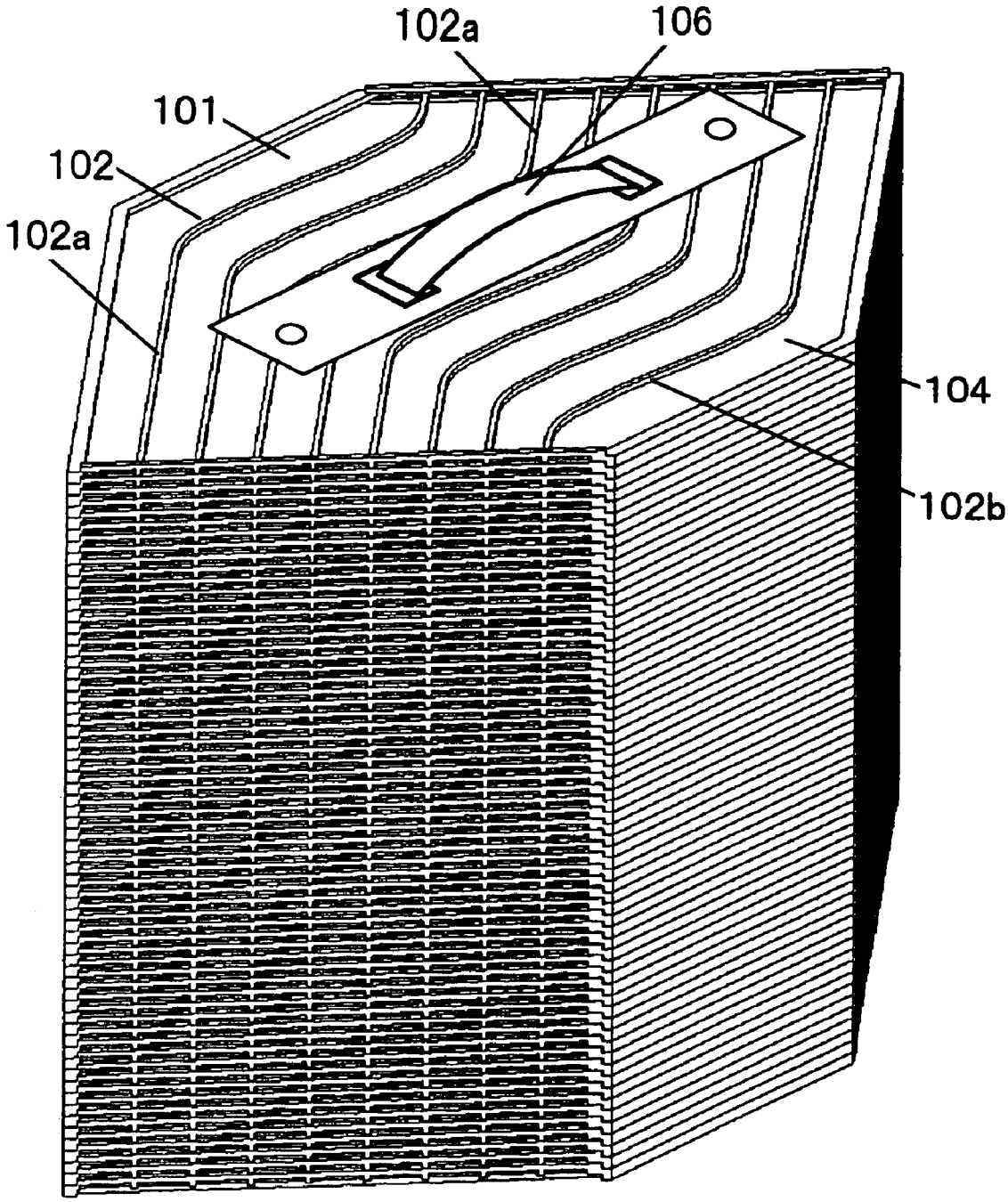
FIG. 47 is a schematic perspective view showing a state in which a handle is provided in accordance with a conventional Example.

FIG. 42 is a schematic exploded perspective view showing a heat exchanger used in this Example; and FIG. 43 is a schematic perspective view showing a state in which heat transfer plates are laminated.

As shown in FIGS. 42 and 43, the width of outer peripheral rib A12 of heat transfer plate A1 and heat transfer plate B2 is made to be, for example, 4 mm, the convex height of heat transfer plate A1 is made to be 4 mm with respect to the surface of heat transfer surface 5, and the convex height of heat transfer plate B2 is made to be 2 mm with respect to the surface of heat transfer surface 5. Heat transfer plate B2 has discontinuous side surface reinforcement convex portion 38 on the upper surface of outer peripheral rib 12. The width of side surface reinforcement convex portion 38 is made to be 4 mm that is equal to the width of outer peripheral rib A12 and the convex height thereof is 4 mm with respect to the surface of outer peripheral rib A12.

When heat transfer plates A1 and heat transfer plates B2 are laminated alternately, the upper surface and the side surface of outer peripheral ribs A12 formed on heat transfer plate A1 are brought into contact with the rear surface and the side surface of outer peripheral rib A12 formed on heat transfer plate B2, the upper surface and the side surface of side surface reinforcement convex portion 38 formed on outer peripheral rib A12 of heat transfer plate B2 are brought into contact with the rear surface and the side surface of outer peripheral rib A12 formed on heat transfer plate A1.

According to the above-mentioned configuration, when adjacent surfaces of the outer side surfaces of outer peripheral ribs A12 of heat exchanger 21 are thermally welded to each other, a hollow convex portion of outer peripheral rib A12 of heat transfer plate A1 is brought into contact with side surface reinforcement convex portion 38 of heat transfer plate B2. Thereby, after heated transfer plates are melted, when a temperature decreases and respective heat transfer plates are welded, deformation of the side surface portion due to temperature shrinkage is prevented, and deterioration of the sealing property due to the deformation is further prevented. Thus, the sealing property of the side surface portion can be improved.

As is apparent from the above-mentioned Examples, according to the present invention, since the air flow passage rib, the outer peripheral rib A and the outer peripheral rib B are formed in a hollow shape by folding one sheet into a convex shape, weight is reduced and an amount of materials to be cast can be reduced, so that material cost is reduced. The heat transfer plates are formed of a single material of sheet material, so that high recycling property is achieved. Fluid flows into a hollow portion of the air flow passage ribs and heat exchange is carried out also in the air flow passage ribs, thus improving the heat exchanging efficiency. Close contact between the groove A and groove B, close contact between the upper surface of the outer peripheral rib A and the outer peripheral rib B and the heat transfer plate laminated in the upper part thereof, and contact between the outer side surfaces make it possible to seal between the air flow passage A and the air flow passage B. Because of the close contact between the protrusions and the outer peripheral rib B and the groove B provided on a heat transfer plates laminated in the upper part thereof, dislocation of heat transfer plates does not easily occur, deterioration of the sealing property due to the cutting accuracy and dislocation, and the like, of the heat transfer plates can be suppressed. Consequently, it is possible to obtain a heat exchanger in which the sealing property between the air flow passage A and the air flow passage B is high, laminating operation is easy and productive efficiency is high.

Furthermore, it is possible to obtain a heat exchanger in which heat transfer plates are easily molded into convex and concave shapes and which has an excellent productivity.

Furthermore, it is possible to obtain a heat exchanger having a high sealing property and a high operation efficiency since molded product is hard and less flexible.

Furthermore, it is possible to obtain a heat exchanger with a low material cost, excellent moldability or dimension stability and high productive efficiency.

Furthermore, it is possible to obtain a heat exchanger with high productive efficiency because an opening portion is formed on the outer side surface of outer peripheral rib B at the same time when a heat transfer plate is cut out of a molded sheet.

Furthermore, in at least two corner portions of heat transfer plate A and heat transfer plate B, since overlapped portions of the adjacent heat transfer plates are thermally welded over the entire length in the laminating direction and the laminated heat transfer plates are fixed to each other, deterioration of a sealing property of air flow passage due to dislocation of the heat transfer plates can be prevented. Consequently, it is possible to obtain a heat exchanger with a high sealing property.

Furthermore, on the surface on which the inlets and outlets of air flow passages A and air flow passages B are formed, since overlapped portions of the adjacent heat transfer plates are thermally welded over the entire surface, a sealing property of one air flow passage with respect to another air flow passage in the inlet and outlet portions of the air flow passages is improved. Consequently, it is possible to obtain a heat exchanger with a high sealing property.

Furthermore, since overlapped portions of the outer side surfaces of the adjacent heat transfer plates are thermally welded over the entire surface and all the outer side surface portions of air flow passages are sealed, it is possible to obtain a heat exchanger with a high sealing property of air flow passages.

Furthermore, adjacent surfaces to be thermally welded are thermally welded simultaneously, thereby it is possible to obtain a heat exchanger with high productive efficiency.

Furthermore, it is possible to obtain a heat exchanger capable of thermally welding individual surfaces to be thermally welded and having a high sealing property.

Furthermore, since a thermal welding means moves while rotating in the direction that is the same as the laminating direction, the outer peripheral side surfaces of heat transfer plates are pressed in the same direction as the direction in which heat transfer plates are folded and the upper surface of the surfaces to be thermally welded is pressed to a lower surface reliably. Consequently, surfaces to be thermally welded can be welded reliably and a heat exchanger with a high sealing property can be obtained.

Furthermore, since a handle is provided in the direction perpendicular to the laminating direction of heat transfer plates or in the laminating direction of heat transfer plates, it is possible to obtain a heat exchanger capable of being attached and detached to/from equipment in the laminating direction and in the direction perpendicular to the laminating direction.

Furthermore, since a first end surface member and a support member are integrated with each other, man-hour of coupling the first end surface member and the support member can be reduced. Consequently, it is possible to obtain a heat exchanger with high productive efficiency.

Furthermore, since a second end surface member is affixed to heat transfer plates at both ends and at the same time, a band-like handle member is fixed, it is possible to obtain a heat exchanger with high productive efficiency. Since the second end surface member is formed of an elastic body, it is possible to obtain a heat exchanger with a high sealing property at the end surface thereof when it is mounted onto the equipment.

Furthermore, since a band-like handle member is provided in the direction perpendicular to the laminating direction of heat transfer plates or in the laminating direction, it is possible to obtain a heat exchanger capable of being attached and detached to/from equipment in the laminating direction and in the direction perpendicular to the laminating direction. Since a second end surface member is affixed to heat transfer plates located at both end surface and at the same time, a band-like handle member is fixed, it is possible to obtain a heat exchanger with high productive efficiency. Since the second end surface member is formed of an elastic body, it is possible to obtain a heat exchanger with a high sealing property at the end surface of the heat exchanger when it is mounted onto the equipment.

Furthermore, when adjacent surfaces of the outer side surface of outer peripheral rib A of a heat exchanger are thermally welded, a hollow convex portion of outer peripheral rib A of heat transfer plate A is brought into contact with a side surface reinforcement convex portion of heat transfer plate B. Thereby, after heated transfer plates are melted, when a temperature decreases and respective heat transfer plates are welded, deformation of the side surface portion due to temperature shrinkage is prevented, and deterioration of the sealing property due to the deformation is further prevented. Thus, it is possible to obtain a heat exchanger with a high sealing property.

Furthermore, when adjacent surfaces of the outer side surface of outer peripheral rib A of a heat exchanger are thermally welded to each other, hollow convex portions of the outer peripheral ribs A of the heat transfer plate A and the heat transfer plate B are brought into contact with the respective side surface reinforcement convex portions. Thereby, after heated transfer plates are melted, when a temperature decreases and respective heat transfer plates are welded, deformation of the side surface portion due to temperature shrinkage is prevented, and deterioration of the sealing property due to the deformation is further prevented. It is possible to obtain a heat exchanger with a high sealing property.

Furthermore, when the upper surface of the outer peripheral rib A of the heat transfer plate B is provided with the side surface reinforcement convex portion and the heat transfer plates A and the heat transfer plates B are laminated alternately, the upper surface of the outer peripheral rib A formed on the heat transfer plate A is brought into contact with the rear surface of the outer peripheral rib A formed on the heat transfer plate B, the upper surface of the outer peripheral rib A formed on the heat transfer plate B is brought into contact with the rear surface of the heat transfer surface provided on the heat transfer plate A, and the upper surface and the side surface of the side surface reinforcement convex portion formed on the outer peripheral rib A of the heat transfer plate B is brought into contact with the rear surface and side surface of the outer peripheral rib A formed on the heat transfer plate A.

According to the present invention, when adjacent surfaces of the outer side surface of the outer peripheral rib A of the heat exchanger are thermally welded, after heated transfer plates are melted, when a temperature decreases and respective heat transfer plates are welded, deformation of the side surface portion due to temperature shrinkage is prevented, and deterioration of sealing property due to deformation is further prevented. It is possible to obtain a heat exchanger with a high sealing property.

A side surface reinforcement convex portion having a discontinuous shape is shown.

According to the present invention, when adjacent surfaces of the outer side surface of the outer peripheral rib A of the heat exchanger are thermally welded, after heated transfer plates are melted, when a temperature decreases and respective heat transfer plates are welded, deformation of the side surface portion due to temperature shrinkage is prevented, and deterioration of a sealing property due to deformation is further prevented. Thus, it is possible to obtain a heat exchanger with a high sealing property.

Furthermore, when a side surface reinforcement convex portions is provided on the upper surface of the outer peripheral rib A of the heat transfer plate A and the heat transfer plate B and the heat transfer plates A and the heat transfer plates B are laminated alternately, the upper surface and the side surface of the side surface reinforcement convex portion formed on the heat transfer plate A are brought into contact with the rear surface and the side surface of the outer peripheral rib A formed on the heat transfer plate B, and the upper surface and the side surface of the side surface reinforcement convex portion formed on the heat transfer plate B are brought into contact with the rear surface and the side surface of the outer peripheral rib A formed on the heat transfer plate A.

According to the present invention, when adjacent surfaces of the outer side surface of the outer peripheral rib A of the heat exchanger are thermally welded, after heated transfer plates are melted, when a temperature decreases and respective heat transfer plates are welded, deformation of the side surface portion due to temperature shrinkage is prevented, and deterioration of a sealing property due to deformation is further prevented. Thus, it is possible to obtain a heat exchanger with a high sealing property.

Furthermore, when the heat transfer plates A and the heat transfer plates B are laminated alternately, the upper surface and the side surface of the outer peripheral rib A formed on the heat transfer plate A are brought into contact with the rear surface and side surface of the outer peripheral rib A formed on the heat transfer plate B, and the upper surface and the side surface of the side surface reinforcement convex portion formed on the outer peripheral rib A of the heat transfer plate B are brought into contact with the rear surface and side surface of the outer peripheral rib A formed on the heat transfer plate A.

According to the present invention, when adjacent surfaces of the outer side surfaces of the outer peripheral ribs A of the heat exchanger are thermally welded, after heated transfer plates are melted, when a temperature decreases and respective heat transfer plates are welded, deformation of the side surface portion due to temperature shrinkage is prevented, and deterioration of a sealing property due to deformation is further prevented. Thus, it is possible to obtain a heat exchanger with a high sealing property.

INDUSTRIAL APPLICABILITY

The present invention provides a heat exchanger for use in heat exchanging ventilation equipment or other air conditioning equipment, in which multiple heat transfer plates are laminated alternately and air flow passages A and air flow passages B are formed alternately. The heat exchanger according to the present invention has light weight, an excellent recycling property and an excellent sealing property of air flow passages without using an adhesive agent.

This invention claimed is:

1. A heat exchanger comprising:

a heat transfer plate A and a heat transfer plate B;

a plurality of air flow passage ribs formed in a substantially S-shaped hollow convex and disposed substantially parallel to each other and substantially at equal intervals, the plurality of air flow passage ribs forming a plurality of substantially S-shaped air flow passages and heat transfer surfaces;

an air flow passage end surface provided at an inlet and an outlet of the air flow passage of the heat transfer plate A, the air flow passage end surface being provided obliquely or perpendicular to a direction of the inlet and outlet of the air flow passage and provided by folding the heat transfer surface in a direction opposite to a convex direction of the air flow passage rib;

a groove A provided parallel to the air flow passage end surface on the heat transfer plate A;

a plurality of protrusions each having a hollow shape being convex in the same direction as the convex direction of the air flow passage rib, which are provided between the groove A and the air flow passage end surface on extended lines of the plurality of air flow passage ribs on the heat transfer surface in the vicinity of the air flow passage end surface, each of the plurality of protrusions having a pair of side surfaces substantially parallel to the air flow passage end surface and being higher than a height in the convex direction of the plurality of air flow passage ribs;

outer peripheral edge portions being other than portions of the inlets and outlets of the air flow passages on the heat transfer plate, the outer peripheral edge portions including one pair of outer peripheral edge portions A facing each other and being adjacent to the inlets and outlets of the air flow passages and which are provided substantially parallel to substantially central portions of the plurality of substantially S-shaped air flow passage ribs, and another pair of outer peripheral edge portions B facing each other and being adjacent to the inlets and outlets of the air flow passages and which are provided substantially parallel to the air flow passage rib in the portion of the inlets and outlets of the plurality of substantially S-shaped air flow passages;

the outer peripheral edge portion A having an outer peripheral rib A obtained by forming the heat transfer surface into a hollow shape that is convex in the same direction as the convex direction of the air flow passage rib, in which a convex height of the outer peripheral rib A is higher than a height in a convex direction of the air flow passage rib A and an outer side surface of the outer peripheral rib A is folded in a direction opposite to the convex direction of the air flow passage rib so as to have a folding dimension that is larger than a dimension of the height in the convex direction of the outer peripheral rib A with respect to the heat transfer surface;

the outer peripheral edge portion B having an outer peripheral rib B obtained by forming the heat transfer surface into a hollow shape that is convex in the same direction as the convex direction of the air flow passage rib, in which a convex height of the outer peripheral rib B is the same height in a convex direction of the air flow passage rib B and a central portion of an outer side surface of the outer peripheral rib B is folded to the same plane as the heat transfer surface so as to have an opening portion at the outer side surface of the outer peripheral rib B;

an air flow passage end surface cover provided at both ends of the outer side surface of the outer peripheral rib B, which is folded to the same position as the folding position of the air flow passage end surface; and a groove B provided on an upper surface of the outer peripheral rib B, the groove B being caved to the same plane as the heat transfer surface, on a position in which a distance between a side surface of the outer peripheral rib B and a center line of the groove B is equal to a distance between a center line of the groove A and the air flow passage end surface, in a shape in which an outer surface in a longitudinal direction of the groove A is brought into close contact with an inner surface in a longitudinal direction of the groove B, wherein the heat transfer plate B is mirror-image relation to the heat transfer plate A;

in a shape of the heat transfer plate B, a height in a convex direction of the outer peripheral rib A of the heat transfer plate B is allowed to be the same as a height in a convex direction of the air flow passage rib;

furthermore, a width of the outer peripheral rib A of the heat transfer plate B is larger than a width of the outer peripheral rib A provided in the heat transfer plate A;

each of the heat transfer plate A and the heat transfer plate B is integrated by using one sheet as a material, respectively;

the heat transfer plates A and the heat transfer plates B are laminated alternately in a way in which the outer peripheral rib A of the heat transfer plate A and the outer peripheral rib A of the heat transfer plate B are overlapped with each other; and the heat transfer plates A and the heat transfer plates B are laminated to each other, resulting in forming the air flow passage A and the air flow passage B alternately; and wherein, when the heat transfer plates A and the heat transfer plates B are laminated alternately, upper surfaces of the air flow passage ribs, the protrusions, the outer peripheral ribs A and the outer peripheral ribs B are brought into contact with a heat transfer plate to be laminated on an upper part thereof;

the groove B is brought into contact with an upper surface of the outer peripheral rib B provided on a heat transfer plate located in a lower part of the groove B;

a pair of side surfaces of the protrusions being parallel to the air flow passage end surface are brought into contact with at least one of an inner side surface of the outer peripheral rib B and a side surface of the groove B provided in the heat transfer plate to be laminated on an upper part of the protrusions;

the air flow passage end surface is brought into contact with an outer side surface of the outer peripheral rib B provided on a heat transfer plate located in a lower part of the air flow passage end surface;

side surfaces of the outer peripheral ribs A provided respectively on the heat transfer plate A and the heat transfer plate B are brought into contact with each other; and the air flow passage end surface cover is brought into contact with an end surface of the outer peripheral rib A and the outer peripheral rib B provided on a heat transfer plate located in a lower part of the air flow passage end surface cover.

2. The heat exchanger according to claim 1, wherein the sheet is a thermoplastic resin sheet.

3. The heat exchanger according to claim 1, wherein the sheet is a styrene resin sheet.

4. The heat exchanger according to claim 1, wherein the sheet is a polystyrene resin sheet.

5. The heat exchanger according to claim 1, wherein when the heat transfer plates A and the heat transfer plates B are integrated with each other, by carrying out a molding process by the use of a molding die having a rectangular shaped portion that continues to the outer side surface of the outer peripheral rib B and has a cross sectional shape equal to an opening portion formed on the outer side surface of the outer peripheral rib B, and then cutting a portion formed by the rectangular shaped portion and a sheet portion other than the heat transfer plate A and the heat transfer plate B along the outer side surfaces of the heat transfer plate A and the heat transfer plate B, the heat transfer plate A and the heat transfer plate B are manufactured.

6. The heat exchanger according to claim 1, wherein in at least two corner portions of the heat transfer plate A and the heat transfer plate B, overlapped portions of the air flow passage end surface cover, the outer peripheral rib A, the outer peripheral rib B or the air flow passage end surface, which are formed on an outer side surface of adjacent heat transfer plates, are thermally welded over an entire length in the laminated direction.

7. The heat exchanger according to claim 1, wherein in a surface on which the inlets and outlets of the air flow passages A and the air flow passages B are formed, overlapped portions of the air flow passage end surface cover, the outer peripheral rib A, the outer peripheral rib B and the air flow passage end surface, which are formed on an outer side surface of adjacent heat transfer plates, are thermally welded over an entire surface.

8. The heat exchanger according to claim 1, wherein overlapped portions on an outer side surface of adjacent heat transfer plates are thermally welded over an entire surface.

9. The heat exchanger according to claim 1, wherein when adjacent portions on an outer side surface of the heat exchanger is thermally welded, the adjacent portions on an outer side surface of the heat exchanger is thermally welded simultaneously by a thermal welding means having a thermally welding surface having a shape corresponding to a shape of the adjacent portions on an outer side surface of the heat exchanger.

10. The heat exchanger according to claim 1, wherein when adjacent portions on an outer side surface of the heat exchanger are thermally welded, by vertically pressing a thermal welding means having substantially the same shape as respective surfaces to be thermally welded to a surface to be thermally welded, the outer side surface of the heat exchanger is thermally welded.

11. The heat exchanger according to claim 1, wherein the outer side surface of the heat exchanger is thermally welded by the use of a thermal welding means having a cylindrical-shaped thermally welding surface, by pressing the thermally welding surface of the thermal welding means to the heat exchanger and moving while rotating it from an upper part to a lower part along a laminating direction of the heat transfer plates.

12. The heat exchanger according to any one of claims 1, 2, 3, 4, 5, 6, 7, 8, 9, 10 and 11, comprising:

the first end surface members, which are facing each other, at both end surfaces in the laminating direction in which the heat transfer plates A and the heat transfer plates B are laminated alternately;

a side surface plate covering an outer side surface of the laminated heat transfer plates A and the heat transfer plates B and which is provided at an outer peripheral edge portion of the first end surface member;

a support member provided on an outer side surface of the outer peripheral rib A of the laminated heat transfer plates with both ends thereof coupled to the first end surface members;

elastic bodies included between the first end surface members and the heat transfer plates located at both ends, respectively, the elastic body having a shape of pressing at least outer peripheral edge portions of the heat transfer plates located at both end surfaces; and a handle provided on at least one of the first end surface member and the support member.

13. The heat exchanger according to any one of claims 1, 2, 3, 4, 5, 6, 7, 8, 9, 10 and 11, wherein the first end surface members and the support members are integrated with each other with one of the support members separated;

the first end surface members are disposed so that the first end surface members facing each other via the elastic bodies respectively at both end surfaces in the direction in which the heat transfer plates A and the heat transfer plates B are laminated; and the support members are disposed at the outer side surface of the outer peripheral rib A of the laminated heat transfer plates in which the separated portions of the separated support member are coupled to each other.

14. The heat exchanger according to any one of claims 6, 7, 8, 9, 10 and 11, comprising second end surface members affixed to heat transfer plates located at both end surfaces of the alternately laminated heat transfer plates A and heat transfer plates B, the second end surface member being formed of an elastic body molded in a shape that is the same as a shape of the outer peripheral edge portion of at least the heat transfer plate A or the heat transfer plate B; and a band-like handle member provided along at least one side surface of the outer side surface of the outer peripheral rib A, the band-like handle member being fixed to the heat transfer plates located at both end surfaces by the second end surface members.

15. The heat exchanger according to any one of claims 6, 7, 8, 9, 10 and 11, comprising second end surface members affixed to heat transfer plates located at both end surfaces of the alternately laminated heat transfer plates A and heat transfer plates B, the second end surface member being formed of an elastic body molded in a shape that is the same as a shape of the outer peripheral edge portion of at least the heat transfer plate A or the heat transfer plate B; and a band-like handle member provided along the outer side surface of the outer peripheral rib A, the band-like handle member being fixed to the heat transfer plate located at the end surface by the second end surface member at one end surface in the laminating direction of the laminated heat transfer plates, and disposed at the outside of the second end surface member at another end in the laminating direction of the laminated heat transfer plates.

16. The heat exchanger according to claim 1, wherein a side surface reinforcement convex portion is provided on an upper surface of the outer peripheral rib A of the heat transfer plate B, and when the heat transfer plates A and the heat transfer plates B are laminated alternately, an upper surface of the outer peripheral rib A formed on the heat transfer plate A is brought into contact with a rear surface of the outer peripheral rib A formed on the heat transfer plate B, an upper surface of the outer peripheral rib A formed on the heat transfer plate B is brought into contact with a rear surface of the heat transfer surface provided on the heat transfer plate A, and an upper surface and a side surface of the side surface reinforcement convex upper surface formed on the outer peripheral rib A of the heat transfer plate B are brought into contact with a rear surface and a side surface of the outer peripheral rib A formed on the heat transfer plate A.

17. The heat exchanger according to claim 16, wherein the side surface reinforcement convex portion is formed in a discontinuous shape.

18. The heat exchanger according to claim 17, wherein a side surface reinforcement convex portion is provided on an upper surface of the outer peripheral rib A of the heat transfer plate A and the heat transfer plate B, and when the heat transfer plates A and the heat transfer plates B are laminated alternately, an upper surface and a side surface of the side surface reinforcement convex portion formed on the heat transfer plate A are brought into contact with a rear surface and a side surface of the outer peripheral rib A formed on the heat transfer plate B, and an upper surface and a side surface of the side surface reinforcement convex portion formed on the heat transfer plate B are brought into contact with a rear surface and a side surface of the outer peripheral rib A.

19. The heat exchanger according to claim 17, wherein when the heat transfer plates A and the heat transfer plates B are laminated alternately, an upper surface and a side surface of the outer peripheral rib A formed on the heat transfer plate A are brought into contact with a rear surface and a side surface of the outer peripheral rib A formed on the heat transfer plate B, and an upper surface and a side surface of the side surface reinforcement convex portion formed on the outer peripheral rib A of the heat transfer plate B are brought into contact with a rear surface and a side surface of the outer peripheral rib A formed on the heat transfer plate A.

20. A heat transfer plate, comprising a plurality of ribs defining a plurality of air flow passages;

outer ribs along opposite edges of said heat transfer plate, each of said outer ribs including a respective groove;

a plurality of protrusions along a further edge of said heat transfer plate, said protrusions separated from each other by said air flow passages;

a groove extending along said protrusions on a side of said protrusions away from said further edge.

21. A heat exchanger, comprising a plurality of heat transfer plates, each comprising a plurality of ribs defining a plurality of air flow passages;

outer ribs along opposite edges of said heat transfer plate, each of said outer ribs including a respective groove;

a plurality of protrusions along a further edge of said heat transfer plate, said protrusions separated from each other by said air flow passages;

a groove extending along said protrusions on a side of said protrusions away from said further edge, wherein one of said opposite edges of one of said heat transfer plates is placed along said further edge of another of said heat transfer plates.

* * * * *